US009786115B2

(12) United States Patent
Hirato et al.

(10) Patent No.: US 9,786,115 B2
(45) Date of Patent: Oct. 10, 2017

(54) REEL STRIP AND GAMING MACHINE

(71) Applicants: Universal Entertainment Corporation, Tokyo (JP); Aruze Gaming America, Inc., Las Vegas, NV (US)

(72) Inventors: Jun Hirato, Tokyo (JP); Motomichi Sato, Tokyo (JP); Keita Shimura, Tokyo (JP); Masumi Sakamoto, Tokyo (JP); Takuto Nakayama, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 414 days.

(21) Appl. No.: 14/485,919

(22) Filed: Sep. 15, 2014

(65) Prior Publication Data

US 2015/0080107 A1 Mar. 19, 2015

(30) Foreign Application Priority Data

Sep. 19, 2013 (JP) ..... 2013-194566
May 19, 2014 (JP) ..... 2014-103624

(51) Int. Cl.
*G07F 17/32* (2006.01)

(52) U.S. Cl.
CPC ..... *G07F 17/3213* (2013.01)

(58) Field of Classification Search
CPC ..... G07F 17/3213
See application file for complete search history.

(56) References Cited

U.S. PATENT DOCUMENTS 6,531,230 B1 3/2003 Weber
7,380,791 B2 * 6/2008 Gauselmann ..... G07F 17/3202 273/138.1
8,105,154 B2 1/2012 Okada
2003/0035972 A1 * 2/2003 Hanson ..... B32B 7/02 428/480
2003/0195035 A1 * 10/2003 Onuki ..... G07F 17/3202 463/20
2004/0009807 A1 1/2004 Mille

FOREIGN PATENT DOCUMENTS

JP 2011-085959 4/2011

* cited by examiner

*Primary Examiner* — Werner Garner
(74) *Attorney, Agent, or Firm* — Lex IP Meister, PLLC

(57) ABSTRACT

There is provided a gaming machine capable of providing an effect for symbol display during a stop and/or rotation of a reel, by use of a totally non-conventional effect element, which is an angle of a line of sight to an outer circumferential surface of the reel. Reel strips M32 each having symbols 501 are respectively disposed on outer circumferential surfaces of cylindrical reels M31 each configured to be rotated with its cylinder central axis being held at a predetermined position. Each reel strip M32 includes a color shifting layer M321 configured to selectively reflect and transmit predetermined wavelengths of visible light depending on the incident angle.

19 Claims, 74 Drawing Sheets

FIG.35

| SYMBOL CODE | FIRST ARRAY | SECOND ARRAY | THIRD ARRAY | FOURTH ARRAY | FIFTH ARRAY |
|---|---|---|---|---|---|
| 00 | BAR BAR | BAR BAR BAR | BAR | BAR | BAR BAR |
| 01 | BLANK | BLANK | BLANK | BLANK | BLANK |
| 02 | BONUS | 7 | BONUS | 7 | BONUS |
| 03 | BLANK | BLANK | BLANK | BLANK | BLANK |
| 04 | 7 | BONUS | BAR | BONUS | 7 |
| 05 | BLANK | BLANK | BLANK | BLANK | BLANK |
| 06 | BAR BAR BAR | BAR BAR | BAR BAR | BAR BAR | BAR BAR BAR |
| 07 | BLANK | BLANK | BLANK | BLANK | BLANK |
| 08 | BONUS | BONUS | 7 | BONUS | BONUS |
| 09 | BLANK | BLANK | BLANK | BLANK | BLANK |
| 10 | BAR BAR BAR | BAR BAR BAR | BAR BAR | BAR | BAR BAR BAR |
| 11 | BLANK | BLANK | BLANK | BLANK | BLANK |
| 12 | BAR | BAR | BAR | BAR BAR BAR | BAR |
| 13 | BLANK | BLANK | BLANK | BLANK | BLANK |
| 14 | 7 | 7 | 7 | 7 | 7 |
| 15 | BLANK | BLANK | BLANK | BLANK | BLANK |
| 16 | BAR | BAR | BAR BAR BAR | BAR BAR BAR | BAR |
| 17 | BLANK | BLANK | BLANK | BLANK | BLANK |
| 18 | | | | | |
| 19 | BLANK | BLANK | BLANK | BLANK | BLANK |
| 20 | BAR | BAR | BAR BAR BAR | BAR BAR BAR | BAR |
| 21 | BLANK | BLANK | BLANK | BLANK | BLANK |

FIG.38

NORMAL GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 6 | 3BAR | 4 | 1BAR | 10 | 1BAR | 7 | 2BAR | 2 |
| 1 | BLANK | 6 | BLANK | 4 | BLANK | 10 | BLANK | 7 | BLANK | 2 |
| 2 | BONUS | 6 | SEVEN | 4 | BONUS | 10 | SEVEN | 7 | BONUS | 4 |
| 3 | BLANK | 6 | BLANK | 4 | BLANK | 10 | BLANK | 7 | BLANK | 4 |
| 4 | SEVEN | 6 | BONUS | 6 | 1BAR | 30 | BONUS | 5 | SEVEN | 4 |
| 5 | BLANK | 6 | BLANK | 6 | BLANK | 36 | BLANK | 5 | BLANK | 4 |
| 6 | 3BAR | 6 | 2BAR | 6 | 2BAR | 16 | 2BAR | 5 | 3BAR | 4 |
| 7 | BLANK | 6 | BLANK | 6 | BLANK | 18 | BLANK | 5 | BLANK | 4 |
| 8 | BONUS | 6 | BONUS | 4 | SEVEN | 12 | BONUS | 7 | BONUS | 2 |
| 9 | BLANK | 6 | BLANK | 4 | BLANK | 18 | BLANK | 7 | BLANK | 2 |
| 10 | 2BAR | 32 | 3BAR | 34 | 2BAR | 30 | 1BAR | 15 | 2BAR | 34 |
| 11 | BLANK | 38 | BLANK | 34 | BLANK | 36 | BLANK | 15 | BLANK | 34 |
| 12 | 1BAR | 20 | 1BAR | 18 | 1BAR | 4 | 3BAR | 35 | 1BAR | 30 |
| 13 | BLANK | 22 | BLANK | 18 | BLANK | 4 | BLANK | 35 | BLANK | 30 |
| 14 | SEVEN | 16 | SEVEN | 18 | SEVEN | 4 | SEVEN | 35 | SEVEN | 30 |
| 15 | BLANK | 22 | BLANK | 18 | BLANK | 4 | BLANK | 35 | BLANK | 30 |
| 16 | 1BAR | 1 | 1BAR | 2 | 3BAR | 1 | 3BAR | 7 | 1BAR | 7 |
| 17 | BLANK | 1 | BLANK | 2 | BLANK | 1 | BLANK | 7 | BLANK | 7 |
| 18 | CHERRY | 1 | CHERRY | 2 | CHERRY | 1 | CHERRY | 7 | CHERRY | 7 |
| 19 | BLANK | 1 | BLANK | 2 | BLANK | 1 | BLANK | 7 | BLANK | 7 |
| 20 | 1BAR | 32 | 1BAR | 34 | 3BAR | 4 | 3BAR | 15 | 1BAR | 34 |
| 21 | BLANK | 38 | BLANK | 34 | BLANK | 4 | BLANK | 15 | BLANK | 34 |
| | | 284 | | 264 | | 264 | | 290 | | 316 |

FIG.39

FIRST BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 1 | BLANK | 1 | BLANK | 2 | BLANK | 2 |
| 2 | BONUS | 0 | SEVEN | 12 | BONUS | 1 | SEVEN | 2 | BONUS | 3 |
| 3 | BLANK | 22 | BLANK | 1 | BLANK | 1 | BLANK | 2 | BLANK | 1 |
| 4 | SEVEN | 2 | BONUS | 1 | 1BAR | 0 | BONUS | 2 | SEVEN | 2 |
| 5 | BLANK | 2 | BLANK | 1 | BLANK | 0 | BLANK | 2 | BLANK | 1 |
| 6 | 3BAR | 0 | 2BAR | 0 | 2BAR | 0 | 2BAR | 1 | 3BAR | 2 |
| 7 | BLANK | 0 | BLANK | 0 | BLANK | 8 | BLANK | 7 | BLANK | 6 |
| 8 | BONUS | 0 | BONUS | 0 | SEVEN | 3 | BONUS | 6 | BONUS | 6 |
| 9 | BLANK | 0 | BLANK | 0 | BLANK | 11 | BLANK | 7 | BLANK | 6 |
| 10 | 2BAR | 0 | 3BAR | 0 | 2BAR | 0 | 1BAR | 3 | 2BAR | 2 |
| 11 | BLANK | 0 | BLANK | 0 | BLANK | 0 | BLANK | 1 | BLANK | 2 |
| 12 | 1BAR | 0 | 1BAR | 0 | 1BAR | 0 | 3BAR | 1 | 1BAR | 2 |
| 13 | BLANK | 5 | BLANK | 4 | BLANK | 8 | BLANK | 1 | BLANK | 2 |
| 14 | SEVEN | 1 | SEVEN | 24 | SEVEN | 3 | SEVEN | 2 | SEVEN | 2 |
| 15 | BLANK | 5 | BLANK | 4 | BLANK | 11 | BLANK | 1 | BLANK | 2 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 37 | | 48 | | 47 | | 40 | | 41 |

FIG.40

SECOND BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 0 | BLANK | 1 | BLANK | 1 | BLANK | 2 |
| 2 | BONUS | 0 | SEVEN | 1 | BONUS | 1 | SEVEN | 1 | BONUS | 2 |
| 3 | BLANK | 3 | BLANK | 1 | BLANK | 1 | BLANK | 2 | BLANK | 2 |
| 4 | SEVEN | 15 | BONUS | 1 | 1BAR | 0 | BONUS | 4 | SEVEN | 1 |
| 5 | BLANK | 2 | BLANK | 1 | BLANK | 0 | BLANK | 2 | BLANK | 3 |
| 6 | 3BAR | 0 | 2BAR | 0 | 2BAR | 0 | 2BAR | 1 | 3BAR | 2 |
| 7 | BLANK | 0 | BLANK | 0 | BLANK | 2 | BLANK | 2 | BLANK | 2 |
| 8 | BONUS | 0 | BONUS | 0 | SEVEN | 24 | BONUS | 2 | BONUS | 2 |
| 9 | BLANK | 0 | BLANK | 0 | BLANK | 2 | BLANK | 2 | BLANK | 2 |
| 10 | 2BAR | 0 | 3BAR | 0 | 2BAR | 0 | 1BAR | 1 | 2BAR | 4 |
| 11 | BLANK | 0 | BLANK | 0 | BLANK | 0 | BLANK | 1 | BLANK | 4 |
| 12 | 1BAR | 0 | 1BAR | 0 | 1BAR | 0 | 3BAR | 1 | 1BAR | 4 |
| 13 | BLANK | 1 | BLANK | 2 | BLANK | 1 | BLANK | 2 | BLANK | 4 |
| 14 | SEVEN | 12 | SEVEN | 23 | SEVEN | 12 | SEVEN | 2 | SEVEN | 1 |
| 15 | BLANK | 1 | BLANK | 2 | BLANK | 1 | BLANK | 2 | BLANK | 2 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 34 | | 31 | | 45 | | 26 | | 37 |

FIG.41

THIRD BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 0 | BLANK | 1 | BLANK | 2 | BLANK | 2 |
| 2 | BONUS | 0 | SEVEN | 4 | BONUS | 1 | SEVEN | 2 | BONUS | 2 |
| 3 | BLANK | 0 | BLANK | 18 | BLANK | 1 | BLANK | 2 | BLANK | 2 |
| 4 | SEVEN | 2 | BONUS | 0 | 1BAR | 0 | BONUS | 3 | SEVEN | 2 |
| 5 | BLANK | 4 | BLANK | 0 | BLANK | 0 | BLANK | 1 | BLANK | 2 |
| 6 | 3BAR | 0 | 2BAR | 0 | 2BAR | 0 | 2BAR | 1 | 3BAR | 2 |
| 7 | BLANK | 1 | BLANK | 0 | BLANK | 0 | BLANK | 4 | BLANK | 4 |
| 8 | BONUS | 1 | BONUS | 0 | SEVEN | 6 | BONUS | 8 | BONUS | 7 |
| 9 | BLANK | 1 | BLANK | 0 | BLANK | 12 | BLANK | 4 | BLANK | 4 |
| 10 | 2BAR | 0 | 3BAR | 0 | 2BAR | 0 | 1BAR | 4 | 2BAR | 3 |
| 11 | BLANK | 0 | BLANK | 0 | BLANK | 0 | BLANK | 2 | BLANK | 2 |
| 12 | 1BAR | 0 | 1BAR | 0 | 1BAR | 0 | 3BAR | 2 | 1BAR | 3 |
| 13 | BLANK | 0 | BLANK | 0 | BLANK | 0 | BLANK | 2 | BLANK | 1 |
| 14 | SEVEN | 6 | SEVEN | 2 | SEVEN | 5 | SEVEN | 2 | SEVEN | 2 |
| 15 | BLANK | 29 | BLANK | 2 | BLANK | 13 | BLANK | 1 | BLANK | 2 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 44 | | 26 | | 39 | | 40 | | 40 |

FIG.42

FOURTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 4 | BLANK | 1 | BLANK | 2 | BLANK | 2 |
| 2 | BONUS | 0 | SEVEN | 2 | BONUS | 1 | SEVEN | 2 | BONUS | 2 |
| 3 | BLANK | 18 | BLANK | 0 | BLANK | 1 | BLANK | 1 | BLANK | 2 |
| 4 | SEVEN | 4 | BONUS | 0 | 1BAR | 0 | BONUS | 3 | SEVEN | 2 |
| 5 | BLANK | 0 | BLANK | 0 | BLANK | 0 | BLANK | 2 | BLANK | 2 |
| 6 | 3BAR | 0 | 2BAR | 0 | 2BAR | 0 | 2BAR | 1 | 3BAR | 2 |
| 7 | BLANK | 0 | BLANK | 1 | BLANK | 12 | BLANK | 4 | BLANK | 4 |
| 8 | BONUS | 0 | BONUS | 1 | SEVEN | 6 | BONUS | 8 | BONUS | 7 |
| 9 | BLANK | 0 | BLANK | 1 | BLANK | 0 | BLANK | 4 | BLANK | 4 |
| 10 | 2BAR | 0 | 3BAR | 0 | 2BAR | 0 | 1BAR | 4 | 2BAR | 3 |
| 11 | BLANK | 0 | BLANK | 0 | BLANK | 0 | BLANK | 2 | BLANK | 2 |
| 12 | 1BAR | 0 | 1BAR | 0 | 1BAR | 0 | 3BAR | 2 | 1BAR | 3 |
| 13 | BLANK | 2 | BLANK | 29 | BLANK | 13 | BLANK | 1 | BLANK | 2 |
| 14 | SEVEN | 2 | SEVEN | 6 | SEVEN | 5 | SEVEN | 2 | SEVEN | 2 |
| 15 | BLANK | 0 | BLANK | 0 | BLANK | 0 | BLANK | 2 | BLANK | 1 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 26 | | 44 | | 39 | | 40 | | 40 |

FIG.43

FIFTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 0 | BLANK | 4 | BLANK | 2 | BLANK | 2 |
| 2 | BONUS | 0 | SEVEN | 3 | BONUS | 5 | SEVEN | 2 | BONUS | 3 |
| 3 | BLANK | 18 | BLANK | 1 | BLANK | 4 | BLANK | 2 | BLANK | 1 |
| 4 | SEVEN | 3 | BONUS | 1 | 1BAR | 0 | BONUS | 2 | SEVEN | 2 |
| 5 | BLANK | 6 | BLANK | 1 | BLANK | 0 | BLANK | 2 | BLANK | 1 |
| 6 | 3BAR | 0 | 2BAR | 0 | 2BAR | 0 | 2BAR | 2 | 3BAR | 2 |
| 7 | BLANK | 1 | BLANK | 1 | BLANK | 3 | BLANK | 3 | BLANK | 5 |
| 8 | BONUS | 1 | BONUS | 1 | SEVEN | 1 | BONUS | 3 | BONUS | 6 |
| 9 | BLANK | 1 | BLANK | 1 | BLANK | 3 | BLANK | 3 | BLANK | 5 |
| 10 | 2BAR | 0 | 3BAR | 0 | 2BAR | 0 | 1BAR | 4 | 2BAR | 2 |
| 11 | BLANK | 0 | BLANK | 0 | BLANK | 0 | BLANK | 5 | BLANK | 2 |
| 12 | 1BAR | 0 | 1BAR | 0 | 1BAR | 0 | 3BAR | 4 | 1BAR | 2 |
| 13 | BLANK | 2 | BLANK | 1 | BLANK | 3 | BLANK | 2 | BLANK | 2 |
| 14 | SEVEN | 1 | SEVEN | 6 | SEVEN | 1 | SEVEN | 2 | SEVEN | 2 |
| 15 | BLANK | 2 | BLANK | 1 | BLANK | 2 | BLANK | 2 | BLANK | 2 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 35 | | 17 | | 26 | | 40 | | 39 |

FIG.44

SIXTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 1 | BLANK | 0 | BLANK | 2 | BLANK | 2 |
| 2 | BONUS | 0 | SEVEN | 11 | BONUS | 0 | SEVEN | 1 | BONUS | 3 |
| 3 | BLANK | 12 | BLANK | 1 | BLANK | 0 | BLANK | 2 | BLANK | 1 |
| 4 | SEVEN | 2 | BONUS | 0 | 1BAR | 0 | BONUS | 2 | SEVEN | 2 |
| 5 | BLANK | 11 | BLANK | 0 | BLANK | 0 | BLANK | 2 | BLANK | 1 |
| 6 | 3BAR | 0 | 2BAR | 0 | 2BAR | 0 | 2BAR | 2 | 3BAR | 2 |
| 7 | BLANK | 0 | BLANK | 0 | BLANK | 17 | BLANK | 6 | BLANK | 6 |
| 8 | BONUS | 0 | BONUS | 0 | SEVEN | 3 | BONUS | 6 | BONUS | 6 |
| 9 | BLANK | 0 | BLANK | 0 | BLANK | 4 | BLANK | 6 | BLANK | 6 |
| 10 | 2BAR | 0 | 3BAR | 0 | 2BAR | 0 | 1BAR | 2 | 2BAR | 2 |
| 11 | BLANK | 0 | BLANK | 0 | BLANK | 0 | BLANK | 2 | BLANK | 2 |
| 12 | 1BAR | 0 | 1BAR | 0 | 1BAR | 0 | 3BAR | 2 | 1BAR | 2 |
| 13 | BLANK | 5 | BLANK | 1 | BLANK | 7 | BLANK | 2 | BLANK | 2 |
| 14 | SEVEN | 2 | SEVEN | 11 | SEVEN | 2 | SEVEN | 1 | SEVEN | 2 |
| 15 | BLANK | 13 | BLANK | 1 | BLANK | 4 | BLANK | 2 | BLANK | 2 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 45 | | 26 | | 37 | | 40 | | 41 |

FIG.45

SEVENTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 0 | BLANK | 3 | BLANK | 2 | BLANK | 1 |
| 2 | BONUS | 0 | SEVEN | 2 | BONUS | 4 | SEVEN | 1 | BONUS | 1 |
| 3 | BLANK | 1 | BLANK | 2 | BLANK | 3 | BLANK | 2 | BLANK | 1 |
| 4 | SEVEN | 11 | BONUS | 2 | 1BAR | 0 | BONUS | 1 | SEVEN | 1 |
| 5 | BLANK | 1 | BLANK | 2 | BLANK | 0 | BLANK | 2 | BLANK | 2 |
| 6 | 3BAR | 0 | 2BAR | 0 | 2BAR | 0 | 2BAR | 2 | 3BAR | 2 |
| 7 | BLANK | 0 | BLANK | 0 | BLANK | 2 | BLANK | 2 | BLANK | 1 |
| 8 | BONUS | 0 | BONUS | 0 | SEVEN | 12 | BONUS | 2 | BONUS | 4 |
| 9 | BLANK | 0 | BLANK | 0 | BLANK | 2 | BLANK | 2 | BLANK | 1 |
| 10 | 2BAR | 0 | 3BAR | 0 | 2BAR | 0 | 1BAR | 4 | 2BAR | 7 |
| 11 | BLANK | 0 | BLANK | 0 | BLANK | 0 | BLANK | 1 | BLANK | 5 |
| 12 | 1BAR | 0 | 1BAR | 0 | 1BAR | 0 | 3BAR | 1 | 1BAR | 5 |
| 13 | BLANK | 2 | BLANK | 3 | BLANK | 2 | BLANK | 3 | BLANK | 1 |
| 14 | SEVEN | 12 | SEVEN | 16 | SEVEN | 13 | SEVEN | 2 | SEVEN | 1 |
| 15 | BLANK | 2 | BLANK | 3 | BLANK | 2 | BLANK | 3 | BLANK | 1 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 29 | | 30 | | 43 | | 30 | | 34 |

FIG.46

EIGHTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 0 | BLANK | 1 | BLANK | 2 | BLANK | 1 |
| 2 | BONUS | 0 | SEVEN | 4 | BONUS | 1 | SEVEN | 2 | BONUS | 1 |
| 3 | BLANK | 0 | BLANK | 18 | BLANK | 1 | BLANK | 2 | BLANK | 1 |
| 4 | SEVEN | 2 | BONUS | 0 | 1BAR | 0 | BONUS | 2 | SEVEN | 2 |
| 5 | BLANK | 4 | BLANK | 0 | BLANK | 0 | BLANK | 2 | BLANK | 1 |
| 6 | 3BAR | 0 | 2BAR | 0 | 2BAR | 0 | 2BAR | 1 | 3BAR | 2 |
| 7 | BLANK | 0 | BLANK | 0 | BLANK | 0 | BLANK | 3 | BLANK | 0 |
| 8 | BONUS | 0 | BONUS | 0 | SEVEN | 8 | BONUS | 4 | BONUS | 0 |
| 9 | BLANK | 0 | BLANK | 0 | BLANK | 10 | BLANK | 3 | BLANK | 0 |
| 10 | 2BAR | 0 | 3BAR | 0 | 2BAR | 0 | 1BAR | 4 | 2BAR | 8 |
| 11 | BLANK | 0 | BLANK | 0 | BLANK | 0 | BLANK | 4 | BLANK | 9 |
| 12 | 1BAR | 0 | 1BAR | 0 | 1BAR | 0 | 3BAR | 5 | 1BAR | 9 |
| 13 | BLANK | 0 | BLANK | 0 | BLANK | 0 | BLANK | 2 | BLANK | 1 |
| 14 | SEVEN | 9 | SEVEN | 2 | SEVEN | 6 | SEVEN | 2 | SEVEN | 2 |
| 15 | BLANK | 26 | BLANK | 2 | BLANK | 10 | BLANK | 1 | BLANK | 3 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 41 | | 26 | | 37 | | 39 | | 40 |

FIG.47

NINTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 4 | BLANK | 1 | BLANK | 2 | BLANK | 1 |
| 2 | BONUS | 0 | SEVEN | 2 | BONUS | 1 | SEVEN | 2 | BONUS | 1 |
| 3 | BLANK | 18 | BLANK | 0 | BLANK | 1 | BLANK | 2 | BLANK | 1 |
| 4 | SEVEN | 4 | BONUS | 0 | 1BAR | 0 | BONUS | 2 | SEVEN | 2 |
| 5 | BLANK | 0 | BLANK | 0 | BLANK | 0 | BLANK | 2 | BLANK | 2 |
| 6 | 3BAR | 0 | 2BAR | 0 | 2BAR | 0 | 2BAR | 1 | 3BAR | 1 |
| 7 | BLANK | 0 | BLANK | 0 | BLANK | 10 | BLANK | 3 | BLANK | 0 |
| 8 | BONUS | 0 | BONUS | 0 | SEVEN | 8 | BONUS | 4 | BONUS | 0 |
| 9 | BLANK | 0 | BLANK | 0 | BLANK | 0 | BLANK | 3 | BLANK | 0 |
| 10 | 2BAR | 0 | 3BAR | 0 | 2BAR | 0 | 1BAR | 4 | 2BAR | 8 |
| 11 | BLANK | 0 | BLANK | 0 | BLANK | 0 | BLANK | 4 | BLANK | 9 |
| 12 | 1BAR | 0 | 1BAR | 0 | 1BAR | 0 | 3BAR | 5 | 1BAR | 9 |
| 13 | BLANK | 2 | BLANK | 26 | BLANK | 10 | BLANK | 1 | BLANK | 3 |
| 14 | SEVEN | 2 | SEVEN | 9 | SEVEN | 6 | SEVEN | 2 | SEVEN | 2 |
| 15 | BLANK | 0 | BLANK | 0 | BLANK | 0 | BLANK | 2 | BLANK | 1 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 26 | | 41 | | 37 | | 39 | | 40 |

FIG.48

TENTH BONUS GAME SYMBOL CODE DETERMINATION TABLE

| | FIRST ARRAY | | SECOND ARRAY | | THIRD ARRAY | | FOURTH ARRAY | | FIFTH ARRAY | |
|---|---|---|---|---|---|---|---|---|---|---|
| NO. | SYMBOL | WEIGHT | SYMBOL | WEIGHT | SYMBOL | WEIGHT | SYMBOL | WEIGHT | SYMBOL | WEIGHT |
| 0 | 2BAR | 0 | 3BAR | 0 | 1BAR | 0 | 1BAR | 0 | 2BAR | 0 |
| 1 | BLANK | 0 | BLANK | 7 | BLANK | 0 | BLANK | 2 | BLANK | 1 |
| 2 | BONUS | 0 | SEVEN | 18 | BONUS | 0 | SEVEN | 2 | BONUS | 1 |
| 3 | BLANK | 20 | BLANK | 0 | BLANK | 0 | BLANK | 7 | BLANK | 1 |
| 4 | SEVEN | 2 | BONUS | 0 | 1BAR | 0 | BONUS | 7 | SEVEN | 1 |
| 5 | BLANK | 3 | BLANK | 0 | BLANK | 0 | BLANK | 7 | BLANK | 1 |
| 6 | 3BAR | 0 | 2BAR | 0 | 2BAR | 0 | 2BAR | 1 | 3BAR | 3 |
| 7 | BLANK | 0 | BLANK | 0 | BLANK | 14 | BLANK | 1 | BLANK | 0 |
| 8 | BONUS | 0 | BONUS | 0 | SEVEN | 5 | BONUS | 1 | BONUS | 0 |
| 9 | BLANK | 0 | BLANK | 0 | BLANK | 15 | BLANK | 2 | BLANK | 0 |
| 10 | 2BAR | 0 | 3BAR | 0 | 2BAR | 0 | 1BAR | 2 | 2BAR | 11 |
| 11 | BLANK | 0 | BLANK | 0 | BLANK | 0 | BLANK | 2 | BLANK | 11 |
| 12 | 1BAR | 0 | 1BAR | 0 | 1BAR | 0 | 3BAR | 2 | 1BAR | 11 |
| 13 | BLANK | 7 | BLANK | 24 | BLANK | 14 | BLANK | 2 | BLANK | 2 |
| 14 | SEVEN | 2 | SEVEN | 44 | SEVEN | 5 | SEVEN | 2 | SEVEN | 2 |
| 15 | BLANK | 10 | BLANK | 14 | BLANK | 15 | BLANK | 2 | BLANK | 2 |
| 16 | 1BAR | 0 | 1BAR | 0 | 3BAR | 0 | 3BAR | 0 | 1BAR | 0 |
| 17 | BLANK | 0 | BLANK | 0 | BLANK | 0 | BLANK | 0 | BLANK | 0 |
| 18 | CHERRY | 0 | CHERRY | 0 | CHERRY | 0 | CHERRY | 0 | CHERRY | 0 |
| 19 | BLANK | 0 | BLANK | 0 | BLANK | 0 | BLANK | 0 | BLANK | 0 |
| 20 | 1BAR | 0 | 1BAR | 0 | 3BAR | 0 | 3BAR | 0 | 1BAR | 0 |
| 21 | BLANK | 0 | BLANK | 0 | BLANK | 0 | BLANK | 0 | BLANK | 0 |
| | | 44 | | 107 | | 68 | | 42 | | 47 |

FIG.49

PAYOUT TABLE

| SYMBOL | 1 | 2 | 3 | 4 | 5 | |
|---|---|---|---|---|---|---|
| SEVEN | 0 | 0 | 100 | 200 | 500 | |
| 3BAR | 0 | 0 | 50 | 100 | 400 | |
| 2BAR | 0 | 0 | 40 | 80 | 300 | |
| 1BAR | 0 | 0 | 30 | 60 | 250 | |
| MIX BAR | 0 | 0 | 20 | 50 | 200 | *MIXED DETERMINATION OF [3 BARs], [2 BARs],AND [BAR] |
| CHERRY | 30 | 60 | 90 | 150 | 300 | *SCATTER PAY. |
| BONUS | 0 | 0 | 10 | 30 | 150 | *SCATTER PAY. |

※EACH OF ABOVE PAYOUT AMOUNTS IS MULTIPLIED BY BET MULTIPLIER

FIG.50

SYMBOL DETERMINATION TABLE RANDOM DETERMINATION TABLE

| | SYMBOL DETERMINATION TABLE | ALLOCATION GROUP | |
|---|---|---|---|
| | | A | B |
| 1 | FIRST BONUS GAME SYMBOL CODE DETERMINATION TABLE | 18 | 0 |
| 2 | SECOND BONUS GAME SYMBOL CODE DETERMINATION TABLE | 11 | 0 |
| 3 | THIRD BONUS GAME SYMBOL CODE DETERMINATION TABLE | 17 | 0 |
| 4 | FOURTH BONUS GAME SYMBOL CODE DETERMINATION TABLE | 17 | 0 |
| 5 | FIFTH BONUS GAME SYMBOL CODE DETERMINATION TABLE | 22 | 1 |
| 6 | SIXTH BONUS GAME SYMBOL CODE DETERMINATION TABLE | 15 | 13 |
| 7 | SEVENTH BONUS GAME SYMBOL CODE DETERMINATION TABLE | 0 | 10 |
| 8 | EIGHTH BONUS GAME SYMBOL CODE DETERMINATION TABLE | 0 | 22 |
| 9 | NINTH BONUS GAME SYMBOL CODE DETERMINATION TABLE | 0 | 22 |
| 10 | TENTH BONUS GAME SYMBOL CODE DETERMINATION TABLE | 0 | 32 |
| | | 100 | 100 |

FIG.75

| REMAINING COUNT-UP NUMBER | NUMBER OF SECONDS TAKEN FOR INCREMENT OF 1 |
|---|---|
| 1～2 | APPROXIMATELY 2.10 SECONDS |
| 3 | APPROXIMATELY 1.70 SECONDS |
| 4 | APPROXIMATELY 1.30 SECONDS |
| 5 | APPROXIMATELY 1.20 SECONDS |
| 6～7 | APPROXIMATELY 1.00 SECONDS |
| 8～9 | APPROXIMATELY 0.80 SECONDS |
| 10～11 | APPROXIMATELY 0.70 SECONDS |
| 12 | APPROXIMATELY 0.60 SECONDS |
| 13～17 | APPROXIMATELY 0.50 SECONDS |
| 18～23 | APPROXIMATELY 0.40 SECONDS |
| 24～30 | APPROXIMATELY 0.30 SECONDS |
| 31～45 | APPROXIMATELY 0.24 SECONDS |
| 46～50 | APPROXIMATELY 0.18 SECONDS |
| 51～80 | APPROXIMATELY 0.16 SECONDS |
| 81～100 | APPROXIMATELY 0.13 SECONDS |
| 101 OR MORE | REWRITING |

FIG.76

| MULTIPLYING FACTOR | NUMBER OF SECONDS |
|---|---|
| LESS THAN 1 | 0.5 SECONDS |
| NOT LESS THAN 1 AND LESS THAN 1.5 | 1 SECONDS |
| NOT LESS THAN 1.5 AND LESS THAN 2.5 | 2 SECONDS |
| NOT LESS THAN 2.5 AND LESS THAN 3.5 | 3 SECONDS |
| NOT LESS THAN 3.5 AND LESS THAN 4.5 | 4 SECONDS |
| NOT LESS THAN 4.5 AND LESS THAN 5.5 | 5 SECONDS |
| NOT LESS THAN 5.5 AND LESS THAN 6.5 | 6 SECONDS |
| NOT LESS THAN 6.5 AND LESS THAN 7.5 | 7 SECONDS |
| NOT LESS THAN 7.5 AND LESS THAN 8.5 | 8 SECONDS |
| NOT LESS THAN 8.5 AND LESS THAN 9.5 | 9 SECONDS |
| NOT LESS THAN 9.5 AND LESS THAN 10.5 | 10 SECONDS |
| NOT LESS THAN 10.5 AND LESS THAN 11.5 | 11 SECONDS |
| NOT LESS THAN 11.5 AND LESS THAN 12.5 | 12 SECONDS |
| NOT LESS THAN 12.5 AND LESS THAN 13.5 | 13 SECONDS |
| NOT LESS THAN 13.5 AND LESS THAN 14.5 | 14 SECONDS |
| NOT LESS THAN 14.5 AND LESS THAN 15.5 | 15 SECONDS |
| NOT LESS THAN 15.5 AND LESS THAN 16.5 | 16 SECONDS |
| NOT LESS THAN 16.5 AND LESS THAN 17.5 | 17 SECONDS |
| NOT LESS THAN 17.5 AND LESS THAN 18.5 | 18 SECONDS |
| NOT LESS THAN 18.5 AND LESS THAN 19.5 | 19 SECONDS |
| NOT LESS THAN 19.5 AND LESS THAN 20.5 | 20 SECONDS |
| NOT LESS THAN 20.5 AND LESS THAN 21.5 | 21 SECONDS |
| NOT LESS THAN 21.5 AND LESS THAN 22.5 | 22 SECONDS |
| NOT LESS THAN 22.5 AND LESS THAN 23.5 | 23 SECONDS |
| NOT LESS THAN 23.5 AND LESS THAN 24.5 | 24 SECONDS |
| NOT LESS THAN 24.5 AND LESS THAN 25 | 25 SECONDS |
| NOT LESS THAN 25 AND LESS THAN 50 | 30 SECONDS |
| NOT LESS THAN 50 | 35 SECONDS |

REEL STRIP AND GAMING MACHINE

CROSS REFERENCE TO RELATED APPLICATION

The present application claims priority from Japanese Patent Application Nos. 2013-194566 filed on Sep. 19, 2013, and 2014-103624 filed on May 19, 2014, the disclosure of which is herein incorporated by reference in its entirety.

BACKGROUND OF THE INVENTION

Field of the Invention

The present invention relates to a reel strip and a gaming machine.

Conventionally, as a gaming machine, there is a slot machine (for example, see Specification of U.S. Patent Application Publication No. 2004/0009807). Such a slot machine includes a plurality of reels each having a reel strip with a plurality of symbols. When a game is run, the plurality of reels are rotated and then stopped to rearrange the symbols, and based on the rearranged symbols, its game result is determined. In such a gaming machine, effects for the reels are provided by displaying effect images on a transparent liquid crystal panel disposed in front of the reels (for example, see U.S. Pat. No. 8,105,154).

In such a gaming machine, a backlight for illuminating the reel strip is disposed inside each reel to improve the visibility of the symbols. It has been general to provide an effect for the mechanical reel strips by changing the intensity and/or the color of the backlight.

In view of the above, an object of the present invention is to provide a gaming machine capable of providing an effect for symbol display during a stop and/or rotation of a reel, by use of a totally non-conventional effect element, which is an angle of a line of sight to an outer circumferential surface of the reel.

SUMMARY OF THE INVENTION

A reel strip according to an embodiment of the present invention has symbols placed thereon, and the reel strip is disposed on an outer circumferential surface of a cylindrical reel configured to be rotated with its cylinder central axis being held at a predetermined position. The reel strip includes a color shifting layer configured to selectively reflect and transmit predetermined wavelengths of visible light depending on an incident angle of the light.

In the above structure, the color shifting layer of the reel strip is configured to selectively reflect and transmit predetermined wavelengths of visible light depending on the incident angle of the light. Therefore, the colors of visible light viewed at different viewing angles to the outer circumferential surface of the reel are different from each other since the incident angles of the visible light, corresponding to the respective viewing angles, to the outer circumferential surface of the reel are different from each other. The reel is rotated while being held at the predetermined position, and therefore, as long as the viewing angle is maintained, the incident angle of visible light is also maintained. Accordingly, there is no change in the perceived color of visible light on the reel. Conventionally, an effect for symbol display has been provided by changing the intensity and/or the color of light applied to the reel formed of layers each configured to merely transmit and/or reflect light uniformly. However, the above structure makes it possible to provide an effect for symbol display during a stop and/or rotation of the reel, by use of a totally unconventional effect element, which is the angle of a line of sight (viewing angle) to the outer circumferential surface of the reel. As a result, the following effect is possible, for example: the appearance of the reel and/or the symbols perceived by a player is different that perceived by a person other than the player.

The reel strip according to an embodiment of the present invention may further include: a diffusion layer laminated at a position inward of the color shifting layer and configured to diffuse incident light to be outputted; and a symbol-printed layer laminated at a position outward of the color shifting layer, on which symbol-printed layer the placed symbols are printed.

A gaming machine according to an embodiment of the present invention includes: a reel including a reel strip provided on an outer circumferential surface of the reel, the reel strip having symbols placed thereon; and a reel drive mechanism configured to rotate the reel at a predetermined position to rearrange the symbols. The reel strip includes a color shifting layer configured to selectively reflect and transmit predetermined wavelengths of visible light depending on an incident angle of the light.

In the above structure, the color shifting layer of the reel strip is configured to selectively reflect and transmit predetermined wavelengths of visible light depending on the incident angle of the light. Therefore, the colors of visible light viewed at different viewing angles to the outer circumferential surface of the reel are different from each other since the incident angles of the visible light, corresponding to the respective viewing angles, to the outer circumferential surface of the reel are different from each other. The reel is rotated while held at the predetermined position, and therefore, as long as the viewing angle is maintained, the incident angle of visible light is also maintained. Accordingly, there is no change in the color of the reel perceived by the player. Conventionally, an effect for symbol display has been provided by changing the intensity and/or the color of light applied to the reel formed of layers each configured to merely transmit and/or reflect light uniformly. However, the above structure makes it possible to provide an effect for symbol display during a stop and/or rotation of the reel, by use of a totally unconventional effect element, which is the angle of a line of sight (viewing angle) to the outer circumferential surface of the reel. This enables, for example, an effect that a player and a person other than the player see the reel and/or the symbols differently from each other.

The gaming machine according to an embodiment of the present invention may further include: a display window through which the symbols on the reel strip are visible from the outside; a backlight unit configured to emit backlight illuminating light including the predetermined wavelengths of visible light from a position inside the reel toward a portion of the reel strip which portion is located within the display window; and, a front light unit configured to emit front light illuminating light including the predetermined wavelengths of visible light from a position outside the reel toward the reel strip.

In this structure, the backlight illuminating light and the front light illuminating light are applied to the reel strip at their respective incident angles, and they are reflected and transmitted in the manners corresponding to their respective incident angles. As a result, the external player sees visible light formed by combining transmitted light of the backlight illuminating light and reflected light of the front light illuminating light. Further, the display window is mainly lighted by the transmitted light of the backlight illuminating light, while the outside of the display window is mainly lighted by the reflected light of the front light illuminating light. This enables a gradation of colors over the range of visible light to be used as an effect for reel display and symbol display.

The gaming machine according to an embodiment of the present invention may further include a backlight control device configured to control an emission manner of the backlight illuminating light emitted from the backlight unit. The backlight unit may include a plurality of illuminating light sources arranged in a width direction and a longitudinal direction of the reel strip, with which light sources an amount of the emitted backlight illuminating light is adjustable to multiple levels; and the backlight control device may be configured to control the plurality of illuminating light sources individually.

In the above structure, it is possible to cause a change in the gradation of colors over the range of visible light produced by combining the reflected and transmitted light of the backlight illuminating light and the reflected and transmitted light of the front light illuminating light, by changing the emission manner of the backlight illuminating light using the backlight control device. This increases the freedom in the effect for reel display and symbol display.

The gaming machine according to an embodiment of the present invention may further include a front light control device configured to control an emission manner of the front light illuminating light emitted from the front light unit. The front light unit may include a plurality of illuminating light sources arranged in the width direction of the reel strip, with which light sources an amount of the emitted front light illuminating light is adjustable to multiple levels; and the front light control device may be configured to control the plurality of illuminating light sources individually.

In the above structure, it is possible to cause a change in the gradation of colors over the range of visible light is produced by combining the reflected and transmitted light of the backlight illuminating light and the reflected and transmitted light of the front light illuminating light, by changing the emission manner of the front light illuminating light using the front light control device. This increases the freedom in the effect for reel display and symbol display.

In the gaming machine according to an embodiment of the present invention, each of the illuminating light sources may be a full color light-emitting diode.

In the above structure, it is possible to easily emit various wavelengths of visible light including the predetermined wavelengths of visible light from a single light source.

In the gaming machine according to an embodiment of the present invention, the reel may have a cylindrical shape, and may be configured to be rotated with its cylinder central axis being held at the predetermined position by the reel drive mechanism, and the front light unit may be disposed at a position along a direction of rotation of the reel and outside the display window.

In the above structure, light emitted from the front light unit is applied to the reel strip at an incident angle falling within a range defined by a normal line and a tangent line to the reel strip. Thus, the incident angle of the light to the reel strip continuously varies within the ranges from 0 to 90 degrees as the location on the reel strip where the light is applied varies. This provides a continuous gradation of colors over the range of the reflected light. Therefore, the color of the symbols on the reel strip and the color of the region around each symbol vary with the rotation of the reel. Conventionally, there has been an effect of light-dark gradation in which, for example, the intensity of light from the front light unit is increased as the symbols are moved toward the outside of the display window with the rotation of the reel. However, there has not been realized an effect of a gradation of colors using the color shifting layer, but now, a totally new effect is available.

In the reel strip according to an embodiment of the present invention, the color shifting layer may be a color film of which color perceived by a viewer changes depending on a viewing angle.

In the reel strip according to an embodiment of the present invention, the color shifting layer may be a multilayer optical film having a plurality of layers each configured to selectively reflect specific wavelengths of light.

In the reel strip according to an embodiment of the present invention, the color shifting layer may have a characteristic that its reflection band shifts toward a shorter wavelength band and becomes narrower as the incident angle decreases.

In the reel strip according to an embodiment of the present invention, the color shifting layer may have a characteristic that when visible light is applied to the color shifting layer at an incident angle of 90 degrees, the color shifting layer transmits violet, blue, green, and longer-wavelength red light, while the color shifting layer reflects yellow, orange, and shorter-wavelength red light.

In the reel strip according to an embodiment of the present invention, the color shifting layer may have a characteristic that: when visible light is applied to the color shifting layer at an incident angle of 90 degrees, the color shifting layer transmits violet, blue, green, and longer-wavelength red light, while the color shifting layer reflects yellow, orange, and shorter-wavelength red light; and when visible light is applied to the color shifting layer at an incident angle of 60 degrees, the color shifting layer transmits violet, shorter-wavelength blue, yellow, orange, and red light, while the color shifting layer reflects longer-wavelength blue and green light.

The reel strip according to an embodiment of the present invention may further include a symbol-printed layer on which the symbols are printed. A picture pattern in various colors may be printed in a region of the symbol-printed layer which region is other than regions where the symbols are located; and the color shifting layer may be laminated in the region other than the regions where the symbols are located.

In the gaming machine according to an embodiment of the present invention, the color shifting layer may be a color film of which color perceived by a viewer changes depending on a viewing angle.

In the gaming machine according to an embodiment of the present invention, the color shifting layer may be a multilayer optical film having a plurality of layers each configured to selectively reflect specific wavelengths of light.

In the gaming machine according to an embodiment of the present invention, the color shifting layer may have a characteristic that its reflection band shifts toward a shorter wavelength band and becomes narrower as the incident angle decreases.

In the gaming machine according to an embodiment of the present invention, the color shifting layer may have a characteristic that when visible light is applied to the color shifting layer at an incident angle of 90 degrees, the color shifting layer transmits violet, blue, green, and longer-wavelength red light, while the color shifting layer reflects yellow, orange, and shorter-wavelength red light.

In the gaming machine according to an embodiment of the present invention, the color shifting layer may have a characteristic that: when visible light is applied to the color shifting layer at an incident angle of 90 degrees, the color shifting layer transmits violet, blue, green, and longer-wavelength red light, while the color shifting layer reflects yellow, orange, and shorter-wavelength red light; and when visible light is applied to the color shifting layer at an incident angle of 60 degrees, the color shifting layer transmits violet, shorter-wavelength blue, yellow, orange, and red light, while the color shifting layer reflects longer-wavelength blue and green light.

In the gaming machine according to an embodiment of the present invention, the reel strip may include a symbol-printed layer on which the symbols are printed; a picture pattern in various colors may be printed in a region of the symbol-printed layer which region is other than regions where the symbols are located; and the color shifting layer may be laminated in the region other than the regions where the symbols are located.

In the present invention, it is possible to provide an effect for symbol display during a stop and/or rotation of a reel, by use of a totally non-conventional effect element, which is an angle of a line of sight to an outer circumferential surface of the reel.

BRIEF DESCRIPTION OF THE DRAWINGS

FIG. 35 is an exemplary symbol code table used for designating symbols on outer circumferential surfaces of reel units.

FIG. 38 is an exemplary normal game symbol determination table.

FIG. 39 is an exemplary bonus game symbol determination table.

FIG. 40 is an exemplary bonus game symbol determination table.

FIG. 41 is an exemplary bonus game symbol determination table.

FIG. 42 is an exemplary bonus game symbol determination table.

FIG. 43 is an exemplary bonus game symbol determination table.

FIG. 44 is an exemplary bonus game symbol determination table.

FIG. 45 is an exemplary bonus game symbol determination table.

FIG. 46 is an exemplary bonus game symbol determination table.

FIG. 47 is an exemplary bonus game symbol determination table.

FIG. 48 is an exemplary bonus game symbol determination table.

FIG. 49 is an exemplary payout table.

FIG. 50 is an exemplary symbol determination table random determination table.

FIG. 75 is a table showing the relationship between a remaining count-up number and the number of seconds.

FIG. 76 is a table showing the relationship between a multiplying factor and the number of seconds.

DESCRIPTION OF THE PREFERRED EMBODIMENTS (Overview of Gaming Machine)

Figure 1:
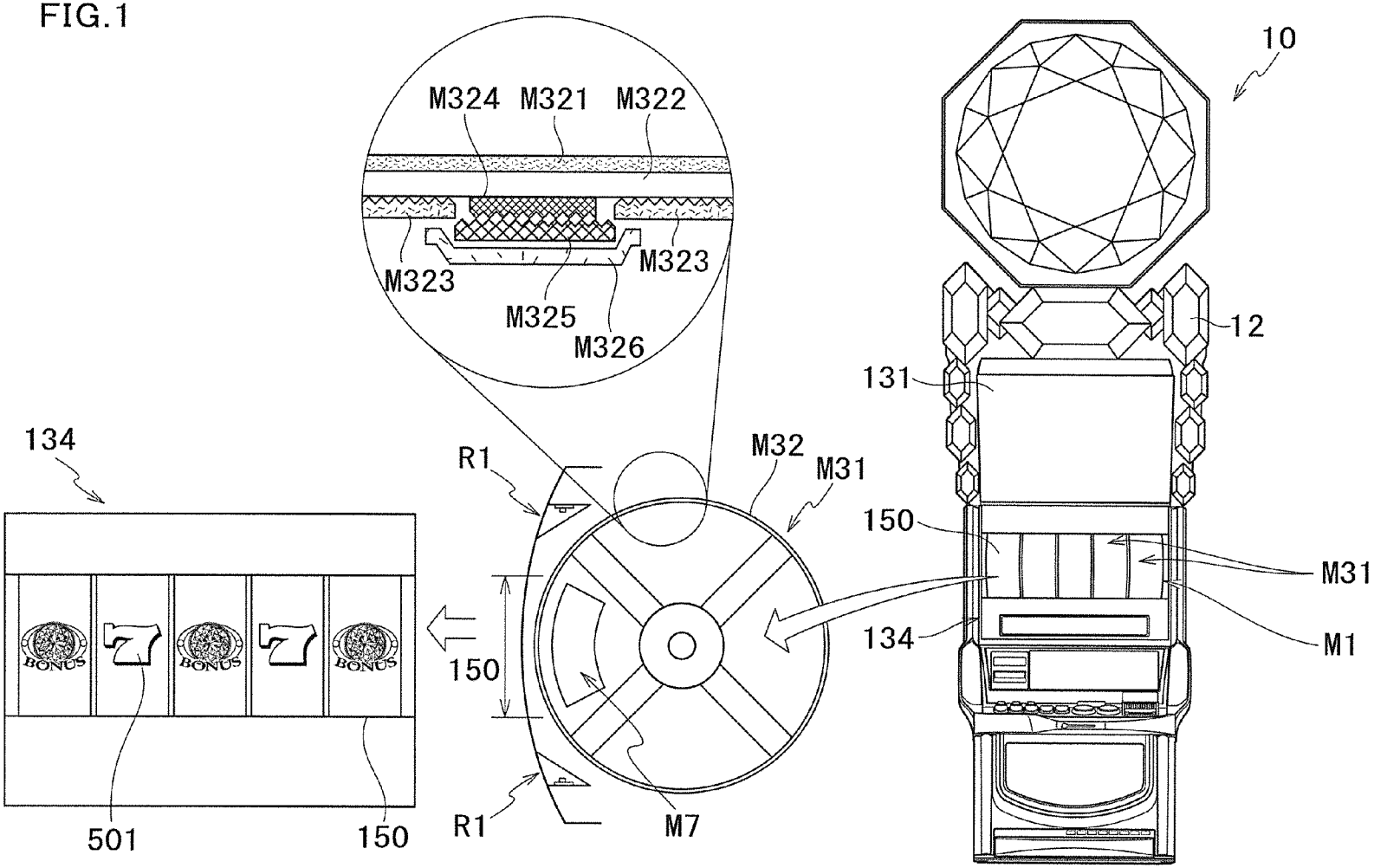
FIG. 1 is an explanatory diagram showing an operation of a gaming machine.

As shown in FIG. 1, in a gaming machine of the present embodiment, reel strips M32 each having symbols 501 placed thereon are respectively disposed on outer circumferential surfaces of cylindrical reels M32 each configured to be rotated with its cylinder central axis being held at a predetermined position. Each reel strip M32 includes a color shifting layer M321 configured to selectively reflect and transmit predetermined wavelengths of visible light depending on an incident angle of the light. That is, the gaming machine includes: the reels M31 each including the reel strip M32 provided on the outer circumferential surface of the reel, the reel strip having the symbols 501 placed thereon; and a reel device M1 (a reel drive mechanism) configured to rotate each reel M31 at the predetermined position to rearrange the symbols 501. Each reel strip M32 includes the color shifting layer M321 configured to selectively reflect and transmit predetermined wavelengths of visible light depending on an incident angle of the light. Note that the following description assumes that the gaming machine is a multiple-player type gaming machine including a plurality of slot machines 10; however, the gaming machine may be a single slot machine 10 intended for a single player.

To be more specific, each of the slot machines 10 functioning as the gaming machine includes: the reels M31 each having the reel strip M32 with the plurality of symbols 501, the reel strip M32 provided on the entire circumference of the corresponding reel M31; a display window 150 through which the symbols 501 on each reel strip M32 are visible from the outside; a backlight unit M7 configured to emit backlight illuminating light including the predetermined wavelengths of visible light from a position inside the reels M31 toward a portion of the reel strips M32 which is located within the display window 150; and a front light unit R1 configured to emit front light illuminating light including the predetermined wavelengths of visible light from positions outside the reels M31 toward the reel strips M32.

With the above structure, the color shifting layer M321 of each reel strip M32 is configured to selectively reflect and transmit the predetermined wavelengths of visible light depending on the incident angle of the light. The colors of visible light viewed at different angles of lines of sight (at different viewing angles) to the outer circumferential surfaces of the reels M31 are different from each other since the incident angles of visible light, corresponding to the respective viewing angles, to the outer circumferential surfaces of the reels M31 are different from each other. Each reel M31 is rotated while being held at the predetermined position, and therefore, as long as the viewing angle is maintained, the incident angle of visible light is maintained. Accordingly, there is no change in visible light coming from the reels M31. Conventionally, the effect for display of the symbols 501 has been provided by changing the intensity and/or the color of light emitted to the reels M31 each formed of one or more layers configured to merely transmit and/or reflect light uniformly. However, the above structure makes it possible to provide an effect for display of the symbols 501 during a stop and/or rotation of the reels M31, by use of a totally unconventional effect element, which is an angle of a line of sight (viewing angle) to the outer circumferential surfaces of the reels M31. As a result, the following effect is possible, for example: the appearance of each reel M31 and/or the symbols 501 perceived by a player is different that perceived by a person other than the player.

As described above, the color shifting layer M321 is a color film of which color perceived by a viewer changes depending on a viewing angle. The color shifting layer M321 of the present embodiment is a multilayer optical film having a plurality of layers each configured to selectively reflect specific wavelengths of light. The color shifting is caused, for example, by interference of light reflected by the layers. As the color shifting layer M321, a film described in Japanese Unexamined Patent Publication No. 2011-085959 may be used, for example.

Figure 2:
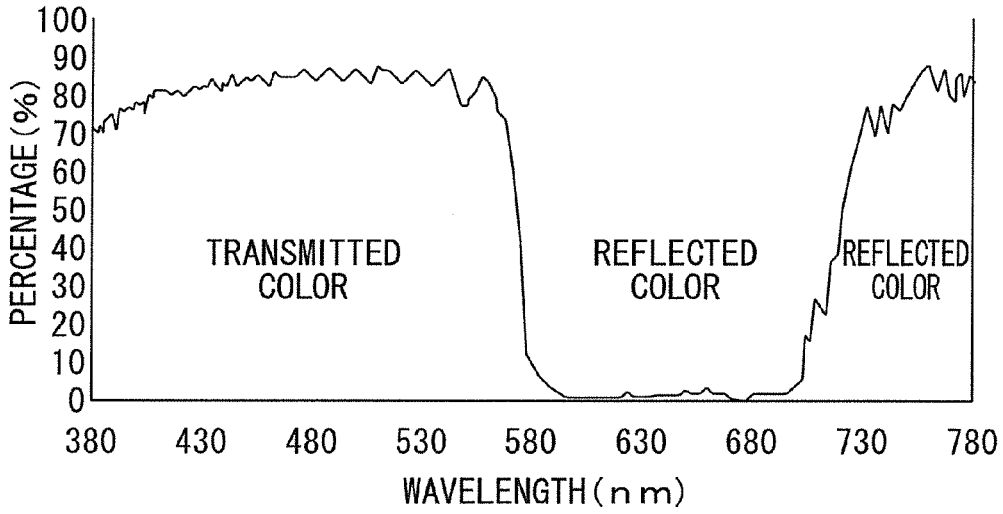
FIG. 2 is a graph showing an example of reflection and transmission characteristics of a color shifting layer to incident light at an incident angle of 90 degrees.
Figure 3:
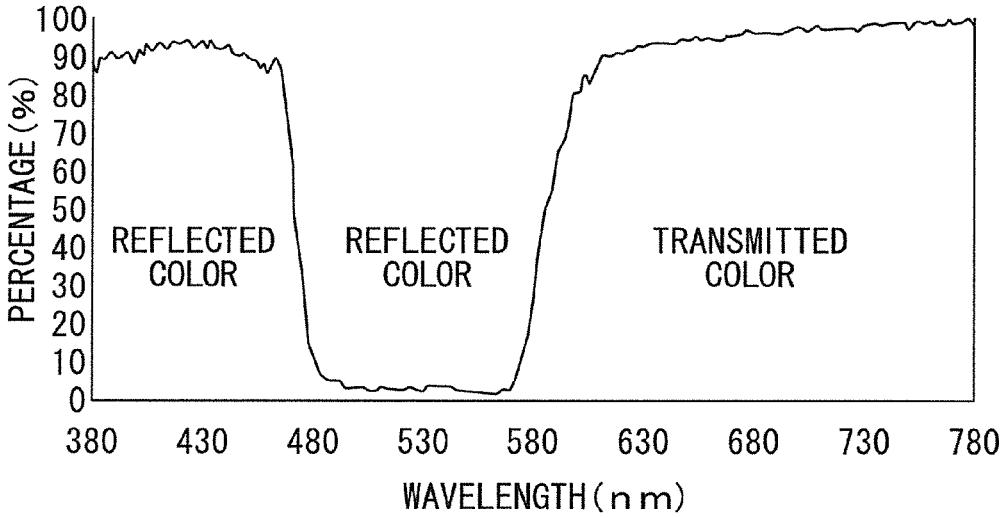
FIG. 3 is a graph showing an example of reflection and transmission characteristics of the color shifting layer to incident light at an incident angle of 60 degrees.

Now, specific description will be given for the display state on the reels M31 of the present embodiment. The following description will be given on an assumption that visible light is white light having a wavelength range of 380 nm to 780 nm; however, the visible light is not limited to this. As shown in FIG. 2, the color shifting layer M321 has the following characteristic: when visible light is applied to the color shifting layer M321 at an incident angle of 90 degrees, the color shifting layer M321 transmits violet (approximately 380 nm to 450 nm), blue (approximately 450 nm to 495 nm), green (approximately 495 nm to 570 nm), and longer-wavelength red (approximately 620 nm to 780 nm) light; while the color shifting layer M321 reflects yellow (approximately 570 nm to 590 nm), orange (approximately 590 nm to 620 nm), and shorter-wavelength red light. Further, as shown in FIG. 3, the color shifting layer has a characteristic that when visible light is applied thereto at an incident angle of 60 degrees, the color shifting layer M321 transmits violet, shorter-wavelength blue, yellow, orange, and red light, while the color shifting layer M321 reflects longer-wavelength blue and green light. Thus, the color shifting layer M321 has a characteristic that its reflection band shifts toward a shorter wavelength band (toward the blue light band) and becomes narrower, as the incident angle decreases. In other words, the color shifting layer M321 has a characteristic that longer wavelength colors such as yellow, orange, and red are perceived when the incident angle decreases.

The present embodiment is configured so that the emission manner (amount of light, color, time interval between emissions, timing of emission, and the like) of backlight illuminating light emitted from the backlight unit M7 is controllable, and so that the emission manner (amount of light, color, time interval between emissions, timing of emission, and the like) of front light illuminating light emitted from the front light unit R1 is controllable. When the amount of the backlight illuminating light is decreased, for example, (or when the amount of the front light illuminating light is increased), light reflected by the color shifting layers M321 is greater on the reel strips M32, with the result that the longer-wavelength colors such as yellow, orange, and red are highly perceived by the player. Meanwhile, when the amount of the front light illuminating light is decreased (or when the amount of the backlight illuminating light is increased), light transmitted by the color shifting layer M321 is greater on the reel strips M32, with the result that shorter-wavelength colors such as violet, blue, and green are highly perceived by the player.

Further, if there is a person other than the player next to the player playing the slot machine 10, the longer-wavelength colors of such as yellow, orange, and red are highly perceived as the person other than the player gets away from the player (as the viewing angle to the reel strip M32 decreases). That is, the person other than the player perceives that the longer wavelength-colors of the reel strips M32 fade as the person gets closer to the slot machine 10.

Figure 4:
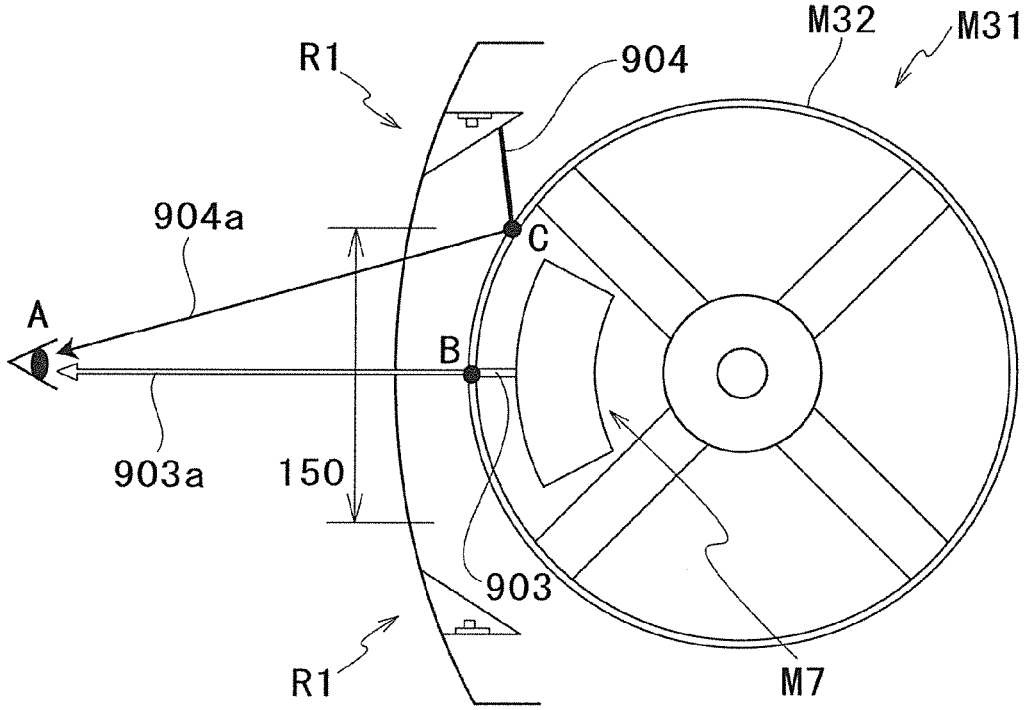
FIG. 4 is an explanatory diagram showing a relationship between a reel and a viewing angle of a player.

Further, on each reel M31, the reel strip M32 is annularly placed as shown in FIG. 1. Therefore, it is perceived as if each reel M31 has a gradation of colors. Now, description will be given for an exemplary case where a target point B on the reel M31 which point is leveled with the center of the reel M31 and a target point C on the reel M31 which point is displayed on an upper area of the display window 150 are viewed from a viewing position A leveled with the center of the reel M31, as shown in FIG. 4. The backlight unit M7 emits backlight illuminating light 903 including the predetermined wavelengths of visible light from the position inside the reel M31 toward a portion of the reel strip M32 which is located within the display window 150. Further, the front light unit R1 emits front light illuminating light 904 including the predetermined wavelengths of visible light toward the reel strip M32 from positions outside the reel M31 and above and below the display window 150.

Since the front light illuminating light 904 is emitted from the positions above and below the display window 150, light traveling from the target point B to the viewing position A is mainly constituted by backlight transmitted light 903*a* which is the backlight illuminating light 903 transmitted by the reel strip M32. Accordingly, the color of the target point B of the reel M31 perceived at the viewing position A is greatly affected by the color of light transmitted by the color shifting layer M321. Meanwhile, light traveling from the target point C to the viewing position A is mainly constituted by front light reflected light 904*a* which is the front light illuminating light 904 reflected by the reel strip M32. Accordingly, the color of the target point C of the reel M31 perceived at the viewing position A is greatly affected by the color of light reflected by the color shifting layer M321. Thus, when the player sees each reel M31 through the display window 150, the color of each reel M31 changes, in directions from the center to the upper and the lower ends of the reel M31, from a color affected by the color of light transmitted by the color shifting layer M321 to a color affected by the color of light reflected by the color shifting layer M321. This way, it is perceived as if the reels M31 seen through the display window 150 have a gradation of colors over the range of visible light.

As described above, each reel strip M32 has the color shifting layer M321 configured to selectively reflect and transmit predetermined wavelengths of visible light depending on an incident angle of the light, and this allows the reels M31 to have the following functions. The reels M31 have a function of changing the color of the reels M31 through adjustment of the amount of the backlight illuminating light and/or the front light illuminating light. Further, the reels M31 have a function of causing the player and a person other than the player to perceive different colors of the reels M31. Furthermore, the reels M31 have a function of causing the player to perceive as if the reels M31 have a gradation of colors over the range of visible light.

Figure 7:
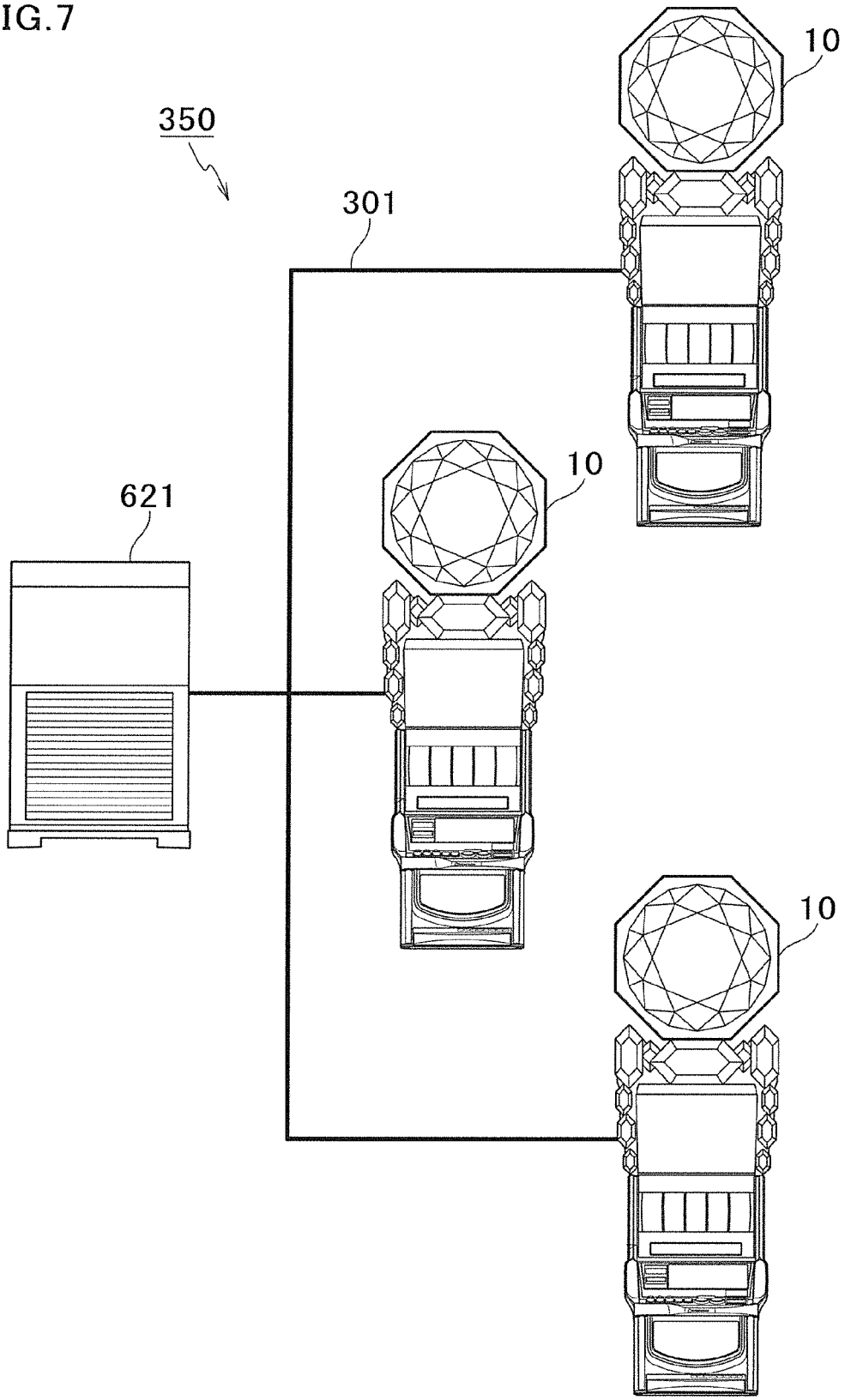
FIG. 7 is an explanatory diagram showing an overall structure of a game system.

The slot machine 10 with the above described structure is provided to a multiple-player type gaming machine 300, as shown in FIG. 7. The gaming machine 300 includes a plurality of slot machines 10 each serving as the gaming terminal having the reel device M1, which are connected to a center controller 200 in such a manner that data communication is possible. The gaming machine 300 enables running of a basic game such as a slot game independently in each of the slot machines 10, and enables running of a common game by synchronizing the slot machines 10 with each other.

Note that the connection between the slot machine 10 and the center controller 200 may be wired or wireless, or may be a combination of these. The unit of a bet amount may be a national or local currency such as Dollar, Yen, and Euro, or a game point used only in the field or halls having the gaming machine 300.

More specifically, the gaming machine 300 has: an input device configured to enable an input from outside; the plurality of slot machines 10 each configured to run a basic game independently of another and having a terminal controller programmed to run various processes for conducting a common game which is run in the slot machines 10; and a center controller 200 connected to and in communication with the slot machines 10 and programmed to run various processes.

The terminal controller of the gaming machine 300 is configured to execute at least: a process of running a basic game upon an input of a start operation through the input device; a process of running a common game upon reception of a game start command from the center controller 200; and a process of determining a game result of the common game, based on game result information from the center controller 200.

Here, the "common game" here is a sub game which is different from a basic game (main game) which is an essential game of the gaming machine 300. The common game is run in parallel to the basic game or during a period in which the basic game is stopped. For example, the common game may be craps game, baseball game, and soccer game.

Figure 5:
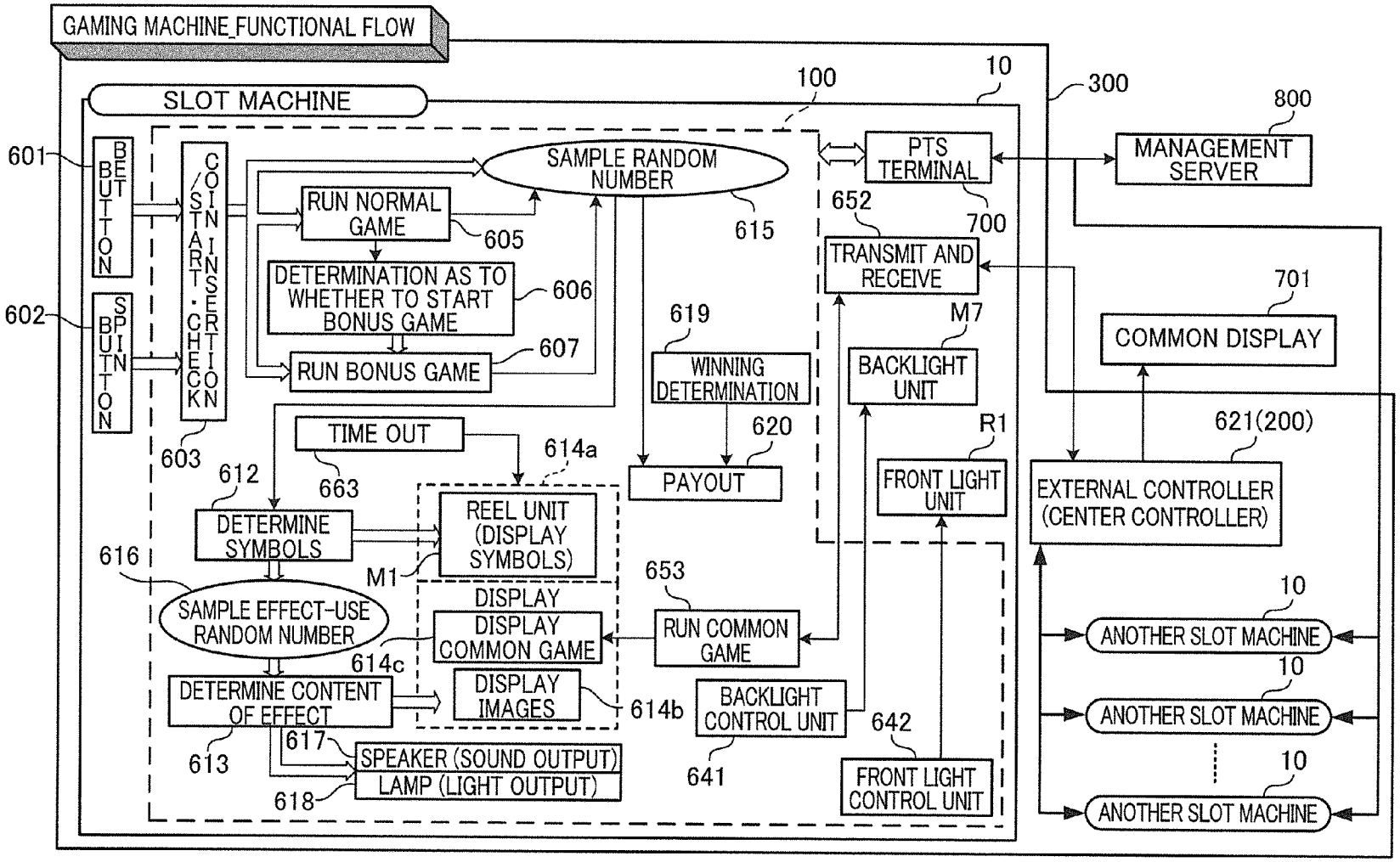
FIG. 5 is an explanatory diagram showing a function flow of the gaming machine.

As shown in FIG. 5, the center controller 200 of the gaming machine 300 is configured to execute at least: a process of outputting a game start command to a slot machine 10 satisfying a game running condition at a predetermined timing; a process of determining a game result of the common game; a process of outputting the game result determined as the game result information to the slot machine 10.

Here, the "game running condition" is a condition for enabling participation into the common game. For example, the condition may be an accumulated value of the bet amount on the basic game being the minimum bet amount or more, or the number of games in the basic game being a minimum number of times or more. Note that the "game running condition" can be satisfied by the player based on his/her will, immediately before the common game is started. For example, if the game running condition is not satisfied due to the accumulated value of the bet amount of the basic game falling short of the minimum bet amount, the player may satisfy the game running condition by paying a difference between the minimum bet amount and the accumulated value of the bet amount before the common game is started, or by paying an amount to meet the predetermined condition. Further, if the condition is not satisfied due to the number of basic games played falling short, the player may satisfy the game running condition by paying an amount to compensate the shortage, or by paying an amount to meet the predetermined condition.

Further, the predetermined timing for outputting the game start command is a timing at which the common game start condition is satisfied in any one of the slot machine 10. The "common game start condition" relates to the accumulated bet amount information or an accumulated number of basic games. The present embodiment deals with a case where the gaming machine 300 having the center controller 200 apart from the slot machine 10; however, the present invention is not limited to this. The gaming machine 300 may be arranged such that one or more slot machines 10 have the function of the center controller 200 and the slot machines 10 are connected to be able to communicate with one another.

The slot machine 10 above is a kind of the gaming terminals in the gaming machine 300. Although the present embodiment deals with the slot machine 10 as an example of the gaming terminal, the disclosure is not limited to this and any type of device having a terminal controller that is able to independently run a basic game may be used as the gaming terminal.

The basic game in the present embodiment is run by the slot machine 10. The basic game is a slot game of rearranging a plurality of symbols 501. The basic game is not limited to the slot game but is any type of games capable of being independently run at a gaming terminal such as the slot machine 10.

Rearrangement of symbols 501 in the slot game is executed by the reel device M1 (symbol display device). The slot game includes a process of running a normal game of rearranging symbols 501 on the reel device M1 on condition that a gaming value is bet and awarding a normal payout based on the rearranged symbols 501, and a process of running a bonus game of rearranging symbols 501 with the assumption that the payout rate is higher than that of the normal game when the rearranged symbols 501 achieve a predetermined condition and awarding a bonus payout based on the rearranged symbols 501.

The number and types of the "symbols 501" are not limited provided that the symbols 501 are rearranged in the reel device M1. The symbols 501 are superordinate concept of the specific symbols and normal symbols. The specific symbols are added to the normal symbols as needed. For example, the specific symbols include wild symbols and trigger symbols. The wild symbol can be used as a substitute for any type of the symbol 501. Each trigger symbol is a symbol that serves at least as a trigger for start running the bonus game. The trigger symbol may function as a trigger of increase in the number of the specific symbols in the bonus game, i.e., increase in the number of the specific symbols of at least one of the trigger symbol and the wild symbol. Furthermore, the trigger symbol may function as a trigger of increase in the number of times to run the bonus game. Note that, in the present embodiment, the symbols 501 include blank symbols each indicated with a blank.

A coin, a bill, or electrically valuable information corresponding to these is used as a gaming value. It is to be noted that the gaming value in the disclosure is not limited to these, and for example a medal, token, electric money or the like can be adopted. Further, a later-described ticket with a barcode is also used.

The bonus game is equivalent to a feature game. While the bonus game in the present embodiment is described as games repeating a free game, the bonus game is not limited to them but is any type of game as long as the gaming state is more advantageous than that of the normal game. Other types of the bonus game may be employed as long as the gaming state is advantageous for the player, i.e., the gaming state is more advantageous than that of the normal game. For example, in the bonus game, various states such as a state in which more gaming values can be achieved as compared to the normal game, a state in which the probability of obtaining a gaming value is higher than the probability in the normal game, and a state in which the number of consumed gaming values is smaller than in the normal game are achieved independently or in combination.

A free game is a game which is executable with a smaller amount of gaming values bet than in the normal game. The expression "executable with a smaller amount of gaming value bet" includes a case where an amount of gaming values bet is zero. Therefore, the free game may be a game which is run without betting a gaming value and the gaming value is paid out for an amount corresponding to rearranged symbols 501. In other words, the free game may be a game that starts even if no gaming value is consumed. On the other hand, the normal game is run on condition that a gaming value is bet, and is a game of paying out gaming value for an amount corresponding to rearranged symbols 501. In other words, the normal game is a game that starts with the consumption of the gaming value.

The term "rearrangement" means rotate displaying the symbols 501 and then stop displaying them. In other words, the term indicates that the symbols 501 are rearranged after the arrangement of the symbols 501 is dismissed. The term "arrangement" indicates a state in which the symbols 501 are visually recognizable by an external player.

The phrase "normal payout based on the rearranged symbols 501" indicates a normal payout corresponding to a winning combination resulting from the rearrangement. The phrase "bonus payout based on the rearranged symbols 501" indicates a bonus payout corresponding to a winning combination resulting from the rearrangement. It is noted that the term "winning combination" indicates that a prize is established.

Examples of "a condition in which the payout rate is higher than in the normal game" include the execution of a free game, increase in the number of the wild symbol and the trigger symbol, and the execution of a game using a substituted symbol table. A rescue process may be executed when a rescue start condition is satisfied in the basic game.

The rescue process is a process to relieve players. Examples of the rescue process include the execution of a free game, the increase in the number of the wild symbol and the trigger symbol, the execution of a game using a substituted symbol table, and the awarding of an insurance payout.

Examples of "rescue start condition" includes a case where the normal game is excessively repeated, i.e., the normal game is repeated for a predetermined number or more of times and a case where the total amount of obtained payout is excessively small, i.e., the obtained normal payout and bonus payout is smaller than a predetermined amount after a single player repeats the game for a predetermined number or more of time.

In addition to the above, the gaming machine 300 may include a common display device 701 which is provided to be viewable from operation positions of all the slot machines 10, and the center controller 200 may display a state until the establishment of a common game start condition on the common display device 701. It is noted that the operation position is the eye level position of the player operating each slot machine 10. With the gaming machine 300 having the feature above, it is possible to allow each player to estimate the waiting time until the common game starts, as the state until the establishment of the common game start condition is displayed on the common display device 701.

(Function Flow of Gaming Machine 300: Slot Machine)

The gaming machine 300 arranged as above includes the slot machines 10 and an external controller 621 (center controller 200) connected to the slot machines 10 to be able to communicate therewith. The external controller 621 is able to communicate with the slot machines 10 provided in a hall.

Each slot machine 10 includes a BET button 601, a spin button 602, and a display 614, and further includes a game controller configured to control these units. The BET button 601 and the spin button 602 are kinds of input devices. The slot machine 10 further includes a transceiver unit 652 that makes it possible to perform data communication with the external controller 621.

The BET button 601 above has a function of receiving a bet amount input by the player. The spin button 602 has a function of receiving an instruction to start a game such as a normal game in response to an operation by the player, i.e., a start operation. The display 614 has a function of displaying still image information such as various symbols 501, numbers, and characters and moving image information such as effect movies. The display 614 has a symbol display region 614*a*, an image display region 614*b*, and a common game display region 614*c*.

The symbol display area 614*a* has a reel device M1 and displays the symbols 501 shown in FIG. 1. The image display region 614*b* displays various types of effect image information executed during a game, by means of moving images and still images. The common game display area 614*c* is an area which displays a common game such as a jackpot game.

The game controller 100 includes a coin insertion/start-check unit 603, a normal game running unit 605, a bonus game start determining unit 606, a bonus game execution unit 607, a random number sampling unit 615, a symbol determining unit 612, an effect-use random number sampling unit 616, an effect determining unit 613, a speaker unit 617, a lamp unit 618, a winning determining unit 619, and a payout unit 620.

The normal game running unit 605 has a function of running a normal game when an operation of the BET button 601 is made. The bonus game start determining unit 606 determines whether to run a bonus game, based on a combination of the symbols 501 rearranged in the normal game. That is to say, the bonus game start determining unit 606 has a function of determining that a bonus game is obtained when a trigger symbol or the like is rearranged in a predetermined condition, and shifting the process to the bonus game execution unit 607 so that a bonus game is run from the next unit game.

It is noted that "unit game" is a series of operations from the start of the receiving of a bet to a state in which an award can be established For example, a unit game in the normal game includes a single bet time for receiving a bet, a single game time of rearranging stopped symbols 501, and a single payout time of a payout process of awarding a payout. A unit game in the normal game is termed unit normal game.

The bonus game execution unit 607 has a function of running a bonus game in which a free game is repeated only by an operation of the spin button 602.

The symbol determining unit 612 has functions of: determining symbols 501 to be rearranged with reference to a random number from the random number sampling unit 615; rearranging the determined symbols 501 on the symbol display region 614*a* of the display 614; outputting rearrangement information of the symbols 501 to the winning determining unit 619; and outputting an effect specifying signal to the effect-use random number sampling unit 616 based on the state of the rearrangement of the symbols 501.

The effect-use random number sampling unit 616 has a function of sampling an effect random number when receiving an effect instruction signal from the symbol determining unit 612 and a function of outputting the effect random number to the effect determining unit 613. The effect determining unit 613 has a function of determining the effect content by using the effect random number, an effect of outputting the image information of the determined effect content to the image display region 614*b* of the display 614, and a function of outputting audio/light information of the determined effect content to the speaker unit 617 and the lamp unit 618.

The winning determining unit 619 has a function of determining the presence of winning when obtaining rearrangement information of the symbols 501, which is a display state of rearrangement on the display 614, a function of calculating a payout amount based on the winning combination when it is determined that winning is achieved, and a function of outputting a payout signal to the payout unit 620 based on the payout amount. The payout unit 620 has a function of paying out a gaming value to the player, in the form of a coin, a medal, a credit, or the like. Furthermore, the payout unit 620 has a function of adding credit data corresponding to the credit to be paid out to credit data stored in an IC card inserted into a later-described PTS terminal 700.

In addition to the above, the game controller 100 includes a not-shown storage unit that stores various types of bet amount data The storage unit is a device which stores data in a rewritable manner (e.g., a hard disc device and a memory).

In addition to the above, the game controller 100 has a common game running unit 653. The common game running unit 653 has functions of: outputting bet amount information based on a bet amount bet on a normal game to the external controller 621 in each unit basic game; executing a common game in response to a game start command from the external controller 621; and receiving a bet input through the BET button 601 for a bet amount corresponding to bet amount data for a common game, which is bettable on a common game.

In addition to the above, the game controller 100 is connected to the PTS terminal 700. The PTS terminal 700 is a unit in which an LCD, a microphone, a human body detection camera, etc. are integrated, and has, for example, a function of providing an effect for a game by mutual communications with the game controller 100. In addition to the above, when receiving credit data from the PTS terminal 700, the game controller 100 updates the credit display on the display 614. Furthermore, the game controller 100 outputs settled credit data to the PTS terminal 700 when the credits on a game are settled. Moreover, the PTS terminal 700 is connected to a VFD (vacuum fluorescent display) 177. The PTS terminal 700 transmits, to the VFD 177, information on a game status or the like received from the game controller 100. This enables the VFD 177 to display various types of status.

Furthermore, the PTS terminal 700 of each of the slot machines 10 constituting the gaming machine 300 is connected to a management server 800 to be able to communicate each other, and centrally manages the download of images, IC cards and credits.

The game controller 100 further includes a backlight control unit 641 and a front light control unit 642. The backlight control unit 641 is configured to control the emission manner (light amount, color, time interval between emissions, timing of emission, and the like) of backlight illuminating light emitted from the backlight unit M7. As will be described later, the backlight unit M7 includes a plurality of illuminating light sources arranged in a width direction and a longitudinal direction of each reel strip M32. With these illuminating light sources, it is possible to change the amount of the emitted backlight illuminating light to multiple levels. The backlight control unit 641 is able to control the plurality of illuminating light sources individually. The front light control unit 642 is configured to control the emission manner (light amount, color, time interval between emissions, timing of emission, and the like) of front light illuminating light emitted from the front light unit R1. As will be described later, the front light unit R1 includes a plurality of illuminating light sources arranged in the width direction of each reel strip M32. With these illuminating light sources, it is possible to change the amount of the emitted front light illuminating light to multiple levels. The front light control unit 642 is able to control the plurality of illuminating light sources individually.

(Function Flow of Gaming Machine 300: External Controller)

The gaming machine 300 with the above-described structure is connected to the external controller 621. The external controller 621 has a function of remotely operating and monitoring the operation state of each slot machine 10 and processes such as changes in game setting values. Furthermore, the external controller 621 has a function of determining a common game start condition for each gaming terminal, and executing a common game at a plurality of slot machines 10 when a determination result at any gaming terminal satisfies the common game start condition. Further, the external controller 621, when starting the common game, has a function of performing a predetermined emitting operation in which, for example, the front light illuminating light 904 is repetitively emitted and stopped, so as to notify the player of the start of the common game on the display window 150 of the reel device M1 as well.

Figure 6:
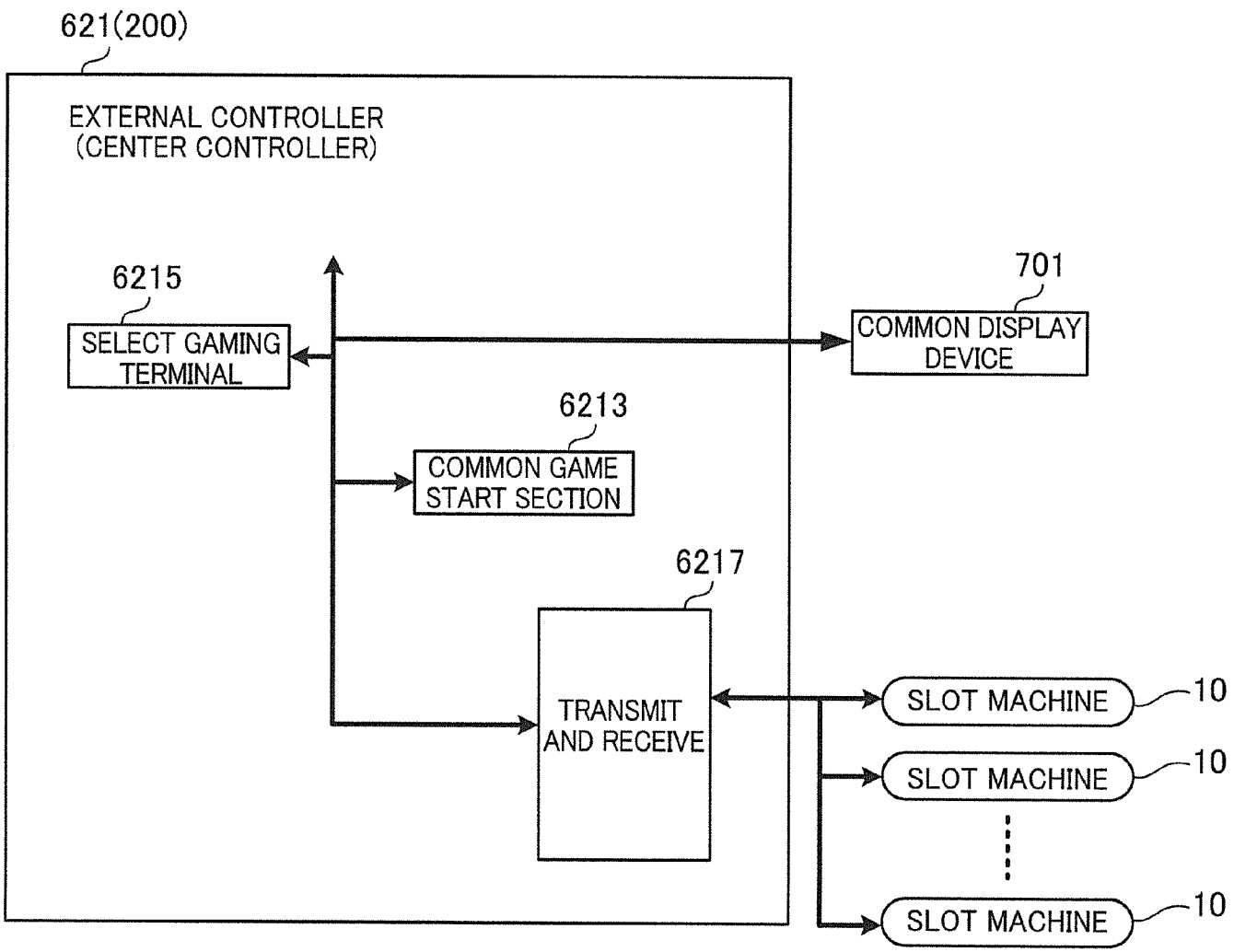
FIG. 6 is an explanatory diagram showing a function flow of an external controller.

More specifically, the external controller 621 includes a common game start unit 6213, a gaming terminal selection unit 6215, and a transceiver unit 6217, as shown in FIG. 6. The common game start determining unit 6213 has functions of: determining whether the common game start condition is established based on the accumulated bet amount information sent from the slot machine 10 in each unit basic game; outputting a game start command to a plurality of slot machines 10; and displaying on the common display device 701 states until the common game start condition is established.

The determination as to whether the common game start condition is established is based on the accumulated bet amount information or based on all accumulated values that increase as the unit basic game is repeated. For example, the number of times of running the basic game and the game time of the basic game may be used as the accumulated values.

In addition to the above, the common game start unit 6213 has a function of outputting a game start command to the slot machine 10 in which an accumulated value that increases as a result of the repetition of the basic game satisfies a game running condition. With this, because the right to participate in the common game is not awarded to a slot machine 10 in which the accumulated value is lower than the minimum setting value, the common game start unit 6213 motivates the player to actively repeat the basic game.

In addition to the above, the common game start unit 6213 has a function of monitoring a non-input time in which no start operation is performed, and outputting the game start command to the slot machines 10 except to the slot machine 10 in which the non-input time is equal to or longer than a timeout time. With this, the common game start unit 6213 is able to determine that no player is at a slot machine 10 where the basic game has not been played at least for the timeout time, and able to avoid the execution of the common game at such a slot machine 10.

The gaming terminal selection unit 6215 has a function of selecting a specific slot machine 10 from the slot machines 10 and outputting a common game start command signal to that specific slot machine 10. The transceiver unit 6217 has a function of exchanging data with the slot machines 10.

(Overall Structure of Game System)

A game system 350 including the gaming machine 300 having the functions above will be described.

As shown in FIG. 7, the game system 350 includes the slot machines 10 and the external controller 621 connected to the slot machines 10 over a communication line 301.

The external controller 621 is configured to control the slot machines 10. In the present embodiment, the external controller 621 is a so-called hall server provided in a gaming facility where a plurality of slot machines 10 are provided Each slot machine 10 has a unique identification number, and the external controller 621 determines the source of data sent from the slot machines 10 based on the identification number. Furthermore, the identification number is used to specify the transmission target, when data is sent from the external controller 621 to a slot machine 10.

The game system 350 may be constructed in a single gaming facility where various games such as casino games are playable or constructed for a plurality of gaming facilities. When constructed in a single gaming facility, the game system 350 may be constructed in each floor or section of the gaming facility. The communication line 301 may be wired or wireless, and is constructed by a dedicated line, a switched line, or the like.

(Mechanical Structure of Slot Machine)

Figure 8:
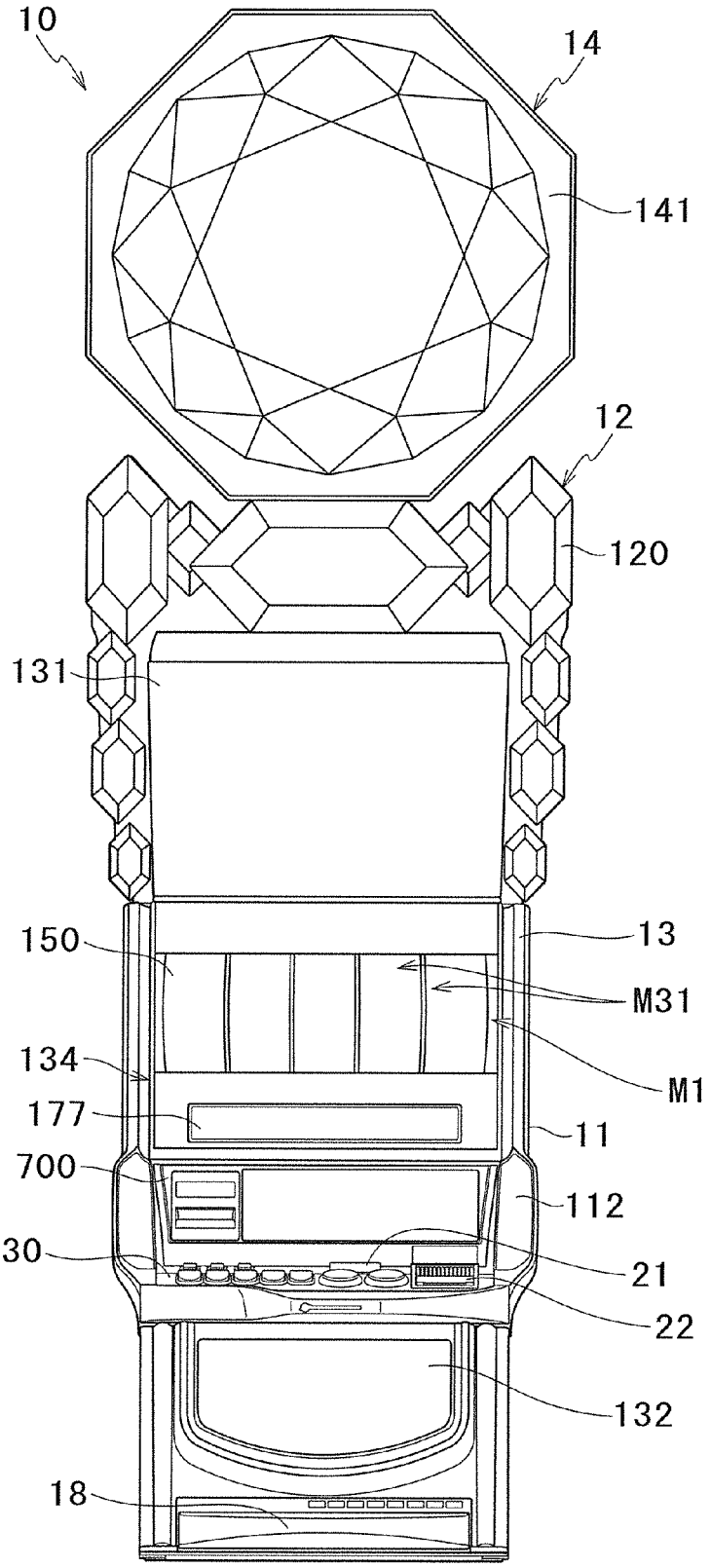
FIG. 8 is a front view of a slot machine in the gaming machine.
Figure 9:
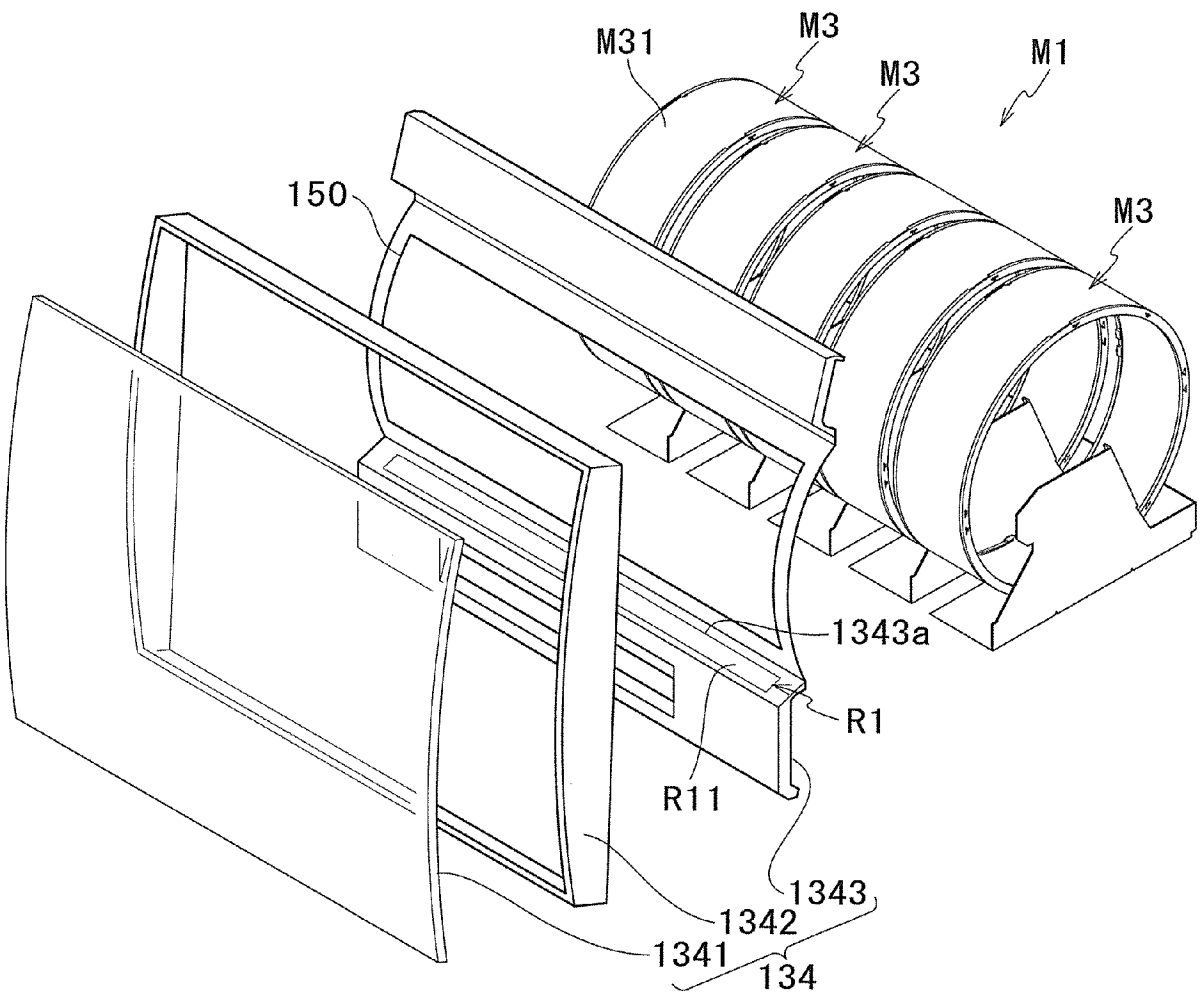
FIG. 9 is an exploded perspective view of a reel device and a reel cover.

Referring to FIG. 8, the overall structure of the slot machine 10 will be described.

A coin, a bill, or electrically valuable information corresponding to these is used as a game medium in the slot machine 10. In the present embodiment, in particular, credit-related data such as money data stored in an IC card is used.

The slot machine 10 includes a cabinet 11, a top box 12 installed on the upper side of the cabinet 11, a main door 13 provided at the front surface of the cabinet 11, and a topper display device 14 installed above the top box 12.

Figure 11:
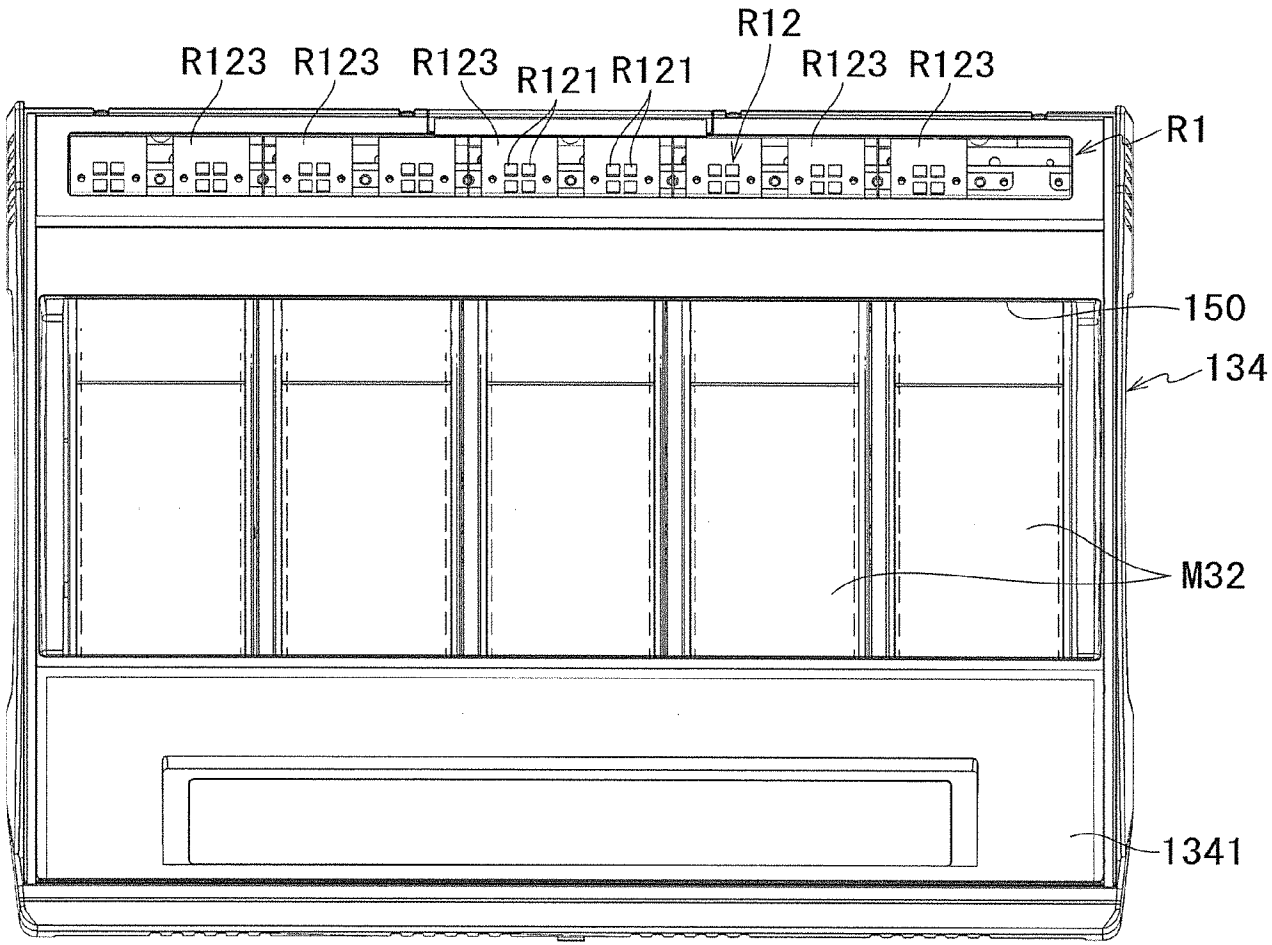
FIG. 11 is a front view of the reel cover.
Figure 12:
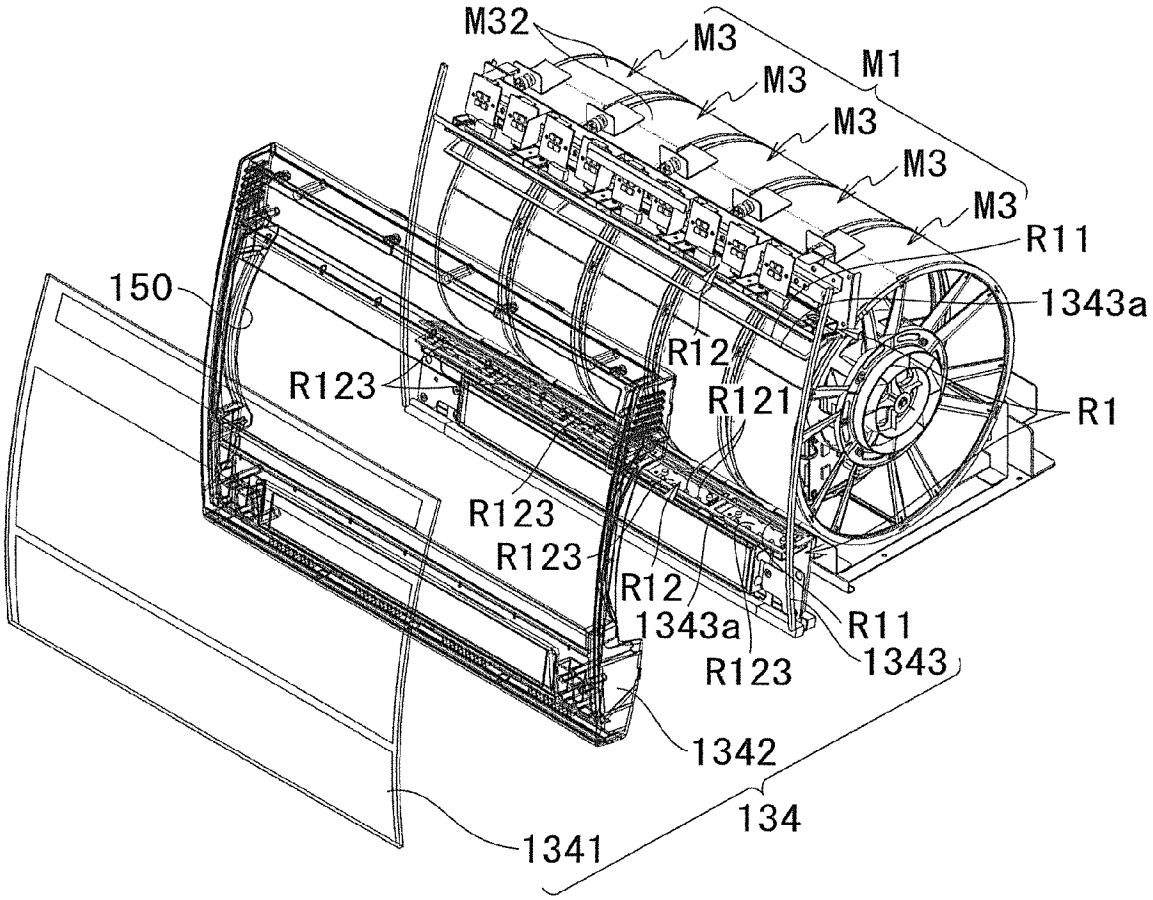
FIG. 12 is an exploded perspective view of the reel device and the reel cover.
Figure 13:
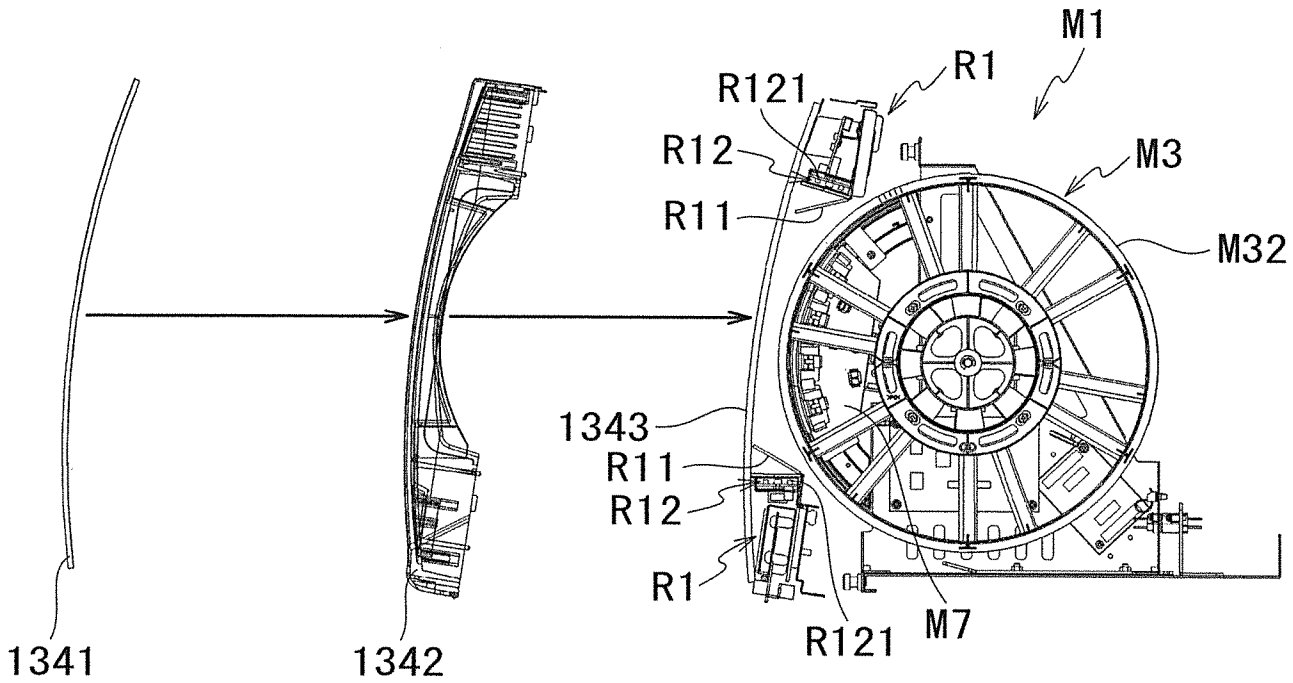
FIG. 13 is an exploded view of the reel device and the reel cover.
Figure 14:
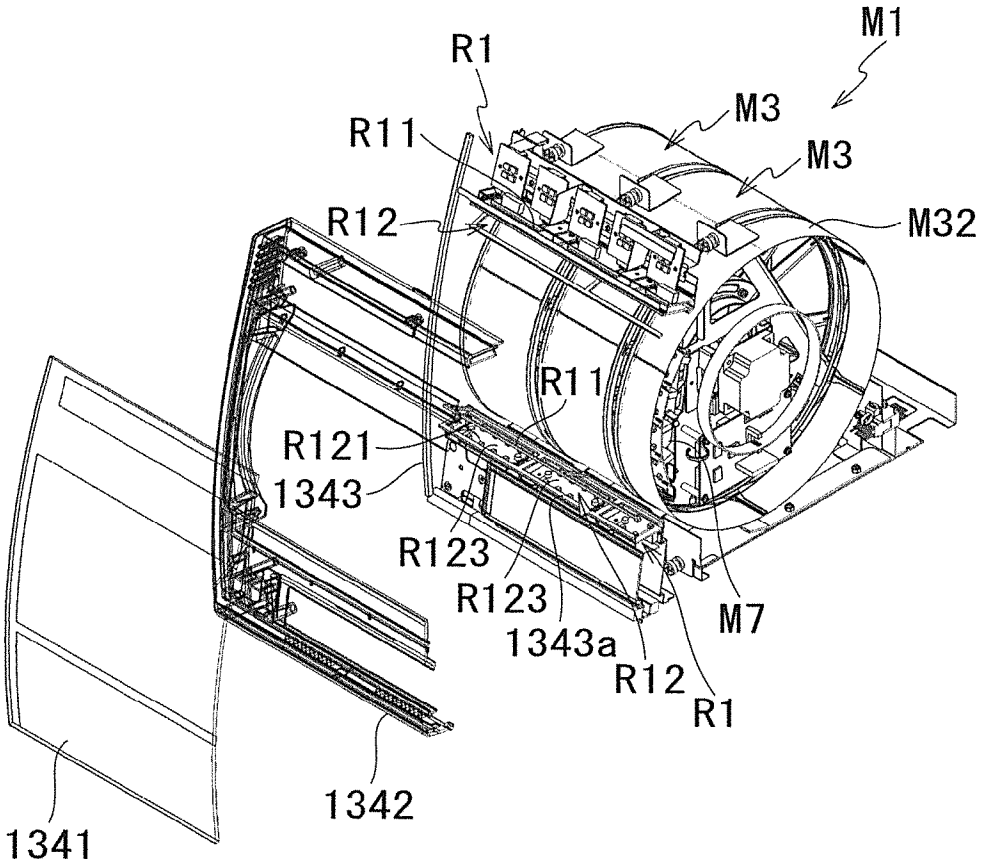
FIG. 14 is an exploded perspective view of a part of the reel device and a part of the reel cover.
Figure 15:
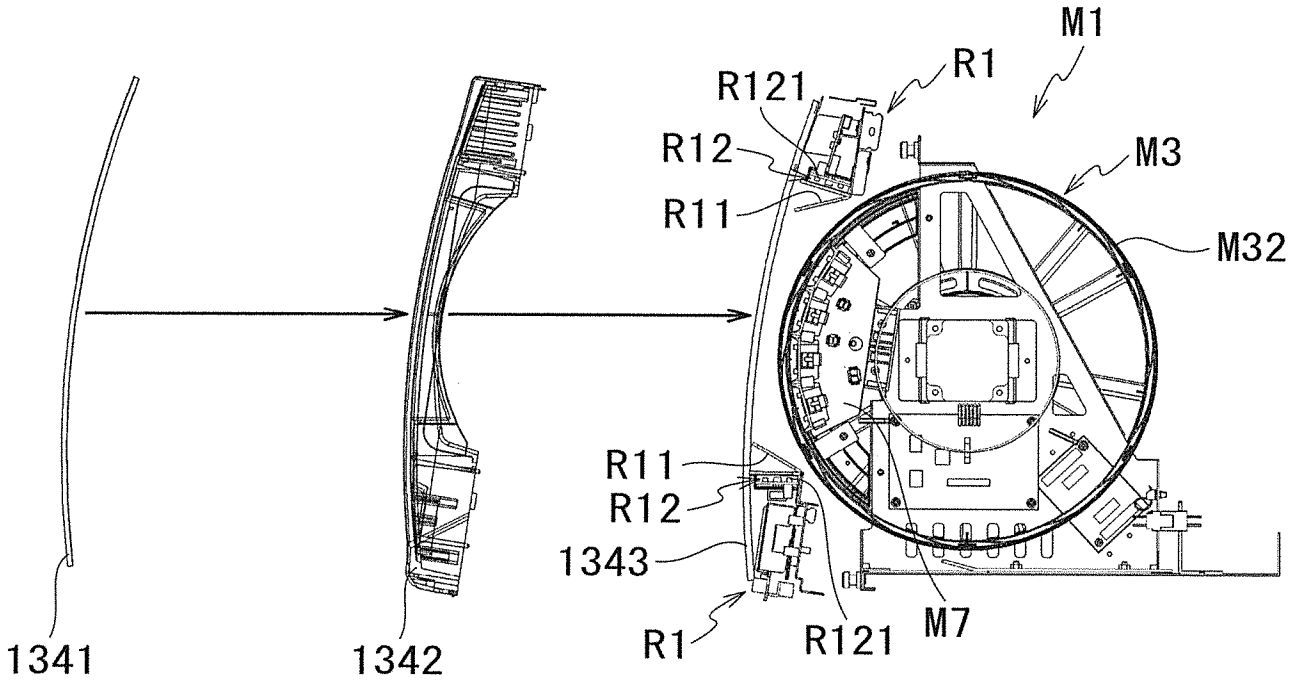
FIG. 15 is an exploded view of the reel device and the reel cover.
Figure 16:
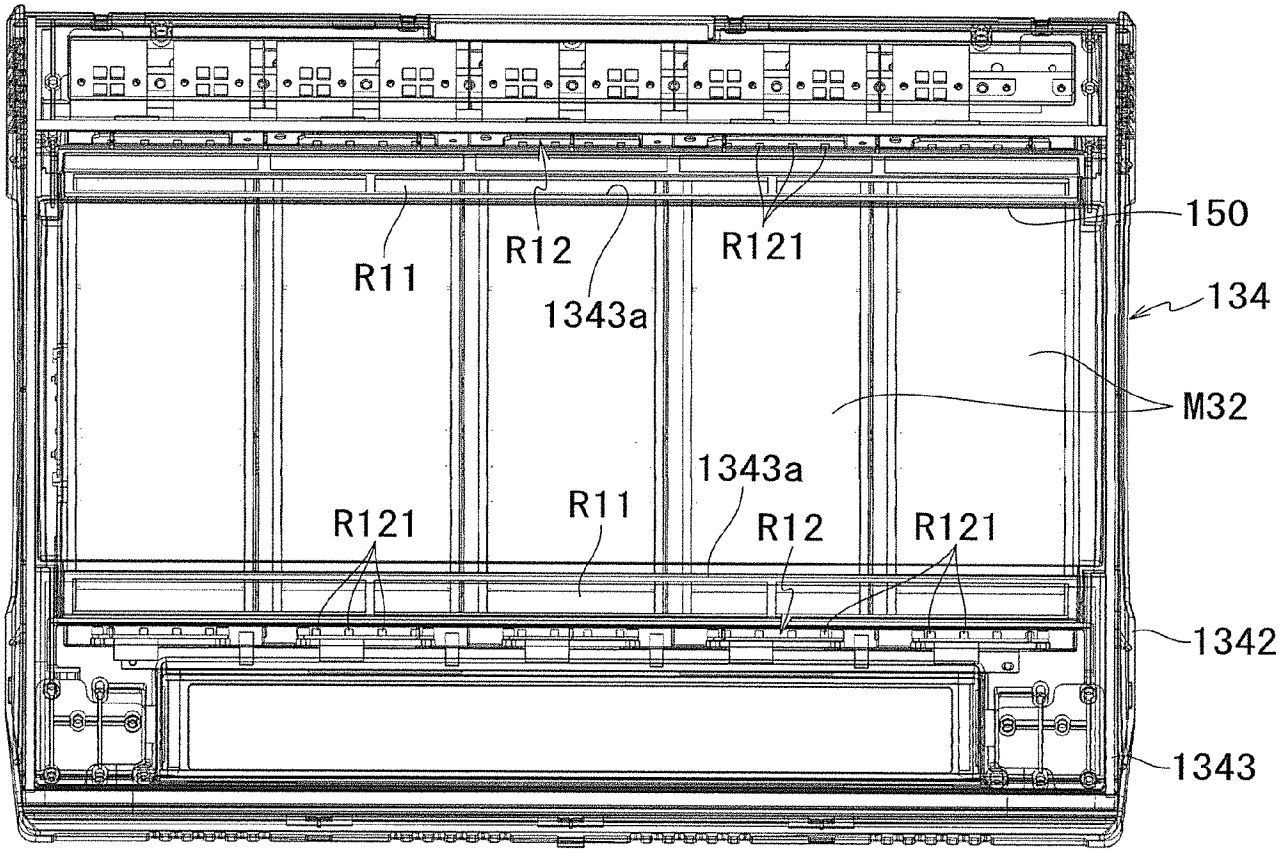
FIG. 16 is a front view of the reel cover.

The main door 13 is provided with a reel device M1. Below the reel device M1, there is provided the VFD 177. In front of the reel device M1 and the VFD 177, there is provided a reel cover 134. As shown in FIG. 9 and FIG. 11 to FIG. 16, the reel cover 134 has a transparent panel 1341, a panel frame 1342 behind the transparent panel 1341, and a panel supporter 1343 supporting the panel frame 1342. To the panel supporter 1343, the front light unit R1 is provided. As shown in FIG. 12 and FIG. 14, the front light unit R1 includes: translucent panels R11 respectively provided at openings 1343*a* of the panel supporter 1343; and illuminating light sources R12 configured to emit the front light illuminating light 904. The details of the front light unit R1 will be described later. Further, speakers 112 are provided to the main door 13.

As shown in FIG. 12, the reel cover 134 has the display window 150 at its center portion. Through the display window 150, 15 symbols 501 of 5 columns and 3 rows are visible from the outside. Three symbols 501 in each column are a part of a symbol group placed on the outer circumference surface of the reel M31. Three symbols 501 on each reel M31 are displayed while being moved downward or upward with a change in the overall speed. This enables rearranging of the symbols 501 displayed, by stopping them after rotating them longitudinally.

Note that the present embodiment deals with a case where the slot machine 10 has the mechanical reel device M1; however, the slot machine 10 of the present invention may adopt a combination of the mechanical reels and video reels which display pseudo reels. Further, on the reel cover 134, a touch panel may be provided. In this case, the player is able to input various instructions by operating the touch panel. The input signal from the touch panel is transmitted to the main CPU 71. Further, the reel cover 134 may have a transparent liquid crystal panel instead of the transparent panel 1341.

Below the reel device M1 is arranged a control panel 30. The control panel 30 is provided with buttons, a coin entry 21 for inserting coins into the cabinet 11, and a bill entry 22.

On the lower front surface of the main door 13, i.e., below the control panel 30, a coin receiving slot 18 for receiving coins, a belly glass 132 on which a character of the slot machine 10 or the like is depicted are provided.

On the front surface of the top box 12, there is provided an upper image display panel 131. The upper image display panel 131 is made of a liquid crystal panel, and structures a display. The upper image display panel 131 displays an image related to an effect, an image for introducing the game or explaining the rules of the game. Further, the top box 12 is provided with a top box decoration unit 120 which forms an upper portion and side surfaces of the top box 12. The top box decoration unit 120 and the topper display device 14 will be described later.

(Reel Device M1)

Figure 10:
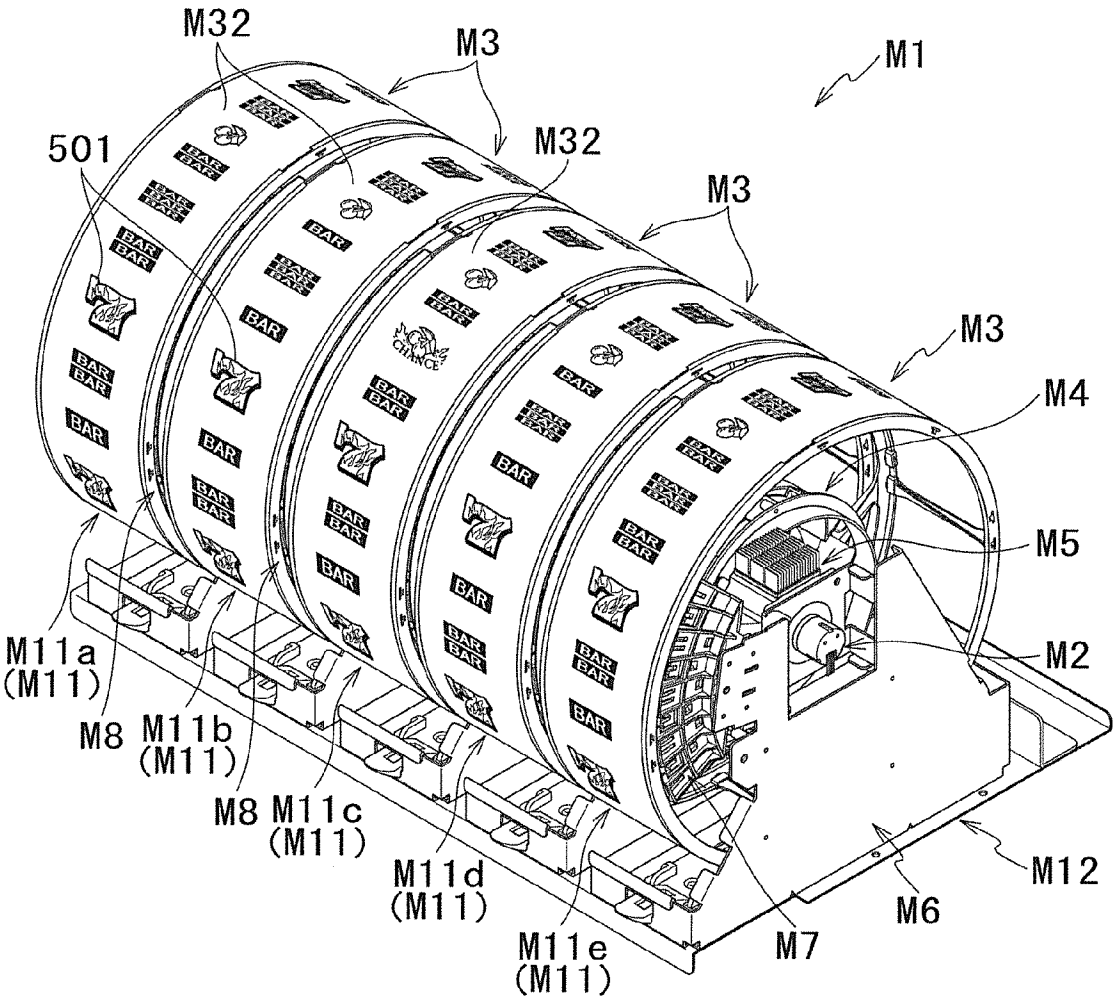
FIG. 10 is a perspective view of the reel device.

The reel device M1 provided to the slot machine 10 has the plurality of reels M31 each of which has a cylindrical shape and which are supported so that the reels M3 are horizontally aligned and are concentric with each other as shown in FIG. 10. That is, each reel M31 is rotated with its cylinder central axis being held at a predetermined position by the reel device M1 (reel drive mechanism). The reel device M1 has reel units M11 each of which is configured to rearrange the symbols 501 by rotating the corresponding reel M31 having the symbols 501 placed on the outer circumferential surface of the reel M31, and a reel unit holding mechanism M12 detachably holding the reel units M11. In the following description, each of the reel units M11 is referred to as a first reel unit M11*a* to a fifth reel unit M11*e*, from the left to right viewed from the front, when the location of the reel unit M11 needs to be specified.

Each reel unit M11 has: the reel M31 having the symbols 501 placed on its outer circumference surface; and a reel support mechanism M6 supporting the reel M31. Each reel M31 has the annular reel strip M32 on which one or more symbols 501 are placed.

Figure 17:
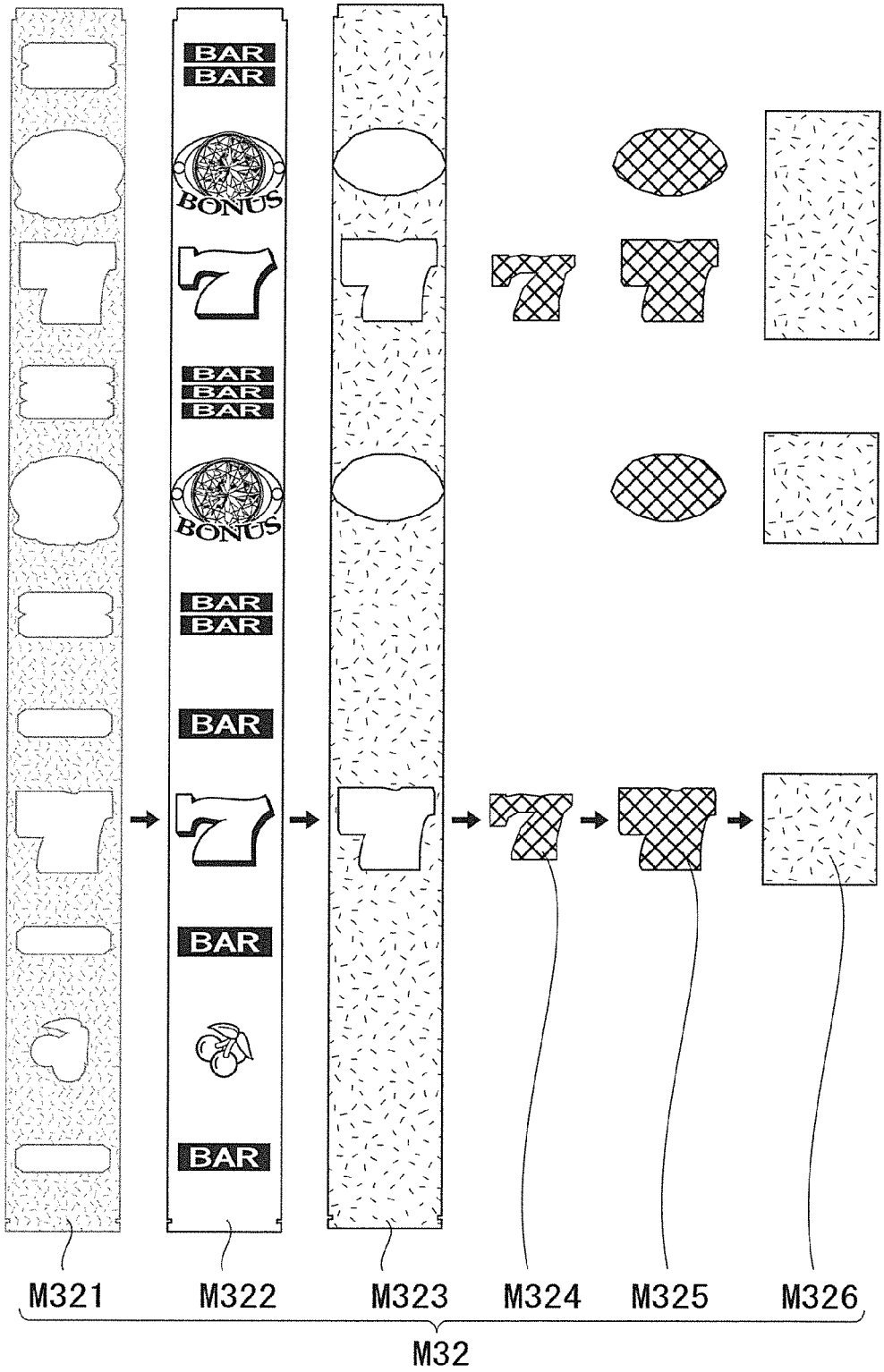
FIG. 17 is an explanatory diagram showing layers of a reel strip.
Figure 18:
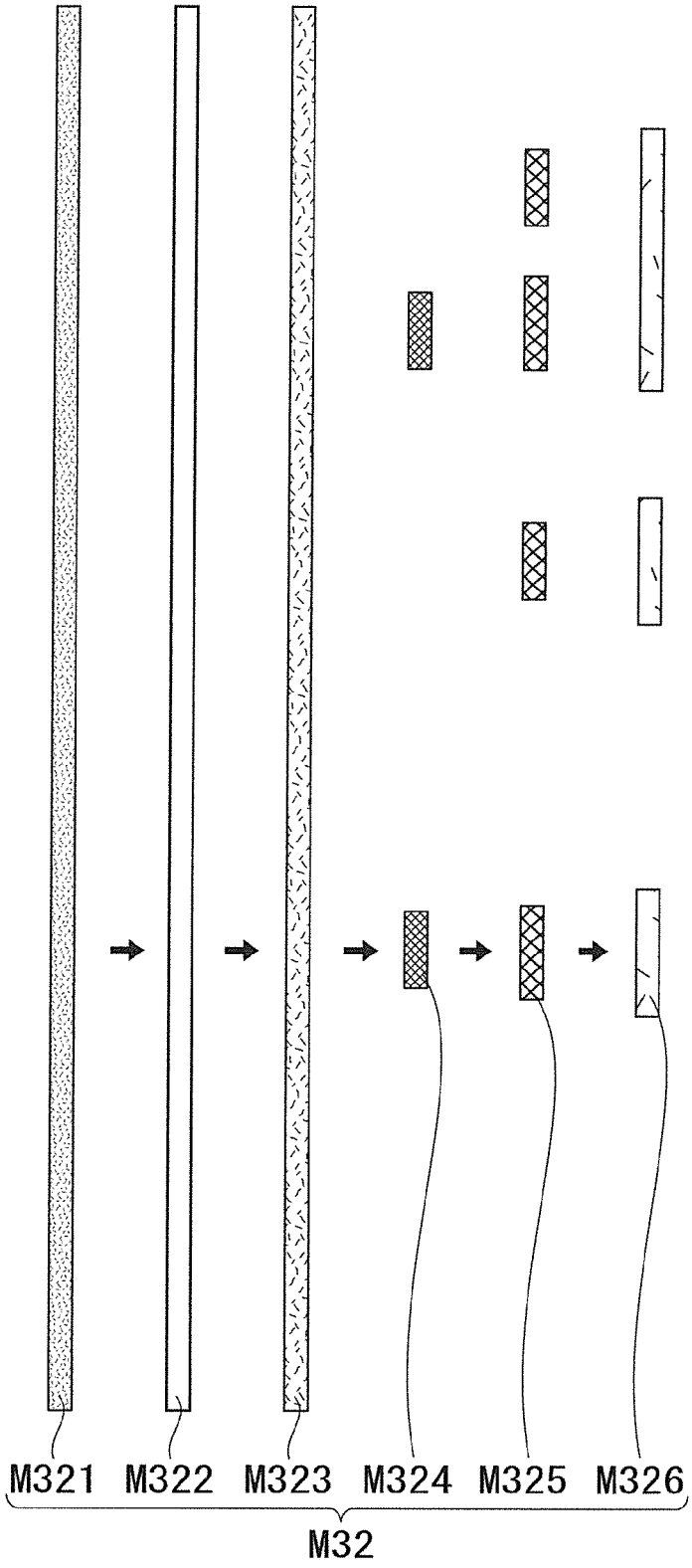
FIG. 18 is an explanatory diagram showing the layers of the reel strip.
Figure 19:
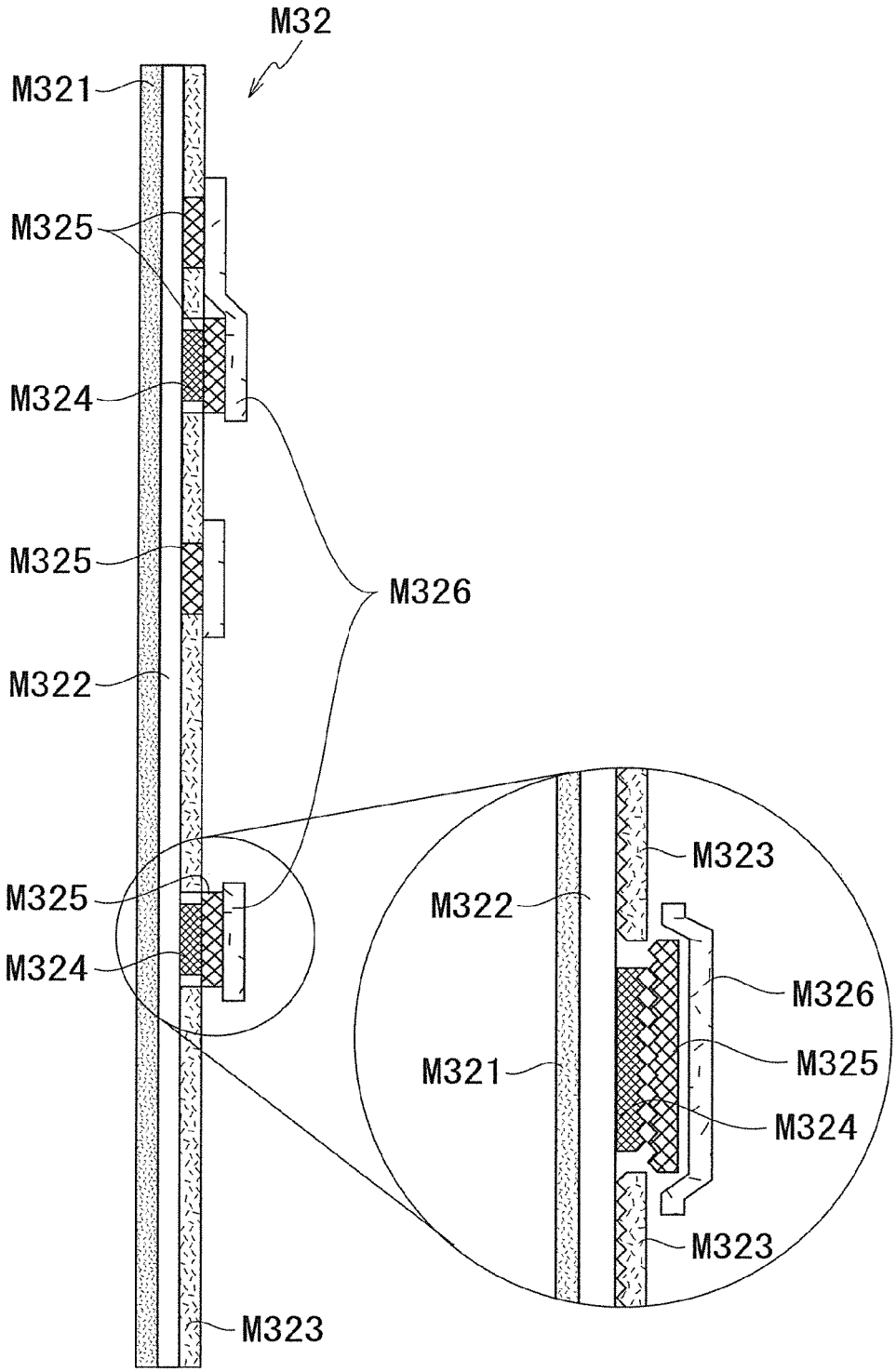
FIG. 19 is an explanatory diagram showing a section of the reel strip.

As shown in FIG. 17 to FIG. 19, each reel strip M32 has the color shifting layer M321, a symbol-printed layer M322, a first diffusion layer M323, a second diffusion layer M324, a third diffusion layer M325, and a lamination layer M326. The color shifting layer M321 is a multilayer optical film which selectively transmits visible light in a first predetermined wavelength band and selectively reflects visible light in a second predetermined wavelength band depending on the incident angle of the light, from which film the shapes of the symbols are cut out. That is, there is no color shifting layer M321 in the areas for the symbols 501. Thus, in the areas for the symbols 501, there is no change in color depending on the viewing angle, and this contrarily emphasizes the symbols 501.

The color shifting layer M321 is the outermost layer when each reel strip M32 is put on the corresponding reel M31. The symbol-printed layer M322 is a transparent PET (polyethylene terephthalate) sheet on which the symbols have been printed. Each of the first diffusion layer M323, the second diffusion layer M324, and the third diffusion layer M325 is a light diffusing sheet formed to match with the symbols, and made from soft polyvinyl chloride (PVC). The lamination layer M326 is a polyvinyl chloride film for lamination.

Further, as shown in FIG. 19, each of the first diffusion layer M323, the second diffusion layer M324, and the third diffusion layer M325 has two surfaces, one of which is smooth (a smooth surface), and the other of which has a mesh structure (a rough surface). The rough surface of the first diffusion layer M323 is adhered to the symbol-printed layer M322. Further, the second diffusion layer M324 is adhered to the symbol-printed layer M322 using not-shown double-sided tape. Furthermore, the third diffusion layer M325 is adhered to the second diffusion layer M324 or the symbol-printed layer M322 using not-shown double-sided tape.

Thus, on the inner circumferential surface side (back surface side) of the color shifting layer M321, the symbol-printed layer M322, the first diffusion layer M323, the second diffusion layer M324, the third diffusion layer M325, and the lamination layer M326 are placed in this order.

Note that each reel strip M32 may include a transparent protection layer formed on the front surface side of the color shifting layer M321. Further, the reel strip M32 may include a smoked layer formed on the front surface side of the color shifting layer M321 which causes the symbols 501 to appear only when the backlight is turned on. The smoked layer has a mirror structure which reflects light coming from the front. Therefore, when the backlight is turned off, illuminating light of the hall is reflected by the smoked layer, and therefore the symbols 501 positioned behind the smoked layer disappear. When the backlight is turned on, the amount of light from the backlight is larger than the amount of light from the illumination light. Therefore, the light emitted from the backlight passes through the symbols 501 and the smoked layer, with the result that the symbols 501 appear on the reel strips M32.

(Reel Unit M11: Backlight Unit M7)

As shown in FIG. 10, the backlight unit M7 is provided at the position inside the reels M31 having the structure described above. The backlight unit M7 is provided so as to emit illumination light from the position inside the reels M31 towards the reel strips M32, and the illumination light transmitted by the reel strip M32 are visible outside the slot machine 10. This causes the player to see the symbols 501 as if they are displayed on the reel strips M32.

Figure 20:
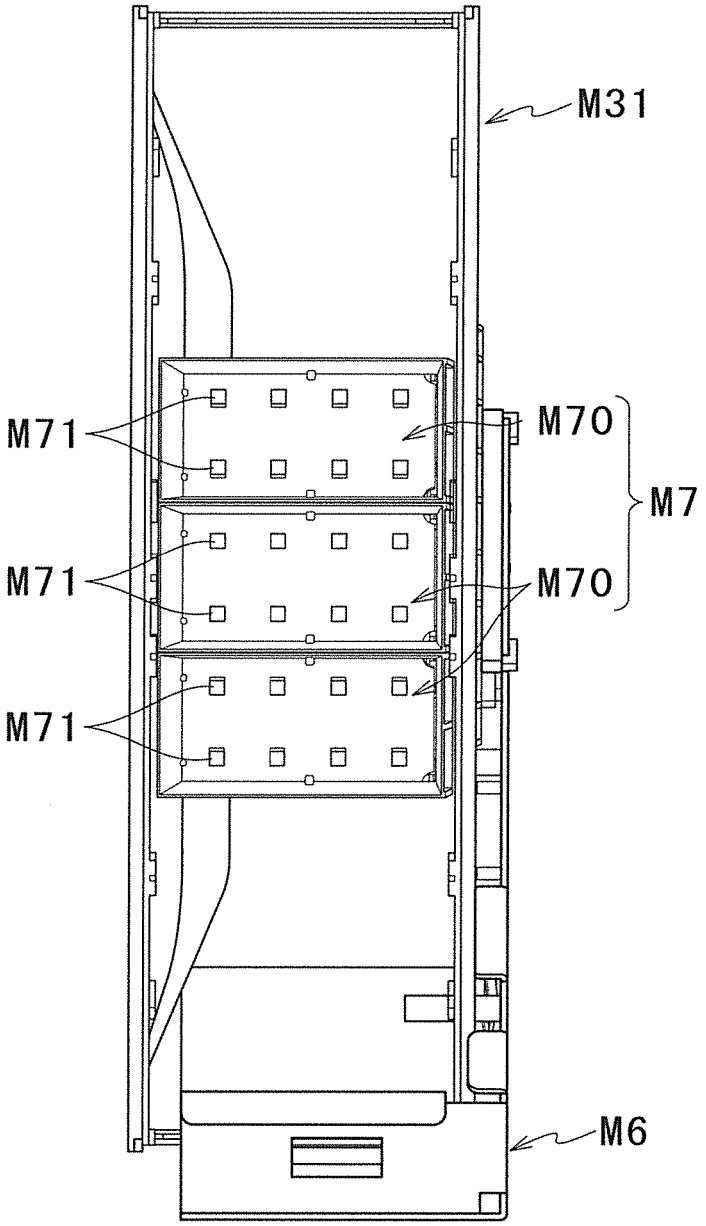
FIG. 20 is a front view of a reel frame and a backlight unit.

Specifically, as shown in FIG. 20, the backlight unit M7 includes backlight light source units M70. In each reel, three backlight light source units M70 are vertically disposed. The backlight light source units M70 are spaced apart from each other so as to respectively oppose the symbols 501 arranged on the display window 150. That is, the backlight light source units M70 are arranged so that each is positioned on a line connecting the corresponding symbol 501 and the center of rotation of the reel M31. This enables the backlight illuminating light to pass through each reel strip M32 while causing each backlight light source unit M70 to illuminate the opposing symbol 501. Each backlight light source unit M70 has a plurality of illuminating light sources M71 arranged in the width direction and in the longitudinal direction of the reel strip M32. With these light sources M71, the amount of the emitted backlight illuminating light is adjustable to multiple levels. The plurality of illuminating light sources M71 are controllable individually. This makes it possible to arbitrarily adjust the backlight illuminating light applied from the backlight light source unit M70 to any of the symbols 501 arranged on the display window 150. Therefore, by decreasing the amount of backlight illuminating light to a portion of the reel strip M32 which portion including any given symbol 501 arranged on the display window 150, it is possible to purposefully cause a change in color in this portion with the use of the color shifting layer M321.

(Front Light Unit R1)

As shown in FIG. 1 and FIG. 11 to FIG. 16, the front light unit R1 configured to emit front light illumination light to the reels M31 of the reel device M1 is disposed at the positions outside the reel device M1. The front light unit R1 is located at the positions along a direction of the rotation of the reels M31 and outside the display window 150. That is, the front light unit R1 is located at the positions above and below the reel device M1 having the plurality of reel M31. Thus, the front light unit R1 is located at the positions out of a sight area in which the reels M31 are visible from the outside of the cabinet 11 through the display window 150.

Note that the front light unit R1 may be disposed in at least one of the positions above and below the reel device M1. Specifically, the front light unit R1 may be disposed in at least one of the outside positions above and below the display window 150, and may be configured to emit front light illuminating light 904 wider than the entire width of all the reels M31 supported by the reel device M1.

Further, the front light unit R1 is provided to the reel cover 134 functioning as a front wall closer to the display window 150. The front light unit R1 and the reel cover 134 are formed into a unit. This enables the front light unit R1 to be attached at the same time when the reel cover 134 is attached to the cabinet 11.

Note that the front light unit R1 is set so as to apply front light illuminating light 904 to the surface of the reel device M1. In other words, the front light unit R1 is set so as to apply front light illuminating light 904 to a non-active range, i.e., an area other than the active range of the symbols 501.

Specifically, the front light unit R1 includes: the translucent panels R11 (a transparent member) respectively provided in openings 1343*a* of the panel supporter 1343; and the illuminating light sources R12 configured to emit front light illuminating light 904. Each transparent panel R11 has a width substantially the same as the width of the reel device M1. Further, the illuminating light sources R12 are formed so as to emit front light illuminating light 904 from the entire width of each transparent panel R11.

Each illuminating light source R12 has a plurality of full color LEDs R121. Each full color LED R121 is a light source including light emitting diode chips of the three primary colors, i.e., red, green and blue. The full color LED R121 is capable of creating front light illuminating light 904 of any given color by adjusting the amount of light of each light emitting diode chip. The full color LEDs R121 are arranged in a matrix in the width direction and the depth direction. Specifically, as shown in FIG. 11, the illuminating light source R12 includes LED units R123 disposed so as to correspond to the reels M31. For each reel 31, two LED units R123 are arranged in the width direction of the reel strips M32. Each LED unit R123 includes four full color LEDs R121 arranged in two rows and two columns. This way, the position on the reel device M1 where the light is applied is adjustable by controlling which of the full color LEDs is turned on.

Thus, the front light unit R1 is configured so that the emission manner (light amount, color, time interval between emissions, timing of emission, and the like) of the emitted front light illuminating light is controllable. Further, the front light unit R1 has the illuminating light sources R12 each having the plurality of LED units R123 arranged in the width direction of the reel strips M32. With these LED units R123, the amount of the emitted front light illuminating light is adjustable to multiple levels. Each of the LED units R123 has four full color LEDs R121, and the full color LEDs R121 are controllable individually.

The thus structured front light unit R1 is disposed at the positions outside the display window 150 when viewed from the outside of the cabinet 11. Therefore, the front light illumination light from the front light unit R1 received by the player is front light reflected light reflected by the reel strips M32. That is, the player sees the front light reflected light, which is light reflected by and filtered through the color shifting layer M321 that is the outermost layer of each reel strip M32.

In other words, when the player looks at a specific point on a reel strip M32, the player sees visible light produced by combining backlight transmitted light, which is the backlight illumination light transmitted by and filtered through the reel strip M32, and front light reflected light, which is the front light illumination light reflected by and filtered through the reel strip M32. The incident angles of the backlight illumination light and the front light illuminating light to the reel strip M32 based on the target point position on the reel strip M32 looked at by the player and on the viewing angle of the player (the position of the player), and the intensities of the backlight illumination light (backlight transmitted light) and the front light illuminating light (front light reflected light) smoothly change as the target point position on the reel strip M32 looked at the player changes. Therefore, the player perceives as if the reel strip M32 has a gradation of colors.

(Top Box Decoration Unit 120)

Figure 21:
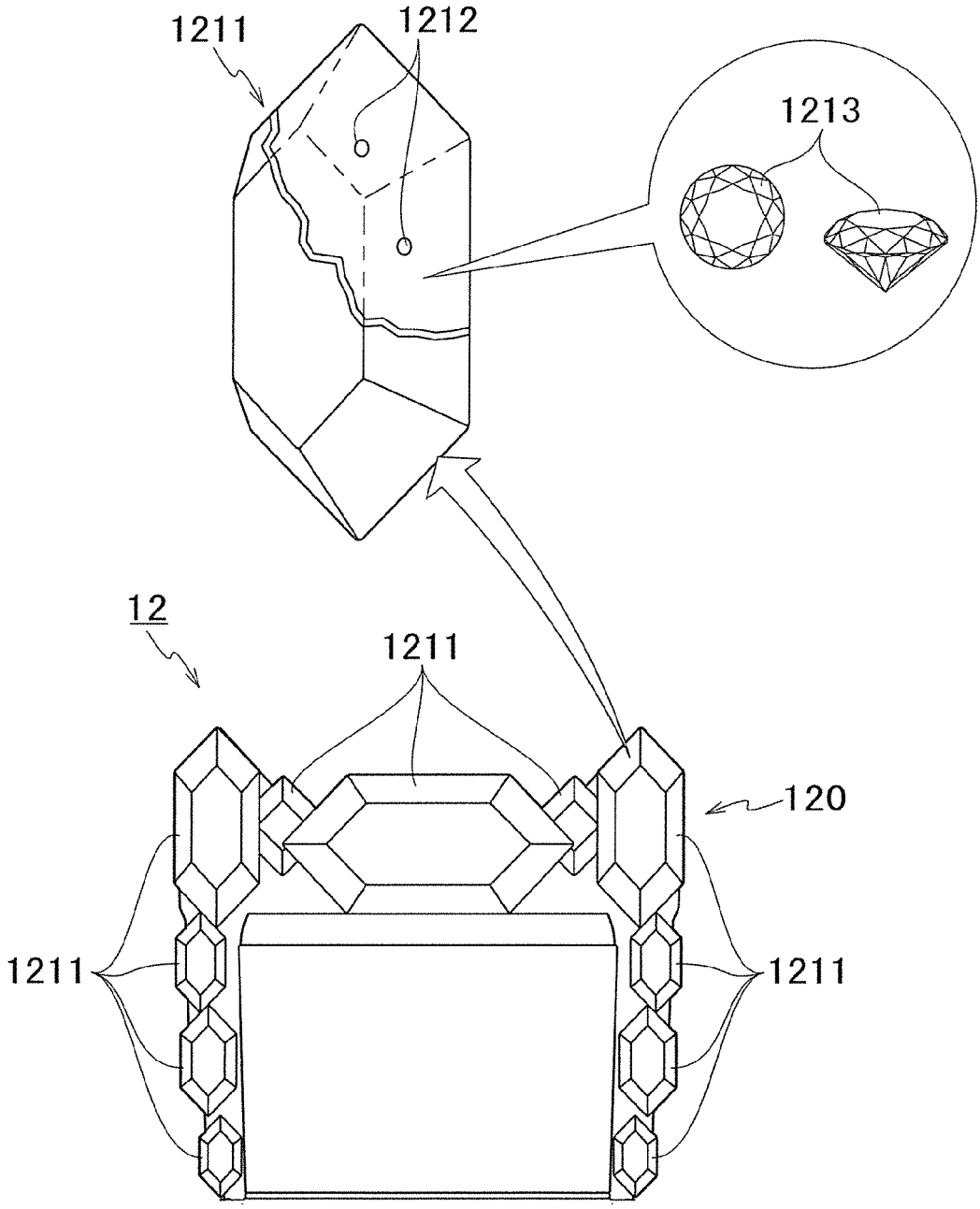
FIG. 21 is an explanatory diagram showing a structure of a top box decoration unit.

As shown in FIG. 8 and FIG. 21, the top box 12 has the top box decoration unit 120. The top box decoration unit 120 has a plurality of structures 1211, and the different sizes of structures 1211 are disposed around the upper image display panel 131.

Each of the structures 1211 has a plurality of facets at its front, and has a shape imitating a jewel. Each structure 1211 is made of a translucent member (such as glass or a resin) which transmits light. Each structure 1211 may be made of other members as long as a part of its front portion is made of the translucent member. Each structure 1211 is a hollow member having an accommodation space inside thereof. All the structures 1211 do not have to have the accommodation spaces. To a rear portion of the accommodation space of each structure 1211, a plurality of illuminations 1212 are attached. The illuminations 1212 are full color LEDs as described above; however, the present invention is not limited to these. The top box decoration unit 120 has a not-shown device for controlling the LEDs. With this, the light amount, color, time interval between light emissions, timing of light emission, and the like of the illuminations 1212 are individually controllable.

The accommodation space of each structure 1211 accommodates therein a plurality of parts 1213. Each of the parts 1213 has a plurality of facets, to be formed into a shape imitating a jewel. Each part 1213 is made of a translucent member (such as glass or a resin) which transmits light. The number of parts 1213 accommodated in each structure 1211 is not particularly limited; however, it is preferable to accommodate the parts 1213 so that the vertical level of the accommodated parts 1213 is equal to or higher than the vertical position of the illuminations 1212 provided in the structure 1211. With this, light emitted from the illuminations 1212 is applied to the parts 1213. As a result, it is possible to provide an effect that light emitted from the illuminations 1212 is irregularly reflected by the parts 1213 each having the plurality of facets.

(Topper Display Device 14)

Figure 22:
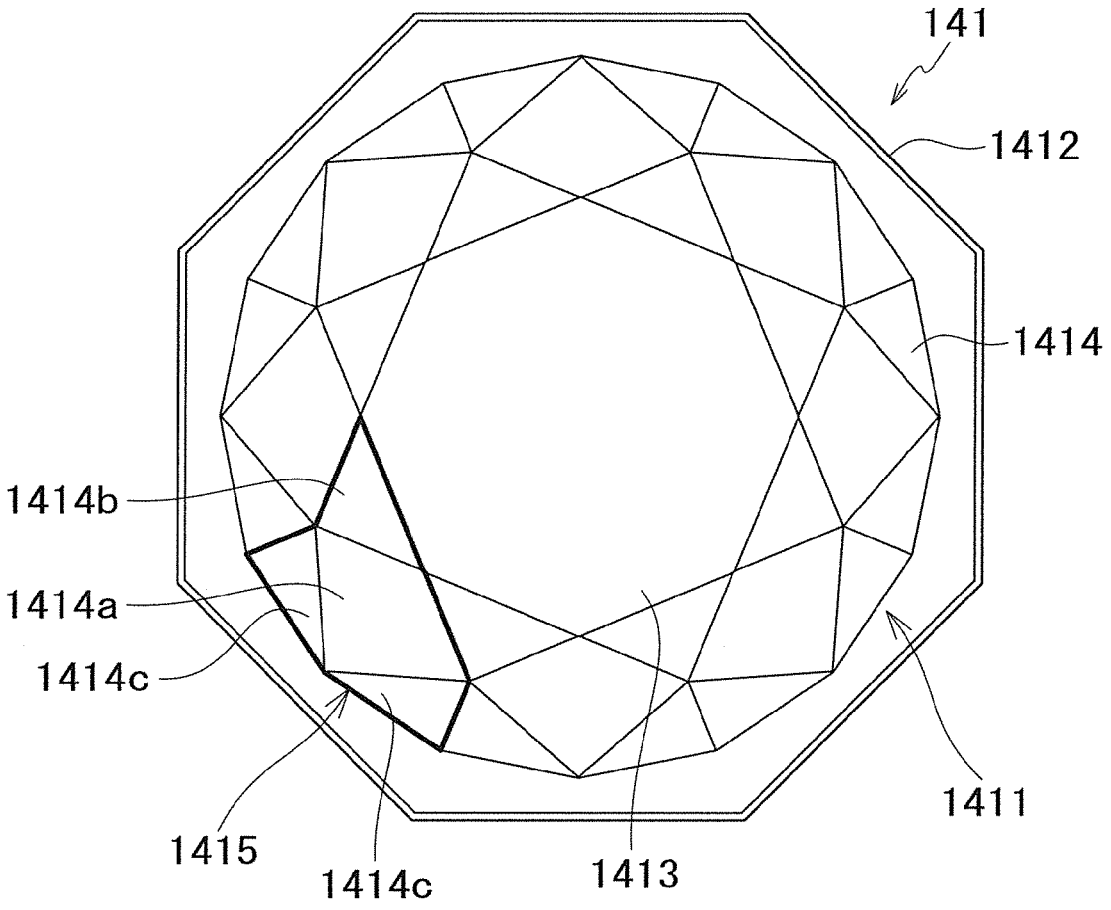
FIG. 22 is an explanatory diagram showing a structure of a topper display device.
Figure 27:
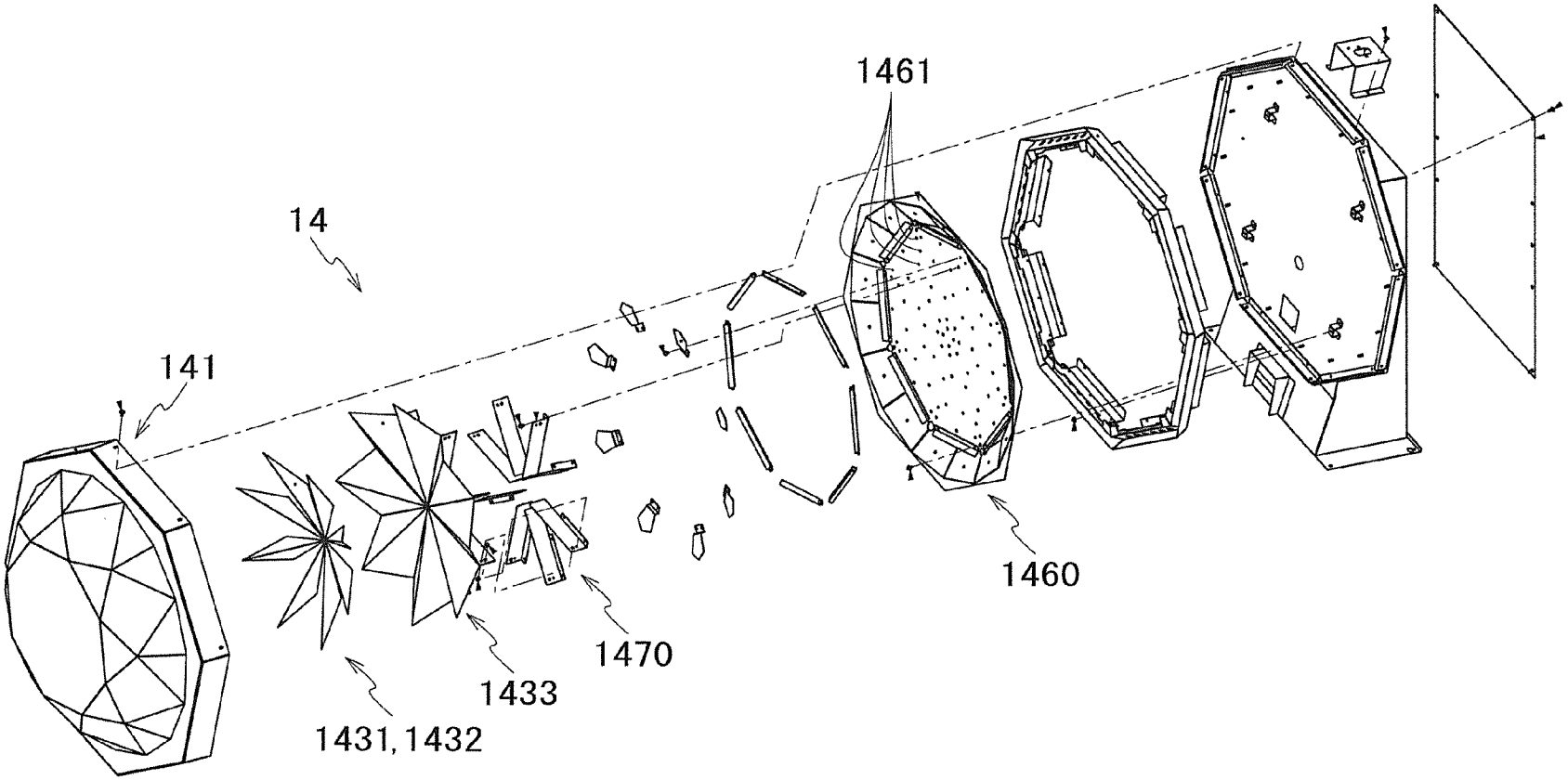
FIG. 27 is an exploded perspective view of the topper display device.

As shown in FIG. 8, FIG. 22, and FIG. 27, the topper display device 14 has a surface cover 141. The surface cover 141 has a front portion 1411 and a side portion 1412. The front portion 1411 has a plurality of facets, to be formed into a shape imitating a jewel. The front portion 1411 imitates a so-called "brilliant cut diamond", more particularly a "round brilliant cut diamond". Note that the front portion 1411 imitates only a crown of the "round brilliant cut diamond". That is, the front portion 1411 does not include a girdle of a cylindrical shape and a pavilion of a substantially conical shape, which are usually formed in the "round brilliant cut diamond".

Specifically, the front portion 1411 has a substantially frustoconical outer shape, and includes a table portion 1413 and cut portions 1414. The table portion 1413 is formed into a flat surface of a right octagon. Around the table portion 1413, the cut portions 1414 are disposed. Each of the cut portions 1414 has a crown main facet portion 1414*a*, a star facet portion 1414*b*, and upper girdle facet portions 1414*c*.

Each crown main facet portion 1414*a* has a quadrangular shape, and the crown main facet portions 1414*a* are arranged equally in the circumferential direction along an outer peripheral surface formed by a substantially conical surface of the front portion 1411. (There are eight crown main facet portions 1414*a*). Each star facet portion 1414*b* has a triangular shape and is arranged in a region defined by an outer edge of the table portion 1413 and by two adjacent crown main facet portions 1414*a*. (There are eight star facet portions 1414*b*.) Each upper girdle facet portion 1414*c* has a triangular shape and each pair of girdle facet portions 1414*c* are arranged in a region defined by a circumferential edge of the front portion 1411 and an adjacent crown main facet portions 1414*a* so as to oppose each other. (There are sixteen upper girdle facet portions 1414*c*.) To an inner side of each cut portion 1414, attached is a cut portion effect sheet 1415.

Figure 23:
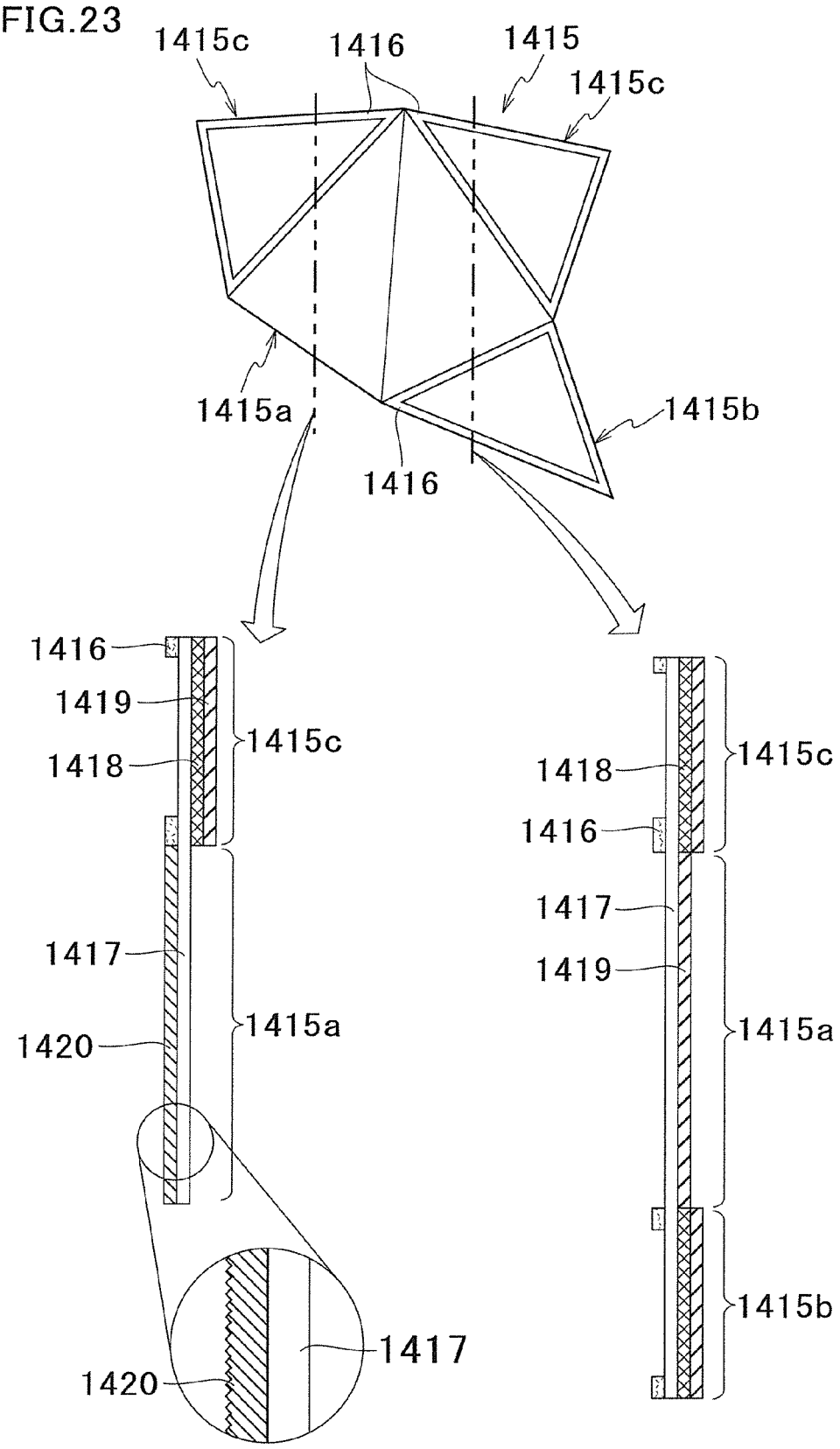
FIG. 23 is an explanatory diagram showing a structure of a front portion of the topper display device.

The cut portion effect sheet 1415 is a sheet member attached to the inner side of the cut portions 1414 of the front portion 1411. As shown in FIG. 23, the cut portion effect sheet 1415 is a flat member having a multilayer structure, and then the cut portion effect sheet 1415 is bent to be three-dimensionally attached to the inner side of each cut portion 1414. Specifically, the cut portion effect sheet 1415 includes a double-sided tape layer 1416, a PET layer 1417, a first hologram sheet layer 1418, a second hologram sheet layer 1419, and a diffusion layer 1420. Each of the first hologram sheet layer 1418 and the second hologram sheet layer 1419 is a sheet on which an interference pattern is formed, and is configured to reflect light in rainbow colors by means of a prismatic effect. The diffusion layer 1420 is a sheet configured to diffuse light, and is made from soft polyvinyl chloride (PVC).

More specifically, on the PET layer 1417 sized to match each cut portion 1414, the double-sided tape layer 1416 is laminated. The double-sided tape layer 1416 is laminated on the outer side of the PET layer 1417 so that the double-sided tape layer 1416 lies along the outlines of the star facet portion 1414*b* and of the two upper girdle facet portions 1414*c*. Further, the diffusion layer 1420 is laminated on a half of the region of the PET layer 1417 which region corresponds to the crown main facet portion 1414*a*. The first hologram sheet layer 1418 is laminated on the regions of the inner side of the PET layer 1417, which regions correspond to the star facet portion 1414*b* and the two upper girdle facet portions 1414*c*. Further, the second hologram sheet layer 1419 is laminated on the region of the inner side of the PET layer 1417 which region corresponds to the other half of the crown main facet portion 1414*a* (where the diffusion layer 1420 is not laminated) and in the regions correspond to the star facet portion 1414*b* and to the two upper girdle facet portions 1414*c*.

Figure 24:
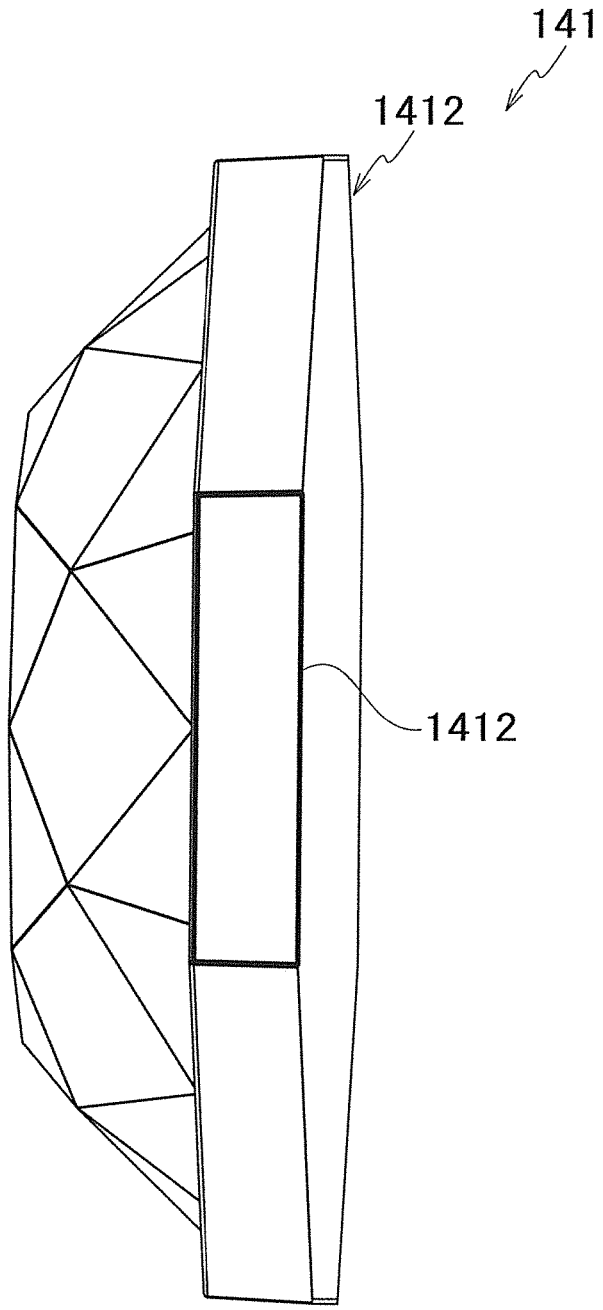
FIG. 24 is an explanatory diagram showing a structure of a side portion of the topper display device.

As shown in FIG. 24 and FIG. 27, the side portion 1412 is formed into a hollow octagonal prism. To the inner sides of the side portion 1412, eight side portion effect sheets 1412*a* having the same shape are attached.

Figure 25:
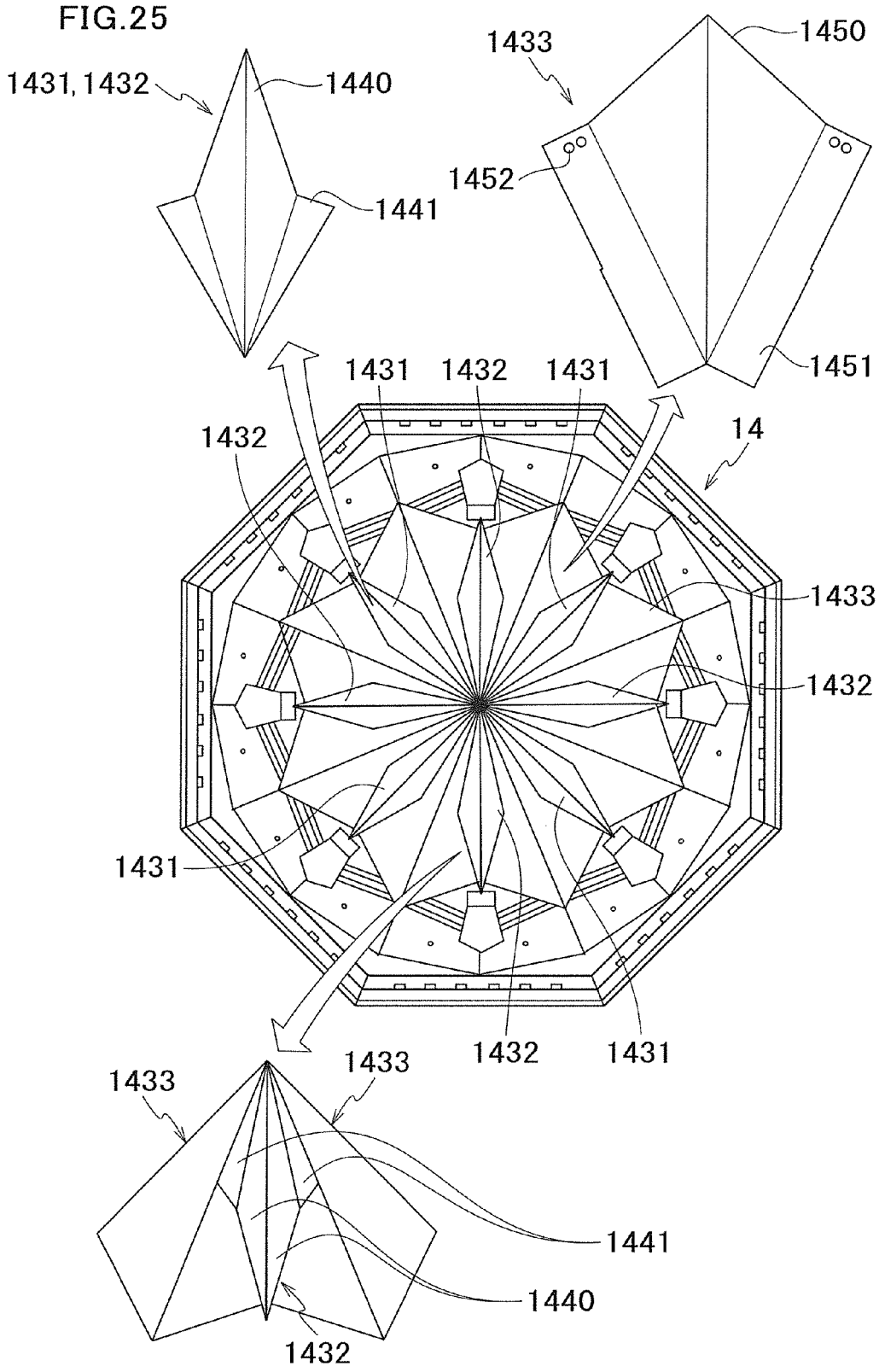
FIG. 25 is an explanatory diagram showing an internal structure of the topper display device.
Figure 26:
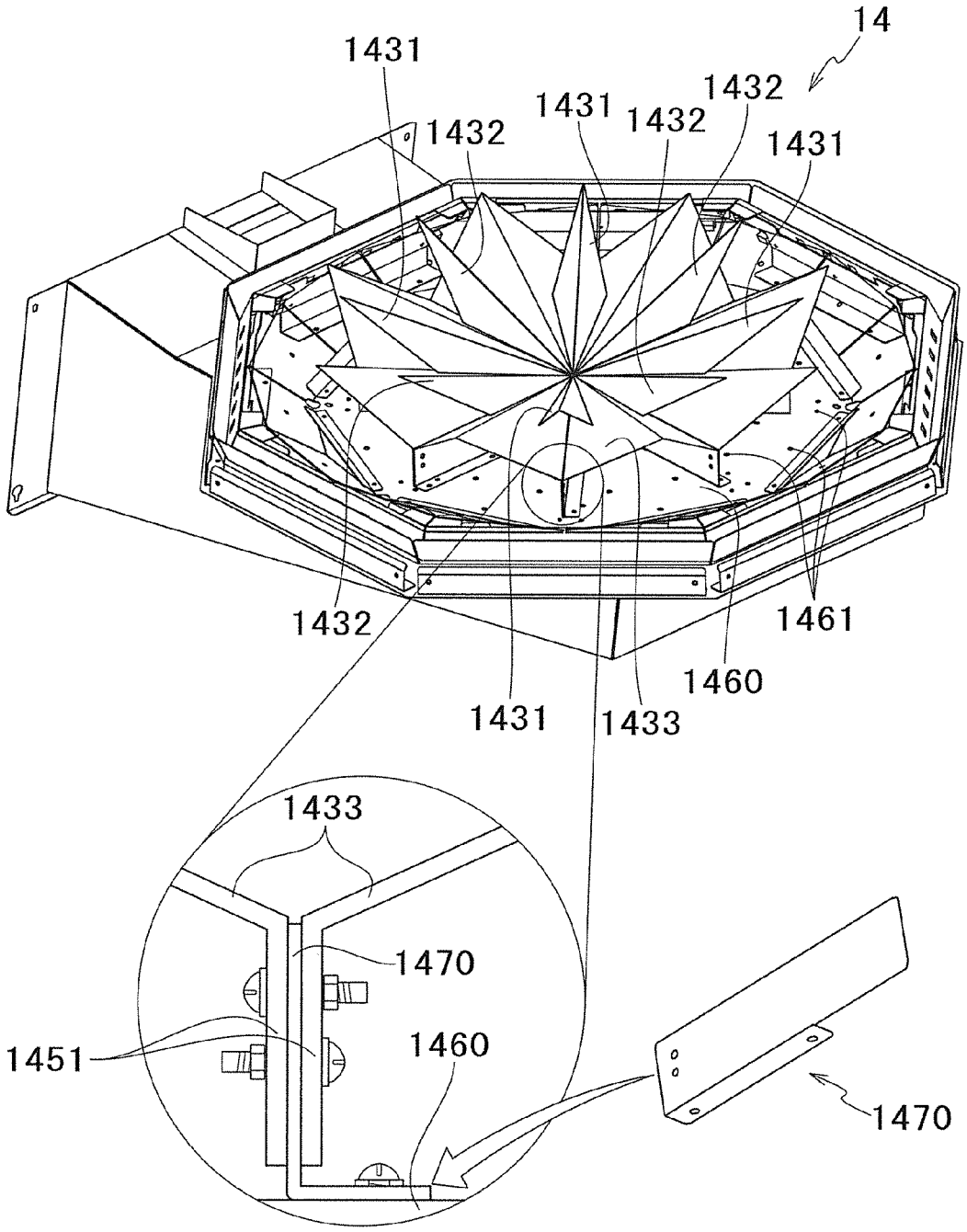
FIG. 26 is an explanatory diagram showing the internal structure of the topper display device.

Now, the internal structure of the topper display device 14 will be described. As shown in FIG. 25 to FIG. 27, inside of the topper display device 14, there are disposed first diffusion members 1431, second diffusion members 1432, and third diffusion members 1433. Each first diffusion member 1431, each second diffusion member 1432, and each third diffusion member 1433 have their respective lamination structures which are different from one another.

Figure 28:
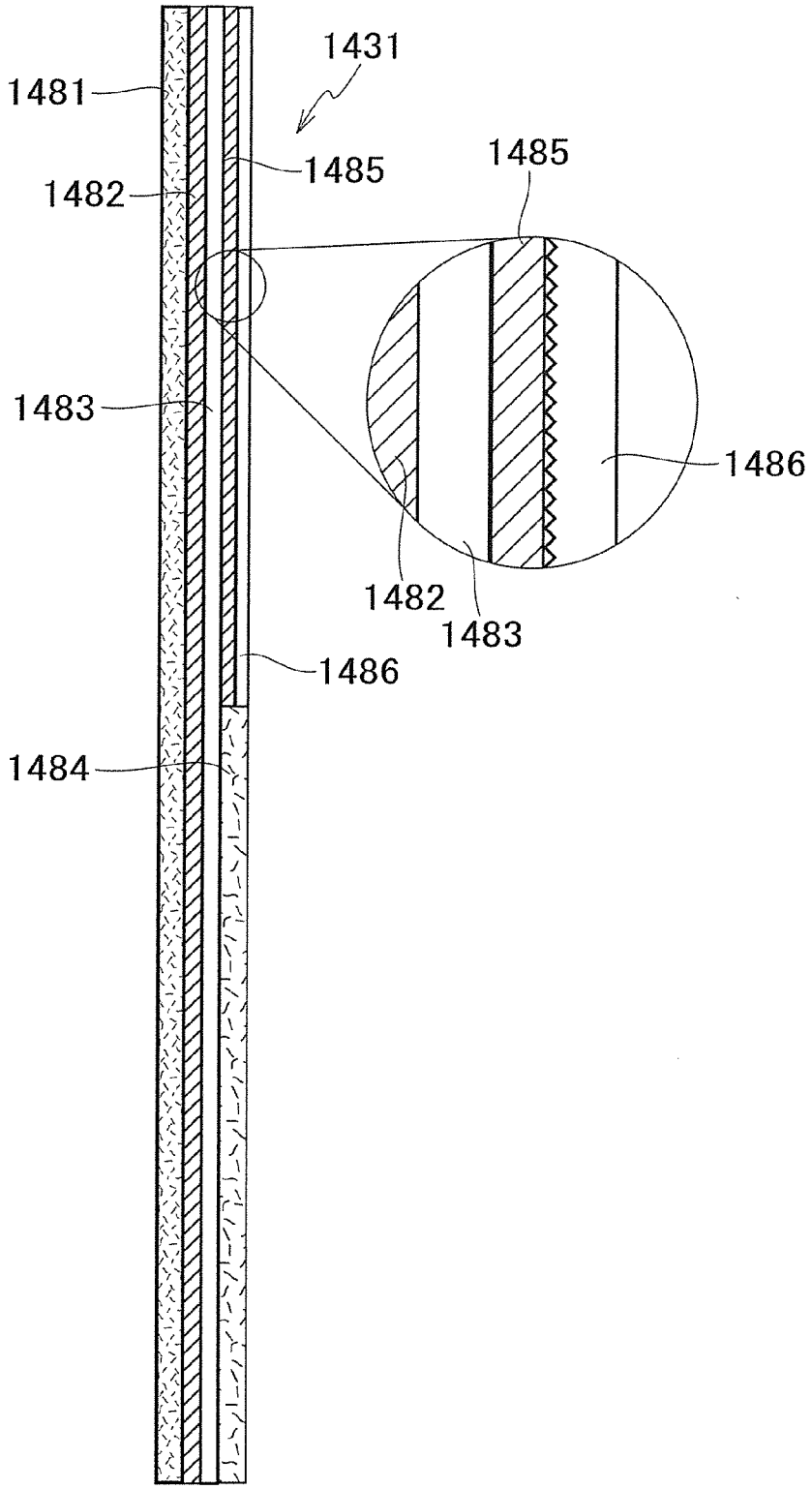
FIG. 28 is a side view of a first diffusion member.

Specifically, as shown in FIG. 25 and FIG. 28, a PET layer 1483 is sized to match each first diffusion member 1431, and a first diffusion layer 1482 is laminated on a front-surface-side region of the PET layer 1483 which region corresponds to a diffusion portion 1440. On the front surface side of the first diffusion layer 1482, a hologram sheet layer 1481 is laminated entirely. A second diffusion layer 1485 is laminated on a back-surface-side region of the PET layer 1483 which region corresponds to the diffusion portion 1440. On the back surface side of the second diffusion layer 1485, a third diffusion layer 1486 is laminated entirely. The third diffusion layer 1486 has a mesh-structured rough surface, and the third diffusion layer 1486 is laminated so that the rough surface is closer to the second diffusion layer 1485 than the other surface. A double-sided sheet 1484 is laminated on back-surface-side regions of the PET layer 1483 which regions correspond to tab portions 1441. The double-sided sheet 1484 is adhered to the third diffusion members 1433.

Figure 29:
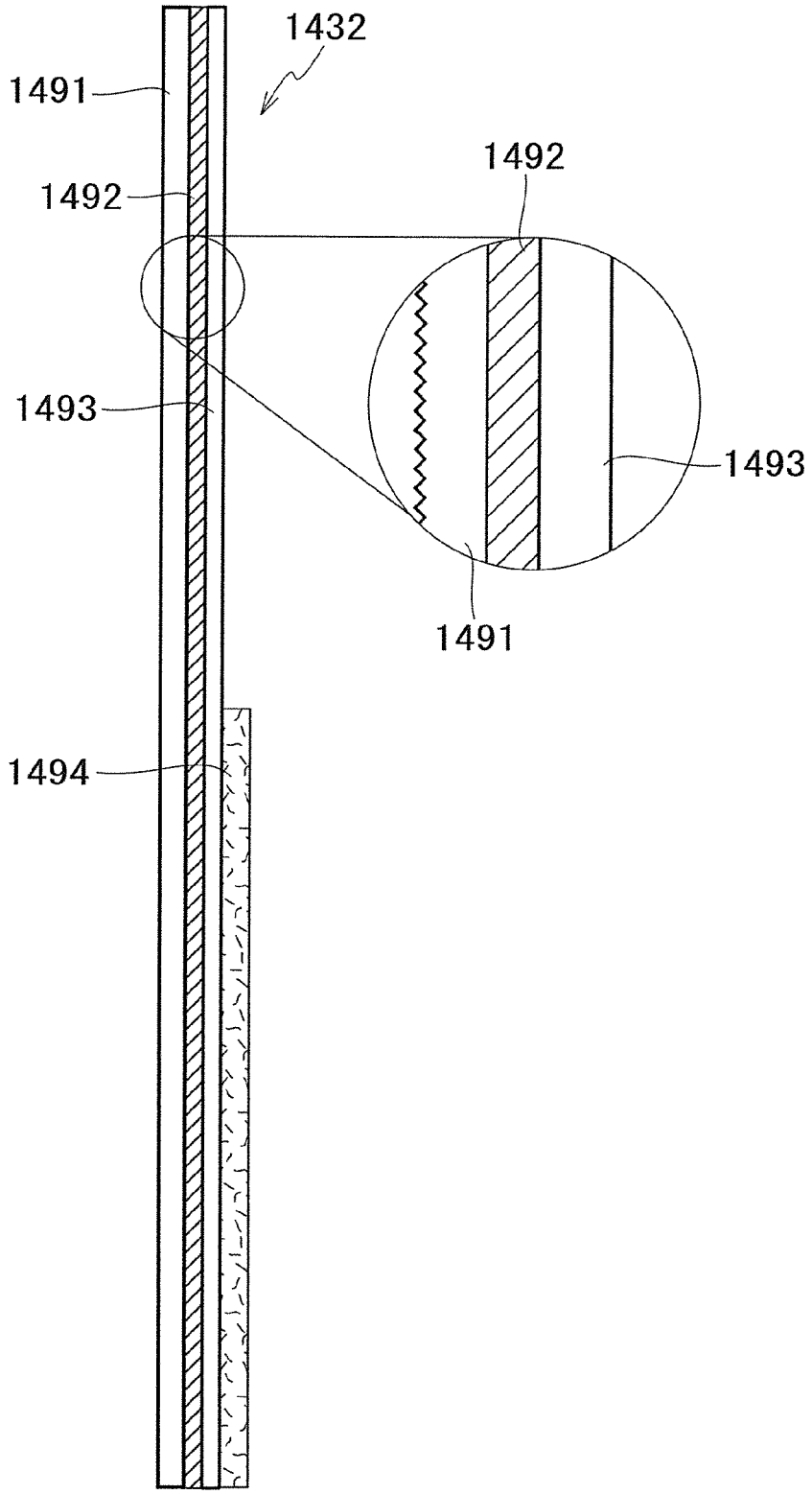
FIG. 29 is a side view of a second diffusion member.

Further, as shown in FIG. 25 and FIG. 29, a PET layer 1493 is sized to match each second diffusion member 1432, and a first diffusion layer 1492 is laminated on a front-surface-side region of the PET layer 1493 which region corresponds to the diffusion portion 1440. On the front surface side of the first diffusion layer 1492, a second diffusion layer 1491 is laminated entirely. The second diffusion layer 1491 has a mesh-structured rough surface, and the second diffusion layer 1491 is laminated so that the rough surface is a front surface. A double-sided sheet 1494 is laminated on back-surface-side regions of the PET layer 1493 which regions correspond to tab portions 1441. The double-sided sheet 1494 is adhered to the third diffusion members 1433.

Figure 30:
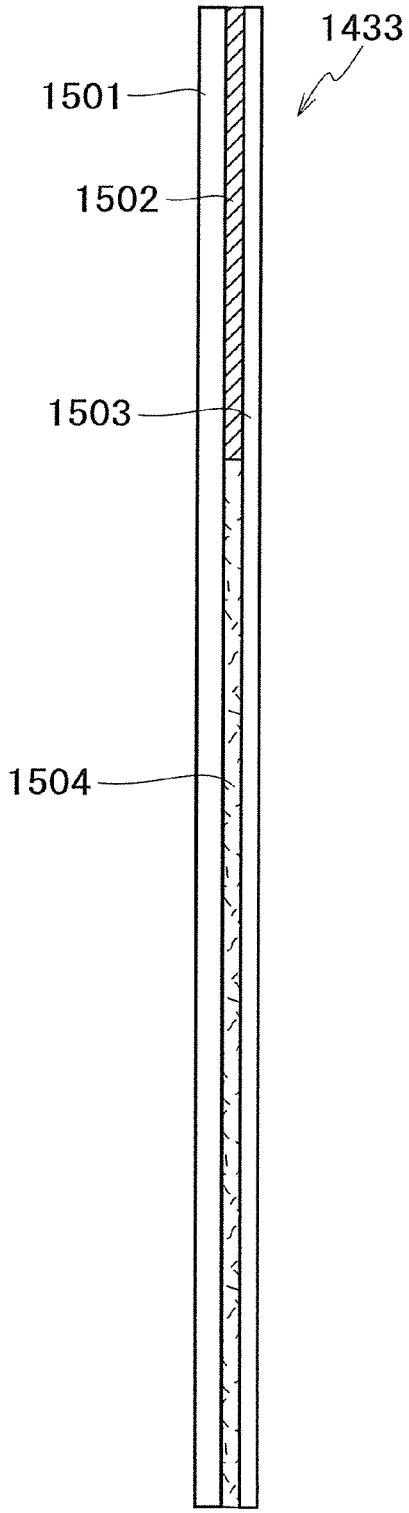
FIG. 30 is a side view of a third diffusion member.

Further, as shown in FIG. 25 and FIG. 30, a PET layer 1503 is sized to match each third diffusion member 1433, and a first diffusion layer 1502 is laminated on a front-surface-side region of the PET layer 1503 which region corresponds to a diffusion portion 1450. On the front surface side of the first diffusion layer 1502, a second diffusion layer 1501 is laminated entirely. Note that the second diffusion layer may be laminated on a half of the region corresponding to the diffusion portion 1450, and a different type of diffusion sheet may be laminated on the other half of the region. Meanwhile, a double-sided sheet 1504 is laminated on front-surface-side regions of the PET layer 1503 which regions correspond to fixed portions 1451. The double-sided sheet 1504 is adhered to the double-sided sheets 1504 of the fixed portions 1451 of the adjacent third diffusion members 1433.

Each first diffusion member 1431 and each second diffusion member 1412 are the same in shape. Specifically, each of the first diffusion members 1431 and the second diffusion members 1432 has the diffusion portion 1440 of a rhombus shape, and the tab portions 1441 which are respectively provided on outer edges adjacent to each other, each of the edges extending from a vertex at a longitudinal end of the diffusion portion 1440. Four first diffusion members 1431 and four second diffusion members 1432 (total number of members is eight) are arranged alternately with each other and radially so that their ends between the tab portions 1441 are located at the center.

Each third diffusion member 1433 has the quadrangular diffusion portion 1450 and the fixed portions 1451. Assuming that a direction of a line connecting two opposing vertices of the quadrangle is a longitudinal direction, the diffusion portion is of a shape as if one of the opposing vertices is stretched in the longitudinal direction. The fixed portions 1451 are respectively provided on outer edges adjacent to each other, each of the edges extending from the stretched vertex. Eight third diffusion members 1433 are disposed, rearward of the first diffusion members 1431 and the second diffusion members 1432, radially so that the their ends between the fixed portions 1451 are located at the center. In this process, the fixed portions 1451 are bent backward, and the third diffusion members 1433 are arranged so that the fixed portions 1451 of the adjacent third diffusion members 1433 are adhered to each other. Thus, the fixed portions 1451 are adhered to one another, and thereby the adjacent diffusion portions 1450 are arranged contiguously with each other. Note that, as shown in FIG. 27, between two fixed portions 1451, a connector 1470 having an L-shape section is sandwiched and screwed. Further, the connectors 1470 are screwed to a metal sheet 1460. Thus, the third diffusion members 1433 are secured to the metal sheet 1460. Further, as shown in FIG. 25, the tab portions 1441 of each first diffusion member 1431 and each second diffusion member 1432 are respectively adhered to the diffusion portions 1450 of the third diffusion members 1433 adjacent thereto. Thus, the first diffusion members 1431 and the second diffusion members 1432 are secured to the third diffusion members 1433.

Figure 31:
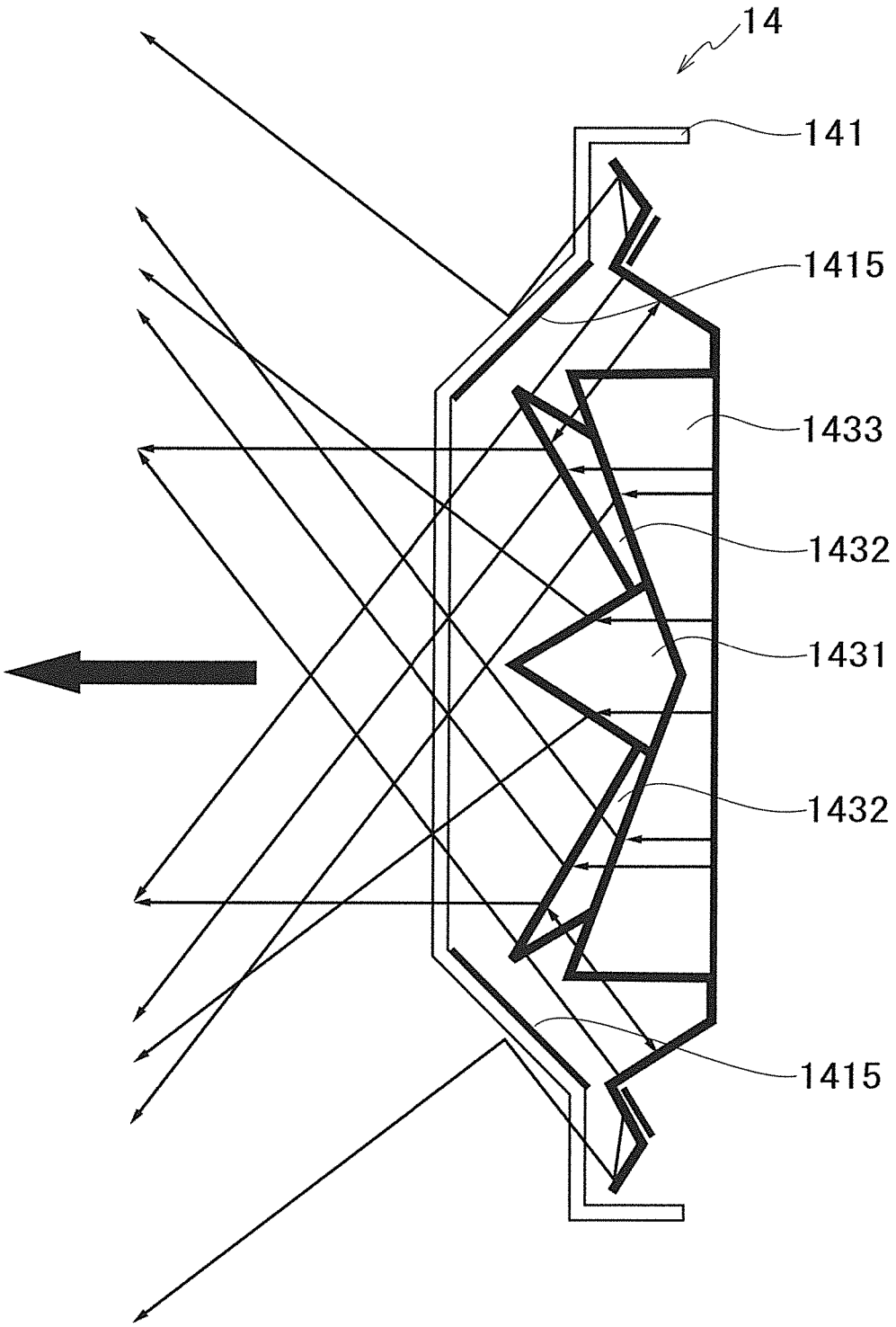
FIG. 31 is an explanatory diagram showing diffusion of light by the topper display device.
Figure 32:
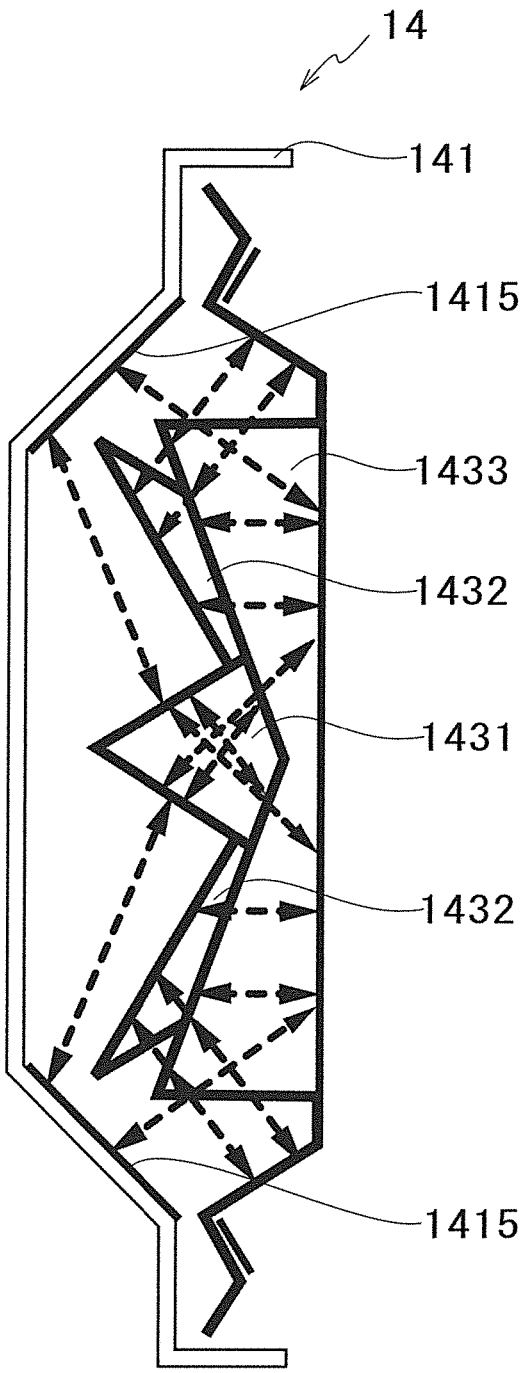
FIG. 32 is an explanatory diagram showing internal reflection of light in the topper display device.

As shown in FIG. 26 and FIG. 27, a plurality of LEDs 1461 are provided on the metal sheet 1460. Therefore, light applied by the plurality of LEDs 1461 goes outside while being refracted in multiple directions when passing through the first diffusion members 1431, the second diffusion members 1432, and the third diffusion members 1433, as shown in FIG. 31. Further, as shown in FIG. 32, light applied by the plurality of LEDs 1461 is irregularly reflected by the first diffusion members 1431, the second diffusion members 1432, and the third diffusion members 1433. This makes a viewer perceive as if there are a larger number of light sources than that of the LEDs 1461, and it is possible to provide an illumination effect enhancing enjoyment.

(Electrical Configuration of Slot Machine)

Figure 33:
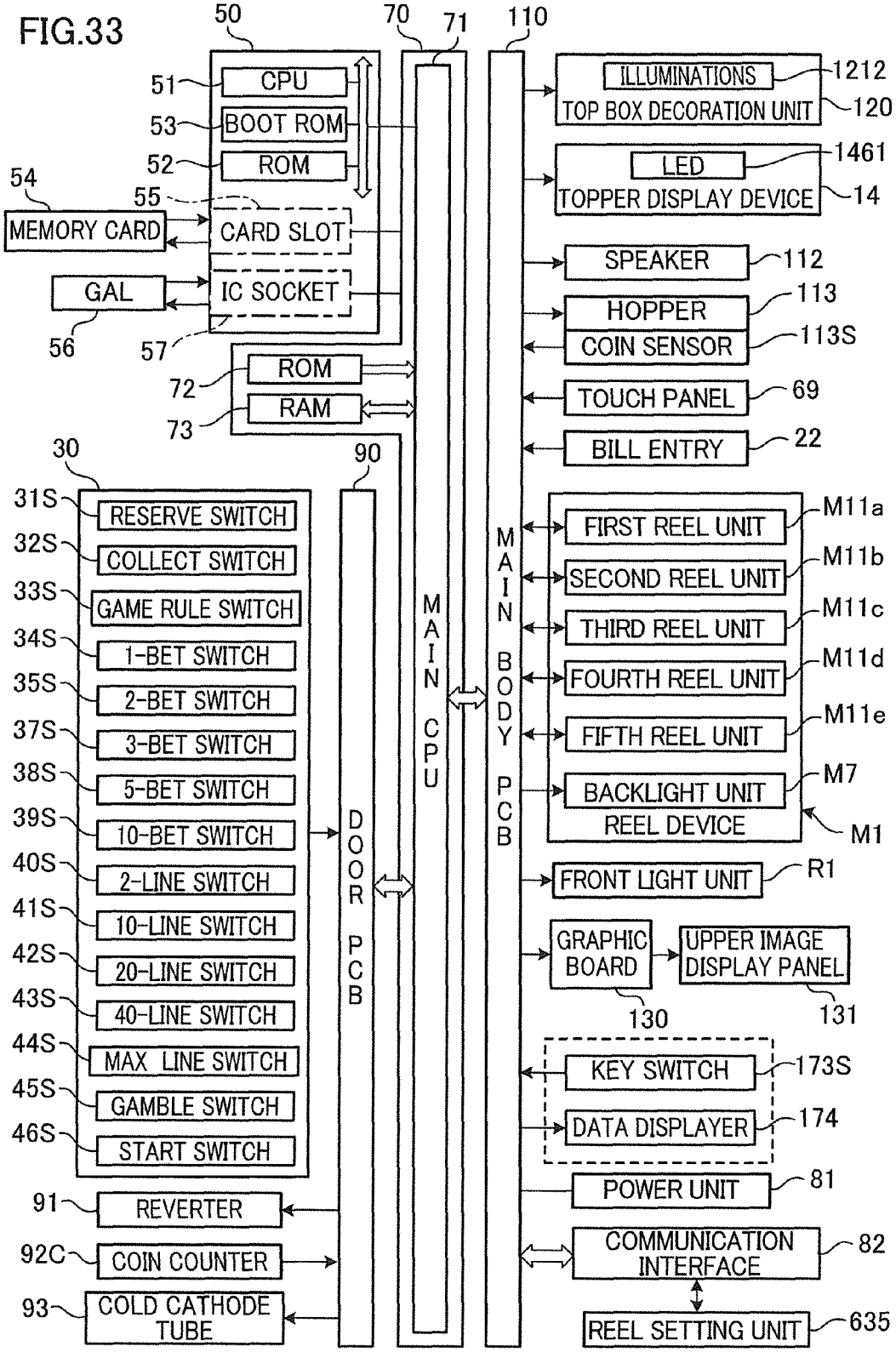
FIG. 33 is an electric block diagram of the slot machine.

Now, referring to FIG. 33, the configuration of a circuit in the slot machine 10 will be described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a game system program. The game program includes a program related to game progression and a program for producing effects by images and sounds. The game program further includes a symbol determination program. The symbol determination program is a program for determining symbols 501 to be rearranged.

The game program further includes sets of data such as: normal game symbol table data indicating a normal game symbol table that shows the relationship of each symbol in each symbol array of the display block, a code number, and a random number; bonus game symbol table data indicating a bonus game symbol table that shows the relationship of each symbol of each symbol array of the display block, a code number, and a random number; symbol number determination table data indicating a symbol column determination table; code number determination table data indicating a code number determination table; wild symbol increase amount determination table data indicating a wild symbol increase amount determination table; trigger symbol increase number determination table data indicating a trigger symbol increase number determination table; odds data indicating the relationship between the types and the number of rearranged symbols on a payline and a payout amount.

Further, the card slot 55 is configured so that the memory card 54 can be inserted thereinto and removed therefrom, and is connected to a motherboard 70 by an IDE bus. The type and contents of the game to be played on the slot machine 10 can be changed by drawing out the memory card 54 from the card slot 53S, writing another game program into the memory card 54, and inserting the memory card 54 into the card slot 53S.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like.

The authentication program is a program (falsification check program) for authenticating the game program and the game system program. The pre-authentication program is a program for authenticating the aforementioned authentication program. The authentication program and the pre-authentication program are written along a procedure (authentication procedure) for proving that the program to be the subject has not been falsified.

The motherboard 70 is constituted by a commercial general-purpose motherboard (printed writing board on which basic components for personal computers are mounted) and is provided with a main CPU 71, a ROM (Read Only Memory) 72, a RAM (Random Access Memory) 73, and a communication interface 82. This motherboard 70 is equivalent to a game controller 100 of the present embodiment.

The ROM 72 includes a memory device such as a flash memory, and stores a program such as BIOS (Basic Input/Output System) to be executed by the main CPU 71, and permanent data. When the BIOS is executed by the main CPU 71, processing for initializing predetermined peripheral devices is conducted. Further, through the gaming board 50, processing of loading the game program and the game system program stored in the memory card 54 is started. In the present invention, the ROM 72 may be or may not be rewritable.

The RAM 73 stores data used for the operation of the main CPU 71 and programs such as the symbol determination program. For example, when the processing of loading the aforementioned game program, game system program or authentication program is conducted, the RAM 73 can store the program. The RAM 73 is provided with working areas used for operations in execution of these programs. Examples of the areas include: an area that stores the number of games, the number of bets, the number of payouts, the number of credits and the like; and an area that stores symbols (code numbers) randomly determined.

The communication interface 82 is for communicating with an external controller 621 such as a server, through the communication line 301. Further, the motherboard 70 is connected with a later-described door PCB (Printed Circuit Board) 90 and a body PCB 110 by respective USBs. The motherboard 70 is also connected with a power supply unit 81. Furthermore, the motherboard 70 is connected with the PTS terminal 700 by an USB.

When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71.

The door PCB 90 is connected with the control panel 30, a reverter 91, a coin counter 92C and a cold cathode tube 93.

The control panel 30 is provided with a reserve switch 31S, a collect switch 32S, a game rule switch 33S, a 1-BET switch 34S, a 2-BET switch 35S, a 3-BET switch 37S, a 5-BET switch 38S, a 10-BET switch 39S, a play-2-lines switch 40S, a play-10-lines switch 41S, a play-20-lines switch 42S, a play-40-lines switch 43S, a MAX LINE switch 44S, a gamble switch 45S, and a start switch 46S, which correspond to the above-described buttons. Each of the switches outputs a signal to the main CPU 71 upon detection of press of the button corresponding thereto by the player. Note that, depending on the type of the game, unnecessary switches and buttons corresponding thereto may be disabled. The number of paylines is fixed to be five in the present embodiment, and therefore the play-2-lines switch 40S, the play-10-lines switch 41S, the play-20-lines switch 42S, the play-40-lines switch 43S, and the MAX LINE switch 44S may be disabled in advance by the game controller 100, for example.

Inside the coin entry 36 are provided the reverter 91 and the coin counter 92C. The reverter 91 validates a coin inserted into the coin entry 36, and discharges coins other than genuine coins through a coin payout exit. The coin counter 92C detects the received genuine coins and counts the number of the coins.

The reverter 91 operates based on a control signal output from the main CPU 71, and distributes valid coins validated by the coin counter 92C into a hopper 113 or a cash box (not shown). That is, coins are distributed into the hopper 113 when the hopper 113 is not filled with coins, while coins are distributed into the cash box when the hopper 113 is filled with coins.

The cold cathode tube 93 functions as a backlight installed on the back side of the upper image display panel 131, and is turned on based on a control signal output from the main CPU 71.

The body PCB 110 is connected with the reel device M1, the front light unit R1, the top box decoration unit 120, the topper display device 14, the speakers 112, the hopper 113, a coin detecting portion 113S, the bill entry 22, a graphic board 130, a key switch 173S, and a data displayer 174.

Each of the front light unit R1, the illuminations 1212 in the top box decoration unit 120, and the LEDs 1461 in the topper display device 14 is turned on based on a control signal output from the main CPU 71. The speakers 112 output BGM sound or the like based on a control signal output from the main CPU 71.

The hopper 113 operates based on a control signal output from the main CPU 71, and pays out coins of the specified number of payouts from the coin payout exit (not-shown) to the coin receiving slot 18. The coin detecting portion 113S outputs a signal to the main CPU 71 upon detection of coins paid out by the hopper 113.

The bill entry 22 authenticates the bills and receives genuine bills into the cabinet 11. The number of bills received by the cabinet 11 is converted to the number of coins, and the credits equivalent to the number of coins are added as the credits owned by the player.

The graphic board 130 controls display of images conducted by the upper image display panel 131, based on a control signal output from the main CPU 71. The graphic board 130 is provided with a VDP (Video Display Processor) generating image data, a video RAM storing the image data generated by the VDP, and the like. It is to be noted that the image data used in generation of image data by the VDP is included in the game program that has been read from the memory card 54 and stored into the RAM 73.

The graphic board 130 is provided with a VDP (Video Display Processor) generating image data, a video RAM temporarily storing the image data generated by the VDP, and the like. It is to be noted that the image data used in generation of image data by the VDP is included in the game program that has been read from the memory card 54 and stored into the RAM 73.

The key switch 173S is provided in the keypad 173, and outputs a predetermined signal to the main CPU 71 when the keypad 173 is operated by the player.

The data displayer 174 displays data read by the card reader 172 and data inputted by the player through the keypad 173, based on a control signal outputted from the main CPU 71.

(Processes of Game Program)

Figure 34:
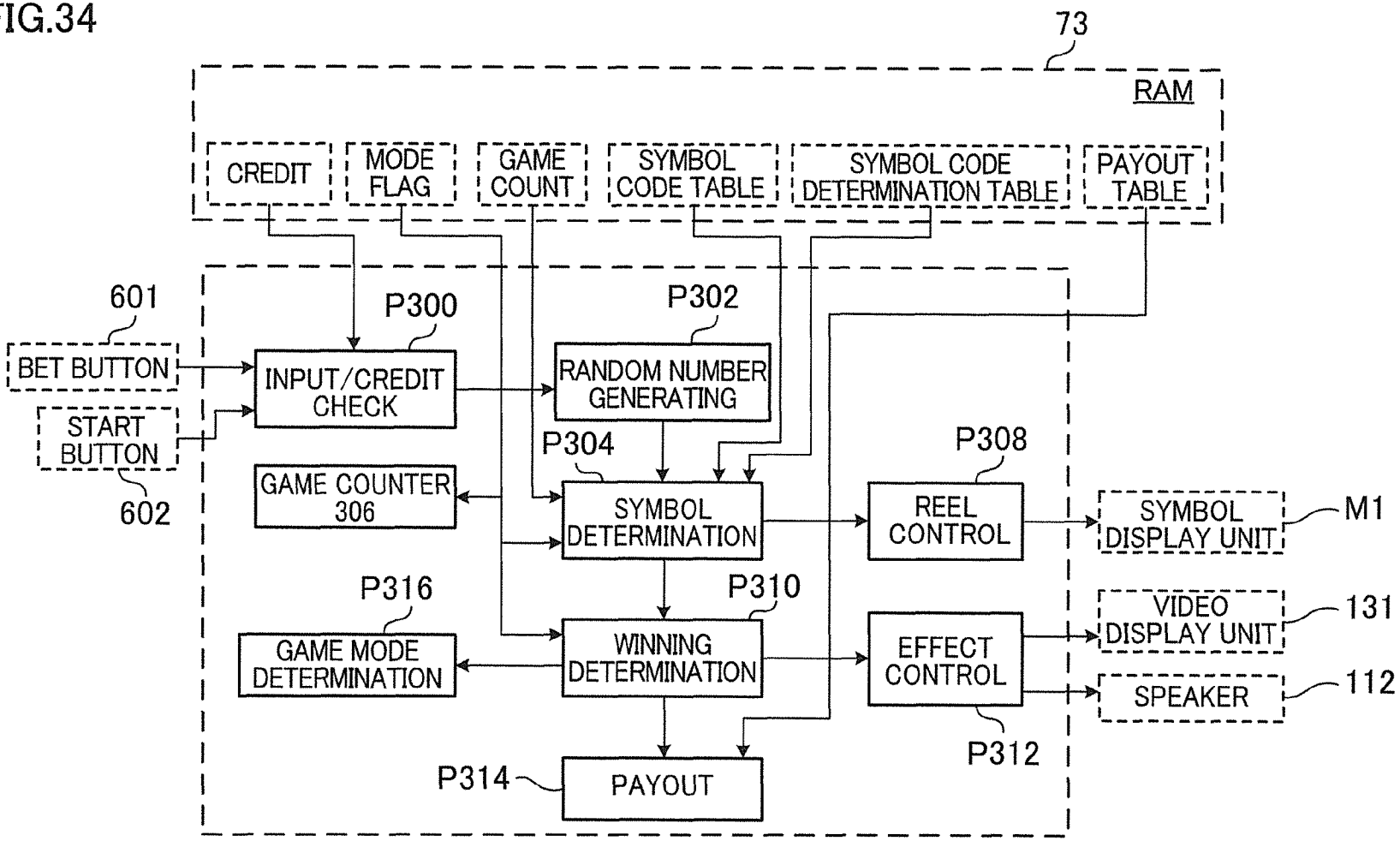
FIG. 34 is a block diagram showing a process of a main game program run by a motherboard.

FIG. 34 is a block diagram showing a process of a game program run by the main CPU 71 of the motherboard 70. When the power is supplied to the slot machine 10, the main CPU 71 loads the authenticated game program and authenticated game system program from the memory card 54 via the gaming board 50 and write them into the RAM 73. Through this, the game program is loaded into the RAM 73 and run.

In a preferable embodiment, the game program includes: an input/bet checking process P300, a random number generating process P302, a symbol determination process P304, a game counter, a reel control process P308, a winning determination process P310, an effect generating control process P312, a payout process P314, and a game mode determination process P316.

(Input/Bet Checking Process P300)

In the input/bet checking process P300, whether a "BET" button or a "START" button is pressed is continuously checked, during the idle state in which the reels M3 of the first to fifth reel units M11*a* to M11*e* are stopped. If the BET button 601 or the spin button 602 (start button) is pressed, whether there is any remaining player credit is checked based on the credit data 320 stored in the RAM 73, in the input/bet checking process P300. If there is at least one player credit, the random number generating process P302 is called from the input/bet checking process P300.

Then, in the random number generating process P302, a random number is generated for use in the symbol determination process P304. In the present embodiment, five random numbers are generated in the random number generating process P302. The five random numbers are used for the reels M3 of the first to fifth reel units M11*a* to M11*e*, respectively.

After all the five random numbers are extracted, symbols to be stopped are determined for each reel M3, referring to the symbol code determination table stored in the RAM 73, in the symbol determination process P304. In the symbol determination process P304, the five random numbers are used to determine five symbols to be stopped for the reels M3 respectively, and the symbols to be stopped are displayed, within the display window 150, on the reels M3 of the first to fifth reel units M11*a* to M11*e* of the reel device M1.

In particular, in the symbol determination process P304, the current game mode is checked by referring to a mode flag 322 stored in the RAM 73. The process of determining the symbols is different between the normal game and the bonus game. In the normal game, the symbols are determined by using random numbers and a constant symbol code determination table, through a constant procedure, in the symbol determination process P304. In the bonus game on the other hand, the symbol determination process is changed by continuously changing the symbol code determination table for each of the unit games, in the symbol determination process P304. Continuously changing the symbol code determination table enables an increase in the probability of a winning combination including at least one specific symbol, as the bonus game repeats. The number of free games in a single session is limited to a predetermined number of times; e.g., ten times. To limit the number of free games, the game counter 306 counts the number of free games already played and/or the number of free games remaining in the session. The value of game count is stored in the RAM 73. The game counter may belong to the symbol determination process P304.

In the reel control process P308, stop position information according to the symbols determined is supplied to control the reel device M1. This way, the reels M3 of the first to fifth reel units M11*a* to M11*e*, after the rotation, stop in positions designated by the stop position information. In other words, the symbols scroll with the rotation of the reels M3. Next, the reels M3 are stopped so that the symbols determined are rearranged in the middle position in the display window 150 of the reel device M1, with respect to the vertical direction.

The winning determination process P310 determines whether or not a predetermined winning combination is formed by the rearranged symbols. When a winning combination is formed by the rearranged symbols, the reel device M1 and another device are controlled in the effect generating control process P312. The other device may be the speakers 112, the lamp, the upper image display panel 131, or the like. Examples of an effect include one by video and audio, and one by a change in the backlight and illumination. Further, in the payout process P314, the amount of payout is determined according to the winning combination, and that amount of payout is awarded to the player.

Further, every time the unit game ends, the game mode of the subsequent unit game is determined in the game mode determination process P316. When the rearranged symbols cause a trigger event, there will be shifting from the normal game mode to the bonus game mode in the game mode determination process P316. On the other hand, when the end condition is satisfied, there will be shifting from the bonus game mode to the normal game mode in the game mode determination process P316. In other occasions, the current game mode is maintained in the game mode determination process P316. The game mode determination process P316 may be executed in the winning determination process P310.

(Symbol, Winning Combination, and Payline)

FIG. 35 is an exemplary symbol code table defining the symbols placed on the outer circumference surfaces of the reels M3 of the first to fifth reel units M11*a* to M11*e*.

On each reel M3, a symbol array is formed by 21 symbols constituted by picture symbols (symbols each having a picture) and blank symbols (blanks) each located between the picture symbols. As described later, the alignments of symbols on the reels M3 are hereinafter referred to as first to fifth symbol arrays. In the present embodiment, each symbol array includes seven types of symbols. The seven types of symbols are: "7", "BAR", "2 BARs", "3 BARs", "Cherry", "Bonus", and "Blank". In each symbol array, codes "00" to "21" are allotted to the symbols, respectively. For example, the first symbol "2 BARs" in the first symbol array is given the code "00". The second symbol "Bonus" in the first symbol array is given the code "01". The eighth symbol "Blank" in the first symbol array is given the code "07".

Three successive symbols out of each symbol array are shown on the display window 150 of the reel device M1. This forms a symbol matrix of 3 rows and 5 columns on the display window 150. Every time the "BET" button or the "START" button is pressed, the reels M3 with symbols start rotating, and the symbols 501 are shown on the display window 150 in such a manner that the symbols 501 scrolls vertically on the display window 150. After a predetermined period has passed, the scroll of symbols 501 is stopped, and the symbols are rearranged to form the symbol matrix on the display window 150.

<"Bonus" Symbol>

Figure 36:
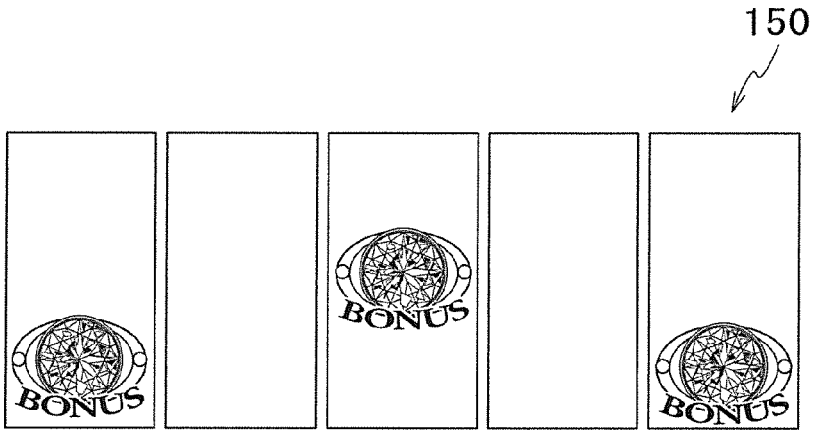
FIG. 36 is a diagram showing a state in which a predetermined number or more of trigger symbols are arranged on a symbol matrix, and showing an example of a trigger condition for shifting to a bonus game.

The "Bonus" symbol included in every reel M3 functions as a trigger symbol that shifts the game mode to the bonus game mode. In the present embodiment, the "Bonus" symbol is formed of an image of a diamond and an image of a text of "BONUS", which are integrated into one symbol. When a predetermined number or more of (three or more in the present embodiment) "Bonus" symbols appear anywhere on the display window 150 as a result of rearrangement of the symbols, as shown in FIG. 36, the bonus game starts in which ten free games are runnable by default. That is, the number of free games is counted down from 10. The counted number of free games is decreased by one every time the free game is run. The "Bonus" symbol functions as a retrigger symbols in the bonus game. Specifically, when a predetermined number or more of (three or more in the present embodiment) "Bonus" symbol appear in the bonus game, a predetermined number (five in the present embodiment) is added to the counted number of free games. Note that the retrigger condition may be the same as the condition for stating the bonus game (trigger condition), or may be different from the trigger condition. When the counted number of the free games reaches 0, the game mode is shifted from the bonus game mode to the normal game mode.

There are a plurality of predetermined combinations of symbols that award a benefit to the player (hereinafter, referred to as a "winning combination"). The benefit to be awarded to the player includes a predetermined amount of payout in the form of an increase in the credit, or paying out coins.

Figure 37:
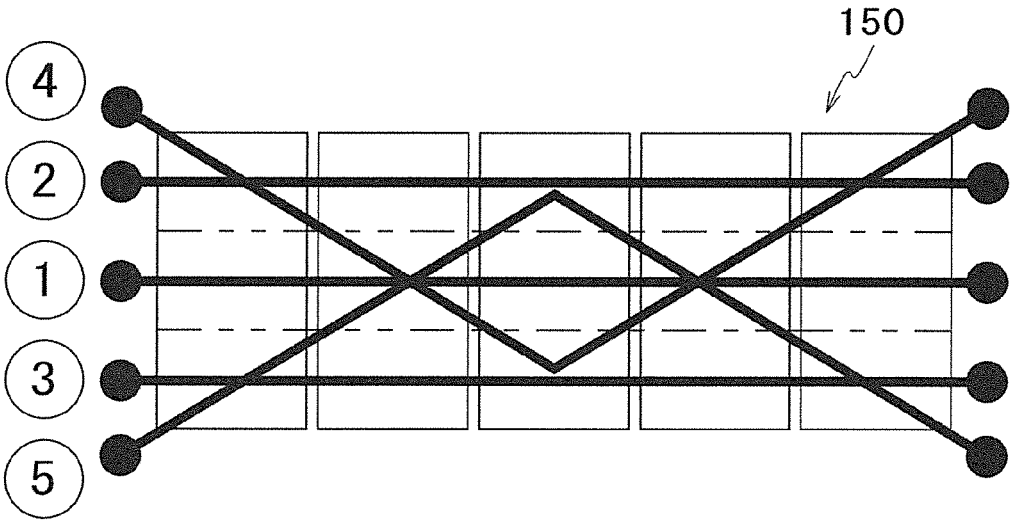
FIG. 37 is a diagram showing paylines in the gaming machine of the first embodiment.

FIG. 37 indicates paylines determined in the preferable embodiment of the present invention. In the present embodiment, there are 5 paylines for the symbol matrix. The first, second, third paylines horizontally extend through the symbol stop positions of the second, first, and third rows of the symbol matrix, respectively. The fourth payline forms a "V" shape, and extends through the symbol stop positions of: the first row, the first column; the second row, the second column; the third row, the third column; the second row, the fourth column; and the first row, the fifth column. The fifth payline forms a counter "V" shape, and extends through the symbol stop positions of: the third row, the first column; the second row, the second column; the first row, the third column; the second row, the fourth column; and the third row, and the fifth column.

Although the five paylines are all activated in the present embodiment, the paylines may be individually activated according to the player's selection. The total number of paylines is modifiable according to the size of the symbol matrix, and an additional payline may be set as needed.

(Symbol Code Determination Table and Payout Table)

Irrespective of the game mode, the symbol combination (e.g., including a combination of symbols to be stopped) is determined based on a plurality of tables stored in the RAM 73 of the motherboard 70. As hereinabove described, the RAM 73 stores at least one of the symbol code determination tables and the symbol determination tables.

FIG. 38 shows a normal game symbol code determination table used in the normal game. Further, FIG. 39 to FIG. 48 show exemplary bonus game symbol code determination tables used in the bonus game. Note that whichever symbol code determination table is used, the default symbol code is "04". That is, in the first unit game of the normal game or in the first free game of the bonus game, the symbols each having the symbol code of "04" are arranged in the middle row (the second row from the top) of the display window 150.

In each of the symbol code determination tables shown in FIG. 38 to FIG. 48, "weights" are assigned to the symbol codes, respectively. Each weight numerically shows the probability that the symbol of the corresponding symbol code is arranged in the middle row of the display window 150. That is, the probability that a symbol is arranged in the middle row is calculated by dividing the weight of the symbol code of the symbol by the total sum of the weights of all the symbol codes.

Each of the symbol code determination tables shown in FIG. 38 to FIG. 48 stores a mapping relation between the random numbers generated through the random number generating process P302 and the symbol codes of the symbols shown in FIG. 36. In other words, every time a random number is generated through a random number generating function 302, a symbol code corresponding to one symbol is determined, by referring to any of the symbol code determination tables shown in FIG. 38 to FIG. 48, in the symbol determination process P304. Increase in the weight of a symbol code increases the probability that the symbol corresponding to the symbol code is arranged.

The normal game symbol code determination table shown in FIG. 38 is used for the symbol determination in the normal game. Further, the bonus game symbol code determination tables shown in FIG. 39 to FIG. 48 are used for the symbol determination in the bonus game. Note that each of the bonus game symbol code determination tables is structured so that the probability of establishment of the winning combination of the symbol "7" is higher than in the case where the normal game symbol code determination table is used.

Now, description will be given for the characteristics of the bonus game symbol code determination tables shown in FIG. 39 to FIG. 48. As shown in FIG. 39, in the first bonus game symbol code determination table, there is a high probability that the winning combination of "7" is established on the fifth payline. Further, as shown in FIG. 40, in the second bonus game symbol code determination table, there is a high probability that the winning combination of "7" is established on the first payline. Further, as shown in FIG. 41, in the third bonus game symbol code determination table, there is a high probability that the winning combination of "7" is established on the second payline. Further, as shown in FIG. 42, in the fourth bonus game symbol code determination table, there is a high probability that the winning combination of "7" is established on the third payline. Further, as shown in FIG. 43, in the fifth bonus game symbol code determination table, there is a high probability that the winning combination of "7" is established on the fourth and fifth paylines. Further, as shown in FIG. 44, in the sixth bonus game symbol code determination table, there is a high probability that the winning combination of "7" is established on the fourth payline. Further, as shown in FIG. 45, in the seventh bonus game symbol code determination table, there is a high probability that the winning combination of "7" is established on the first payline. Further, as shown in FIG. 46, in the eighth bonus game symbol code determination table, there is a high probability that the winning combination of "7" is established on the second payline. Further, as shown in FIG. 47, in the ninth bonus game symbol code determination table, there is a high probability that the winning combination of "7" is established on the third payline. Further, as shown in FIG. 48, in the tenth bonus game symbol code determination table, there is a high probability that the winning combination of "7" is established on the fifth payline.

Furthermore, in the first to sixth bonus game symbol code determination tables, it is more likely that the "Bonus" symbol is rearranged than in the seventh to tenth bonus game symbol code determination tables, that is, it is more likely that the retrigger condition is satisfied.

Every time a unit game is run, it is determined whether a winning combination is established on each payline in the winning determination process P310 which is included in the game program and executed by the main CPU 71. FIG. 49 is a payout table showing a relationship between the winning combination and the payout amount. The payout table shows the payout amounts for the respective number of the symbols rearranged on a payline, to be awarded for 30 BET, which is the minimum bet. For example, when three "7" symbols are rearranged on a payline, the payout amount is 100. When four "7" symbols are rearranged on a payline, the payout amount is 200. Note that in the winning combination of "MIX BAR", all of the "BAR", "2 BARs", and "3 BARs" symbols are counted when rearranged ("MIXED determination"). Further, for the symbols of "Cherry" and "Bonus", a winning determination is made in a scattered manner. That is, as for the symbols of "Cherry" and "Bonus", when a predetermined number or more of (three or more) symbols are rearranged on the display window 150, a payout is awarded regardless of the paylines. Further, the determination of the winning combinations of "7", "3 BARs", "2 BARs", "BAR", and "MIX BAR" is made according to a so-called "Left to Right" rule. Specifically, in addition to the condition that the predetermined number or more of the same symbols forming a winning combination are rearranged on a payline, one of these symbols has to be rearranged in the first column. Further, assuming that the predetermined number is N, the symbols forming the winning combination have to be rearranged on the portion of the payline located in the first column to the Nth column.

The player may select a multiplier for a bet unit number from five multipliers chosen from the multipliers of 1, 2, 3, 4, 5, 10, 15, and 20. Abet amount is calculated by multiplying 30 by the selected multiplier. For example, the multipliers from which the selection is possible may be "1, 2, 3, 5, and 10" by default. Alternatively, the multipliers for the bet unit number from which the selection is possible may be changeable to any of the following combinations: "1, 2, 3, 4, and 5", "1, 2, 5, 10, and 15", or "1, 2, 5, 10, and 20". Thus, the maximum bet amount selectable by the player is 600. Further, a payout amount is calculated by multiplying the number shown in the payout table by the multiplier for the bet unit number selected by the player (bet multiplier). Note that the bet multiplier in a free game is determined based on the bet unit number at the start of the bonus game.

When a winning combination defined in the payout table is included in one of the paylines, the winning combination is detected and the amount of payout is checked, referring to the payout table, in the winning determination process P310. The amount of payout determined is paid out in the payout process P314. When no winning combination is formed by the symbols appearing on the paylines, the result is determined as to be so-called "lost".

For example, when three "7" symbols appear on symbol arrays and along any one of the paylines LINE1 to LINE5 while satisfying the condition of "Left to Right", it is determined that a winning combination of three "7" symbols is formed and 100 times the bet amount is awarded as the payout. The benefit in the form of payout is awarded to the player by actually paying out coins to the coin receiving slot 18 or adding the credits corresponding to the payout.

When the game mode shifts to the bonus game mode, in a counter process P306 shown in FIG. 34, a counter is set to count the number of free games having been already run in the bonus game, or the number of free games yet to be run in the bonus game. Then, a random number is generated in the random number generating process P302, and the symbols to be stopped are determined using the random number generated and with reference to the symbol code determination tables as shown in FIG. 38 to FIG. 48, in the symbol determination process P304. In the symbol determination process P304, which of the first to tenth bonus game symbol code determination tables is used is randomly determined, using a symbol determination table random determination table shown in FIG. 50.

The symbol determination table random determination table has two allocation groups A and B, and between the two groups, weights for the symbol determination tables are different. Which of the allocation groups A and B is used is determined based on whether a retrigger condition has already been satisfied in the bonus game or not. Specifically, when the retrigger condition has not been satisfied in the free game(s) having been already run, the group A is used in the next free game. When the retrigger condition has been satisfied in the free game(s) having been already run, the group B is used in the next free game. Therefore, when the retrigger condition has not been satisfied, the selection is made from the first to sixth bonus game symbol code determination tables with which the retrigger condition is more likely to be satisfied. Further, when the retrigger condition has occurred at least once, there is a high probability that one of the seventh to tenth bonus game symbol code determination tables is selected with which the retrigger condition is less likely to be satisfied. Note that, in the symbol determination process P304, the group A is always used in the first free game of the bonus game.

For example, in the case where the retrigger condition is satisfied in the first free game of the bonus game for which the group A is used, the group B is always used in the second and subsequent free games. Further, for example, in the case where the retrigger condition is satisfied, for the first time, in the tenth free game of the bonus game, the group A is used in all of the first to tenth games, and the group B is always used in the eleventh and the subsequent games.

(VFD)

Figure 51:
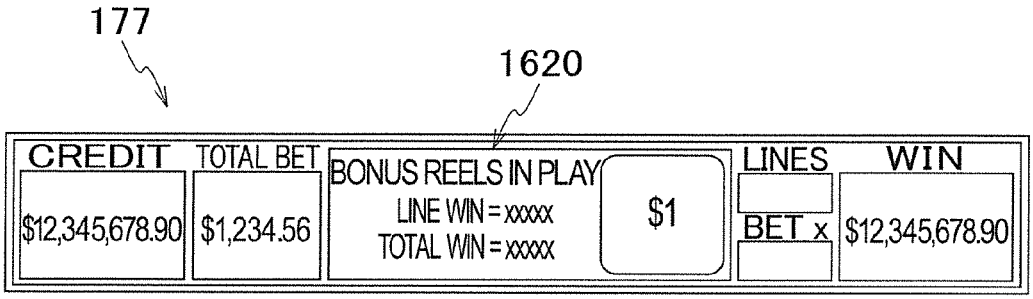
FIG. 51 is a diagram showing an example of image display on a VFD of the gaming machine.

FIG. 51 shows an example of image display on the VFD 177. At a central portion of the VFD 177, there is a game status region 1620 in which the status of the game and/or various messages are displayed. In the game status region 1620, there are displayed a bonus state, winning details, obtained credits, and the like. Further, there are displayed a credit meter (in a money font (a nine-digit font)), a total bet amount, a denomination (in a large font), a line meter (in a two-digit font), a bet meter (in a three-digit font), a win meter (in the money font (the nine-digit font)), a total bet meter (in the money font (a four-digit font)), and the like. For example, in the game status region 1620, the followings are displayed. Specifically, when a payout is obtained in the bonus game, there is displayed "BONUS REELS IN PLAY/LINE 10 WIN=100". Further, during the spin in a free game, there is displayed "BONUS REELS IN PLAY/Remaining x games". Furthermore, a message related to the system is in the game status region 1620. For example, when cash is inserted, there is displayed "CASH IN $100.00". When the hopper is out, there is displayed "HOPPER OUT 12/200". When a ticket is discharged, there is displayed "PLEASE TAKE A TICKET OR RECEIPT".

Further, in the case of a hand pay, there is displayed "CALL ATTENDANT PAY $200.00". Further, in the case of a "tilt", there is displayed "CALL ATTENDANT MAIN DOOR OPEN (MECHANICAL SWITCH)". Further, in the case of general "tilts", there is displayed "CALL ATTENDANT/LOOK UP".

(Display State of Upper Image Display Panel)

Figure 52:
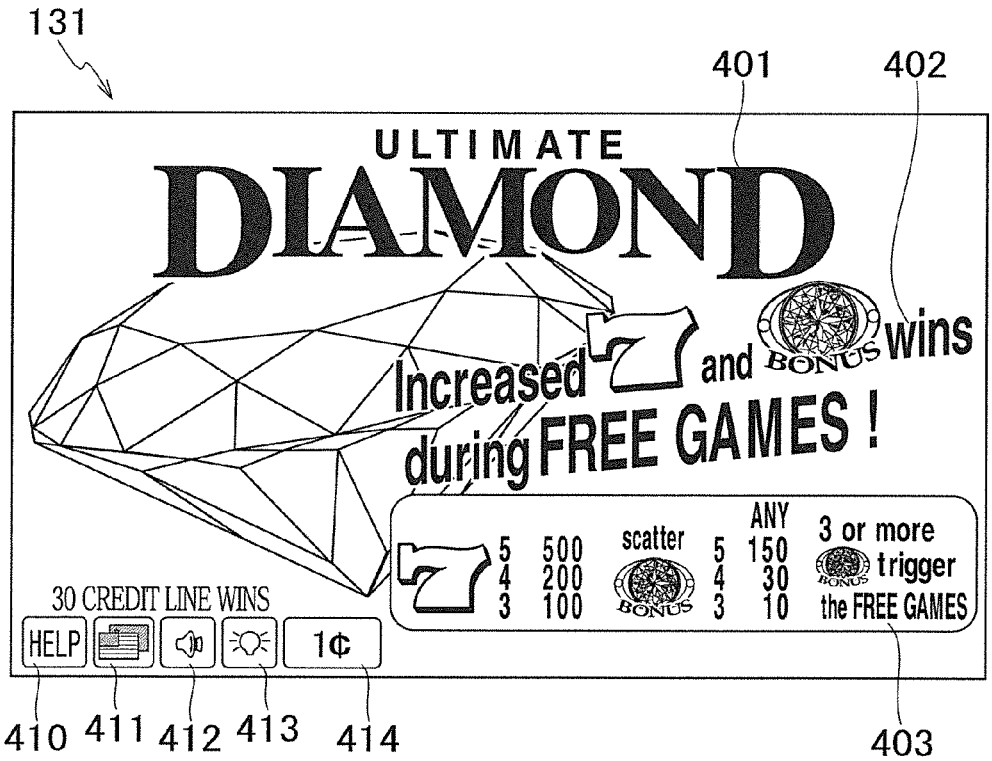
FIG. 52 is a diagram showing an example of image display on an upper image display panel.

The following describes the display state of the upper image display panel 131. In the normal game, a game title 401 is displayed on an upper portion, as shown in FIG. 52. Right below the game title 401, there is displayed a game characteristic image 402 formed by text images and symbol images indicating the characteristics and the like of the bonus game. Below the game characteristic mage 402, there is displayed a payout image 403 which describes at least a part of the payout table.

Further, on a lower left portion of the upper image display panel 131, there are located a help touch button 410, a language change touch button 411, a volume change touch button 412, a brightness adjustment button 413, and a denomination button 414. These buttons 410, 411, 412, 413, and 414 are arranged in order from the left end to the right when viewed from the position of the player. Further, these buttons are displayed also in the bonus game.

When the help touch button 410 is touched, a help screen is displayed. The help touch button 410 is turned dark while it is inactive, for example, during the rotation of the reels. When the language change touch button 411 is touched, the language is changed from English to Chinese or from Chinese to English. The volume change touch button 412 is used to change the volume of the game. There are three levels of the volume, and the levels of the volume is changed in the following manner of: low-medium-high-low-medium . . . , each time the button 412 is touched. The brightness adjustment button (brightness button) 413 is used to change the light amount of the LEDs. There are three levels, and the levels are changed in the following manner: level 3 (highest light amount: 100%)—level 2 (intermediate light amount: 70%)—level 1 (lowest light amount: 30%)—level 3 . . . , each time the button 413 is pressed. The denomination button 414 displays thereon the current denomination set by AUDIT.

Figure 53:
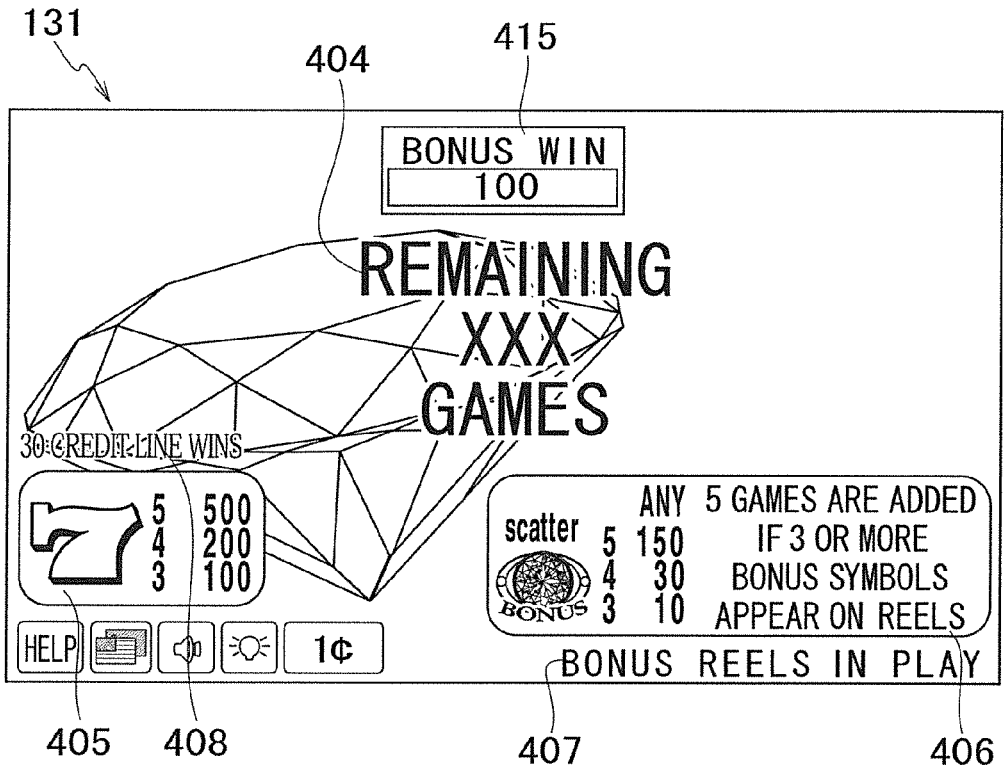
FIG. 53 is a diagram showing an example of image display on the upper image display panel.

During the bonus game, a bonus win meter 415 is displayed on the upper portion of the upper image display panel 131, as shown in FIG. 53. At the center of the screen of the upper image display panel 131, there is displayed a free game count 404 indicating the counted number of the free games. Specifically, the free game count 404 indicates the number of remaining free games runnable by the player. Left below the free game count 404, there is displayed a 7 symbol payout description image 405 having description of the payout brought by the symbols of "7". Further, right below the free game count 404, there is displayed a bonus payout description image 406 having description of a retrigger event and description of the payout brought by the "Bonus" symbols which cause the retrigger event. Further, below the bonus payout description image 406, there is displayed a text image 407 having a text of "BONUS REELS IN PLAY", which tells that the game mode is the bonus game mode. Further, above the 7 symbol payout description image 405, there is displayed a total bet indicating image 408 indicating the current bet amount.

Figure 54:
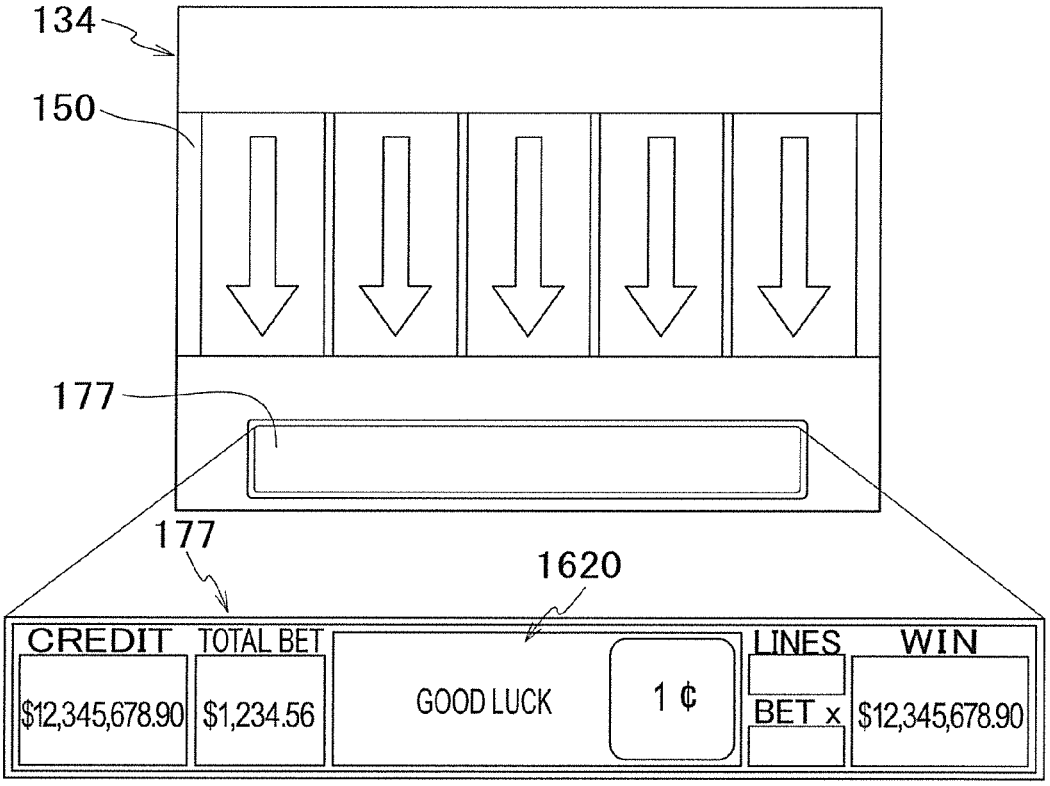
FIG. 54 is a diagram showing an example of image display on a display window and on the VFD.

The following specifically describes the display state of the upper image display panel 131 in the process of shifting from the normal game to the bonus game to start the bonus game. First, in the normal game, the upper image display panel 131 displays the screen as shown in FIG. 52. Note that, while the reels M3 in the display window 150 behind the reel cover 134 are moved in the normal game, a text of "GOOD LUCK" is displayed in the game status region 1620 of the VFD 177 as shown in FIG. 54.

Figure 55:
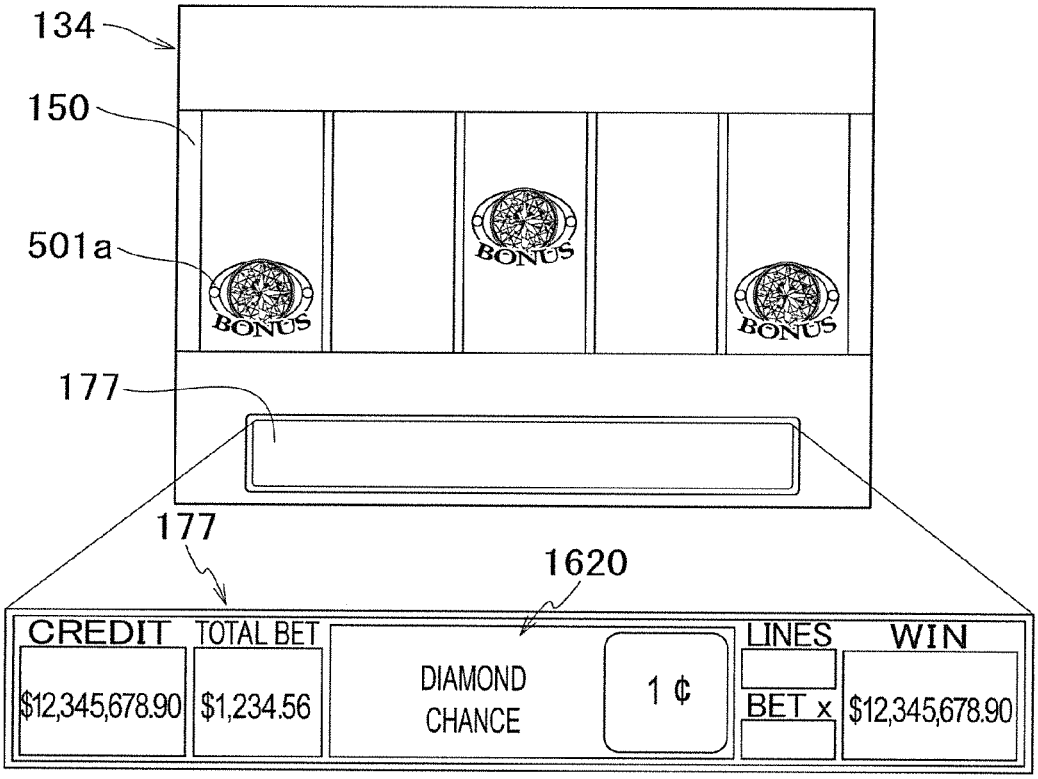
FIG. 55 is a diagram showing an example of image display on the display window and on the VFD.
Figure 56:
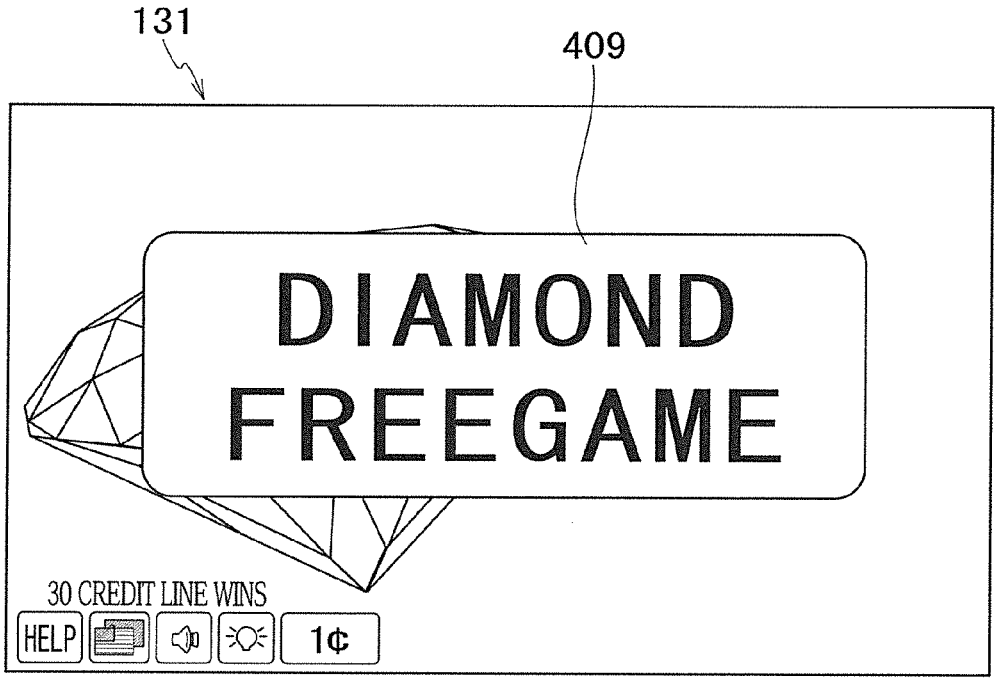
FIG. 56 is a diagram showing an example of image display on the upper image display panel.
Figure 57:
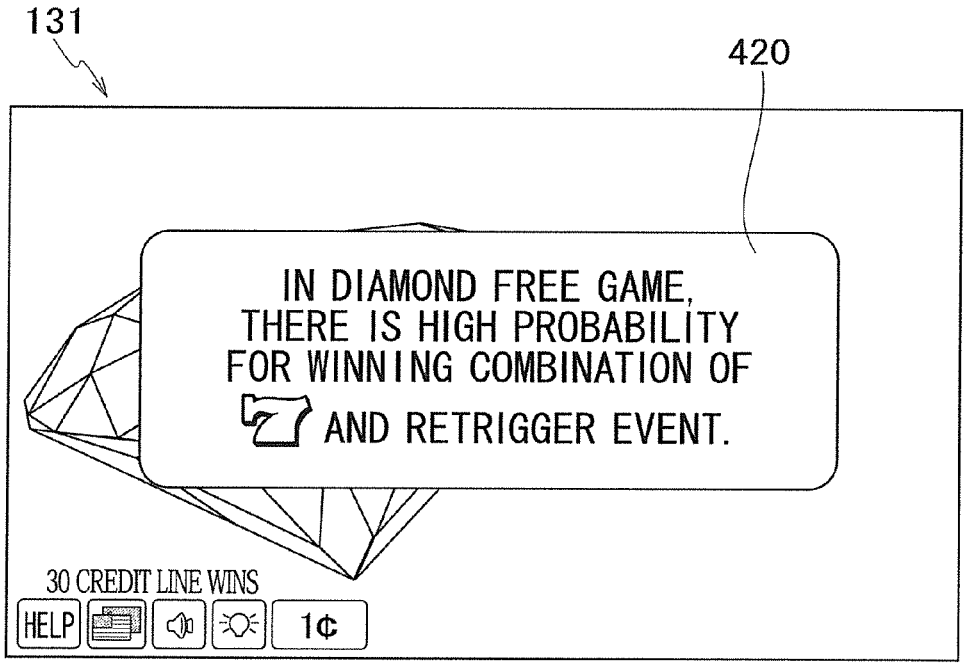
FIG. 57 is a diagram showing an example of image display on the upper image display panel.

In the case where three or more "Bonus" symbols are not stopped on the display window 150 when the reels M3 are stopped, the normal game mode is maintained, and the display state shown in FIG. 52 is maintained on the upper image display panel 131. Meanwhile, when three or more "Bonus" symbols 501*a* are stopped on the display window 150 as shown in FIG. 55, the game mode shifts to the bonus game mode. Note that in the game status region 1620 of the VFD 177, there is displayed a text of "DIAMOND CHANCE". As shown in FIG. 56, when this event occurs, a bonus game shift notification image 409 which indicates shifting to the bonus game mode is displayed at the center of the upper image display panel 131. After the bonus game shift notification image 409 is displayed on the upper image display panel 131, there is displayed a bonus game details notification image 420 which is a text image describing the characteristics of the bonus game, as shown in FIG. 57. Specifically, the bonus game details notification image 420 indicates that "there is a higher probability of winning of the "7" symbols and/or of occurrence of a retrigger event by the "Bonus" symbols in the bonus game", for example. At this time, the message shown by the bonus game details notification image 420 may be output as audio from the speakers 112.

Figure 58:
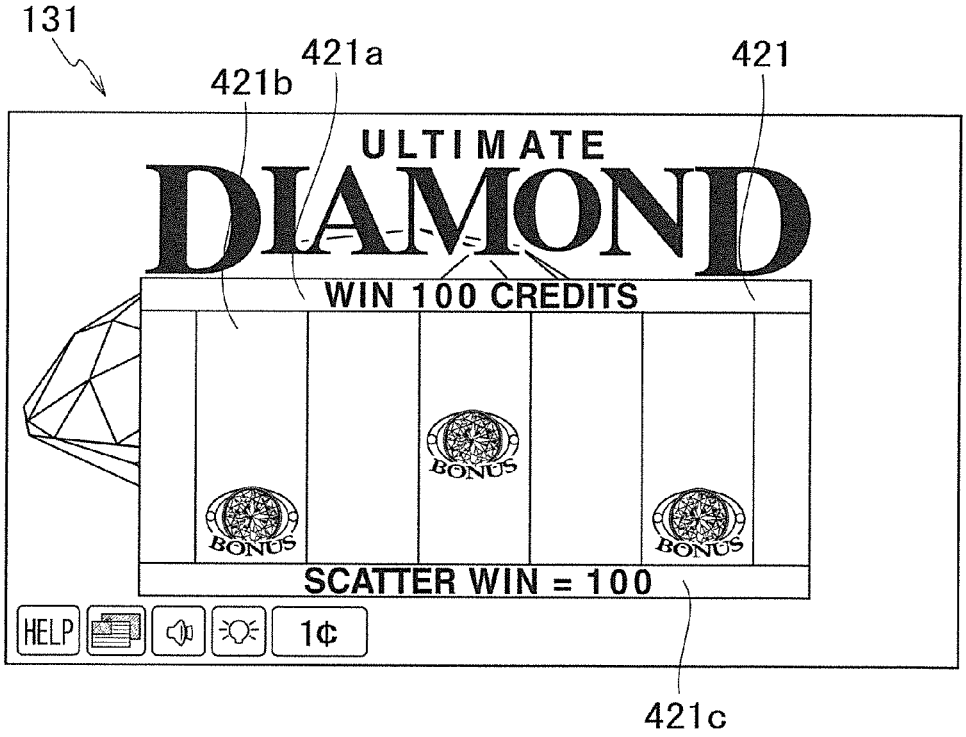
FIG. 58 is a diagram showing an example of image display on the upper image display panel.

Then, as shown in FIG. 58, a winning indicating image 421 is displayed at the center of the upper image display panel 131, to report the details of the payout brought by the "Bonus" symbols. To be more specific, the winning indicating image 421 includes a total payout indicating image 421*a*, a winning combination indicating image 421*b*, and a winning type indication image 421*c*. The total payout indicating image 421*a* indicates the total payout amount obtained as a result of the game. To indicate the credits (a numerical value) in the total payout indicating image 421*a*, there are images in a four-digit font, a seven-digit font, and a eleven-digit font. The winning combination indicating image 421*b* indicates the winning combination which brought the payout, using the images of the symbols. The winning type indication image 421*c* indicates the winning type (a scattered winning combination ("SCATTER WIN") or a payline winning combination ("LINE WIN")), with a payout amount awarded by that winning combination. To indicate the payout amount in the winning type indication image 421*c*, there are images in a four-digit font and a seven-digit font used for indicating a result of a payline winning combination, and images in a five-digit font used for indicating a result of a scattered winning combination. The payout amount in the winning type indication image 421*c* is displayed incrementally (incremental display). Note that when both winning types are achieved simultaneously, the both of them are displayed. They may be alternately displayed each for a predetermined period of time, or may be displayed at the same time.

Figure 59:
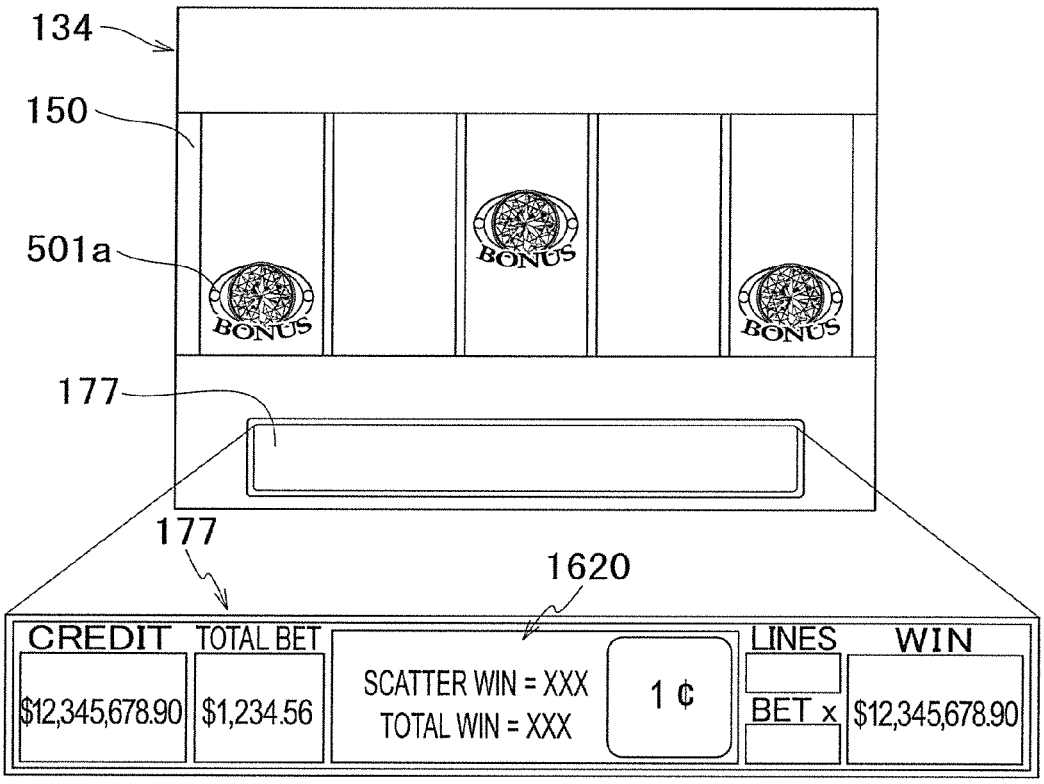
FIG. 59 is a diagram showing an example of image display on the display window and on the VFD.
Figure 60:
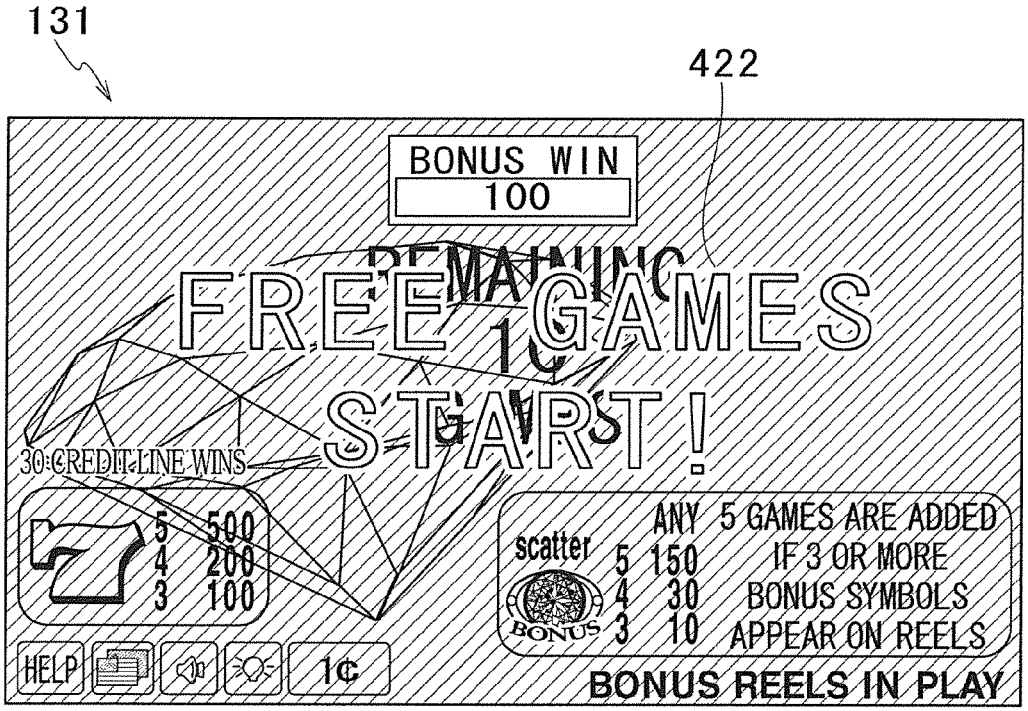
FIG. 60 is a diagram showing an example of image display on the upper image display panel.

When the winning indicating image 421 is displayed on the upper image display panel 131, the VFD 177 also displays similar contents as shown in FIG. 59. Specifically, in the game status region 1620 of the VFD 177, "SCATTER WIN=XXX" (XXX is a six-digit number) and "TOTAL WIN=XXX" (XXX is a eleven-digit number) are displayed in two lines, respectively. Note that, for a payline winning combination, there is displayed "LINE WIN=XXX" (XXX is a seven-digit number). Further, when a plurality of winnings occur in a single game, the indications for the winnings are given one after another, each for a predetermined period time, and "TOTAL WIN=XXX" is displayed simultaneously with the indication for the last winning. For example, if there are one scattered winning combination and two payline winning combinations, "SCATTER WIN=40", "LINE 22 WIN=80", and "LINE 12 WIN=80/TOTAL WIN=200" are displayed one after another in the game status region 1620 of the VFD 177.

Then, on the upper image display panel 131, there is displayed a bonus game start notification image 422 indicating that the bonus game is going to be started. Specifically, the bonus game start notification image 422 has a text image of "FREE GAMES START!". At this time, the images on the upper image display panel 131 other than the bonus game start notification image 422 are displayed in gray, and the bonus game start notification image 422 is highlighted.

Figure 61:
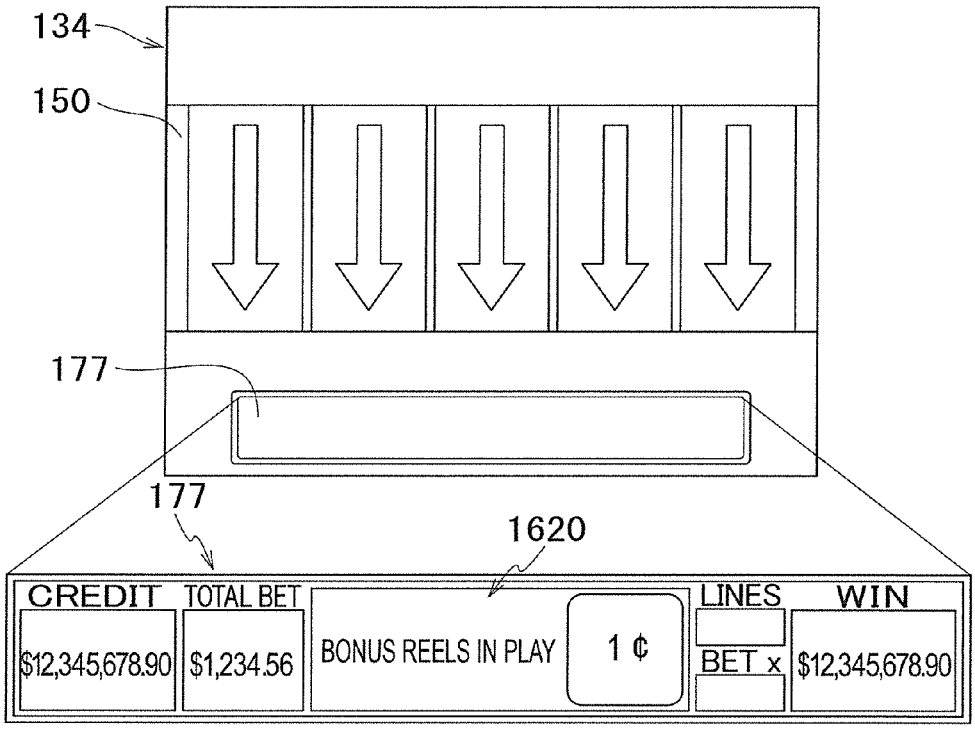
FIG. 61 is a diagram showing an example of image display on the display window and on the VFD.

In the bonus game, the upper image display panel 131 displays the screen shown in FIG. 53 while the reels M3 in the display window 150 behind the reel cover 134 are moved. Meanwhile, in the game status region 1620 of the VFD 177, there is displayed a text of "BONUS REELS IN PLAY", as shown in FIG. 61.

Figure 62:
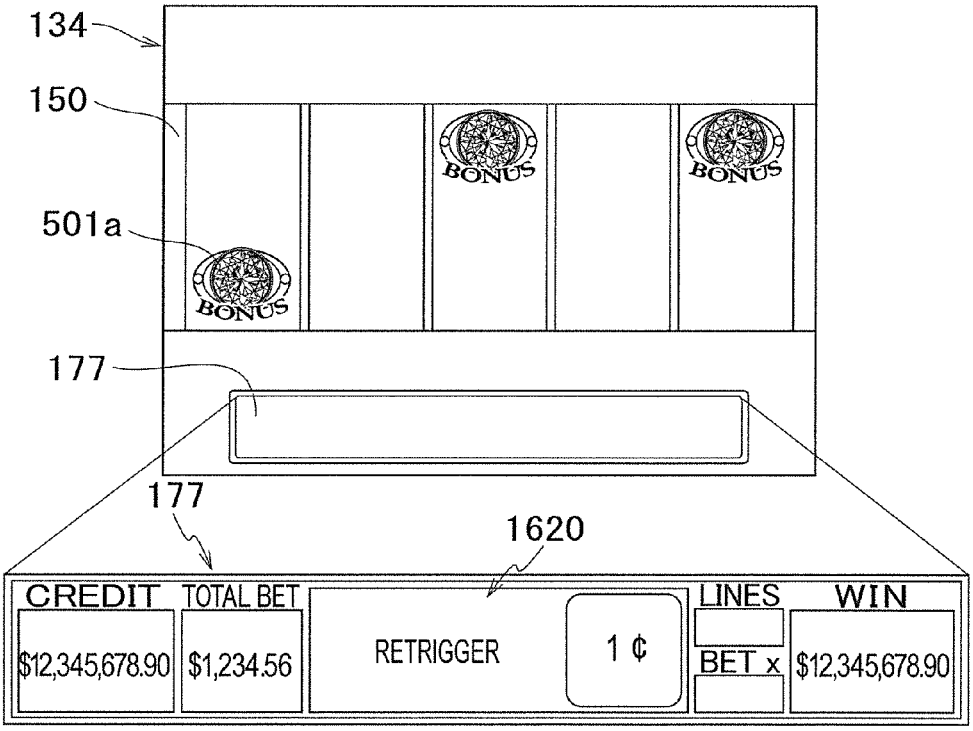
FIG. 62 is a diagram showing an example of image display on the display window and on the VFD.
Figure 63:
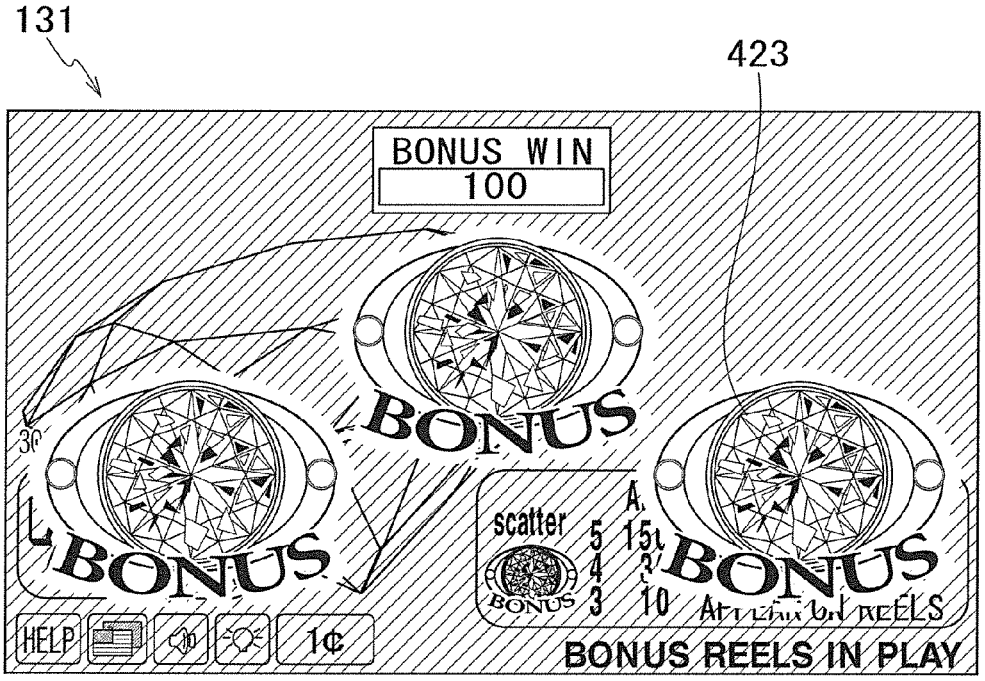
FIG. 63 is a diagram showing an example of image display on the upper image display panel.
Figure 64:
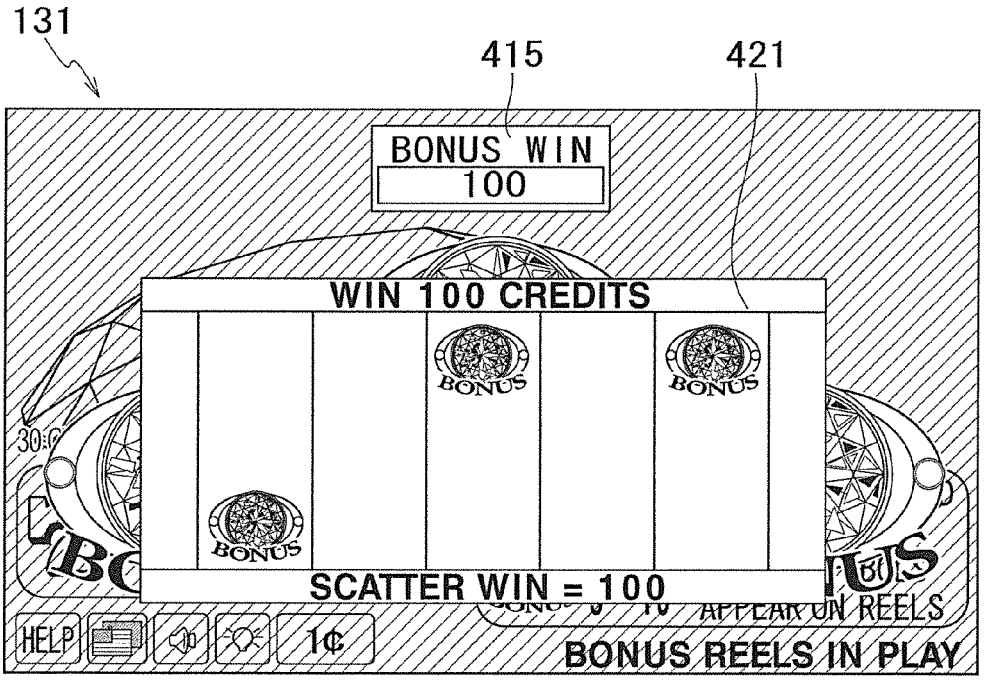
FIG. 64 is a diagram showing an example of image display on the upper image display panel.

As shown in FIG. 62, when a winning combination formed by three or more (three or more of a kind of) "Bonus" symbols 501*a* is achieved on the display window 150 in the bonus game, a text of "RETRIGGER" is displayed in the game status region 1620 of the VFD 177. At this time, on the upper image display panel 131, there are displayed bonus symbol images 423 whose number is equal to the number of the "Bonus" symbols 501*a* displayed on the display window 150, as shown in FIG. 63. Note that the effect of displaying the bonus symbol images 423 is greater and longer than an effect provided at the time of winning formed by the "7" symbols, which will be described later. Then, as shown in FIG. 64, the winning indicating image 421 is displayed, and the payout amount is incrementally displayed in the winning indicating image 421. Simultaneously with the incremental display in the winning indicating image 421, the incremental display of the payout amount is performed in the bonus win meter 415 and in the win meter of the VFD 177.

Figure 65:
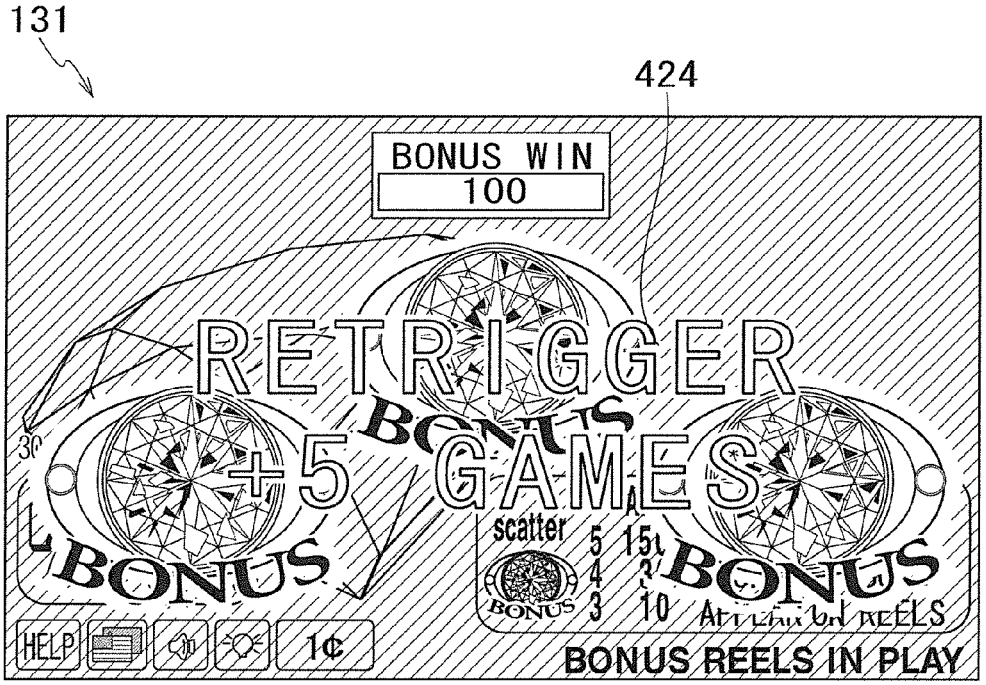
FIG. 65 is a diagram showing an example of image display on the upper image display panel.
Figure 66:
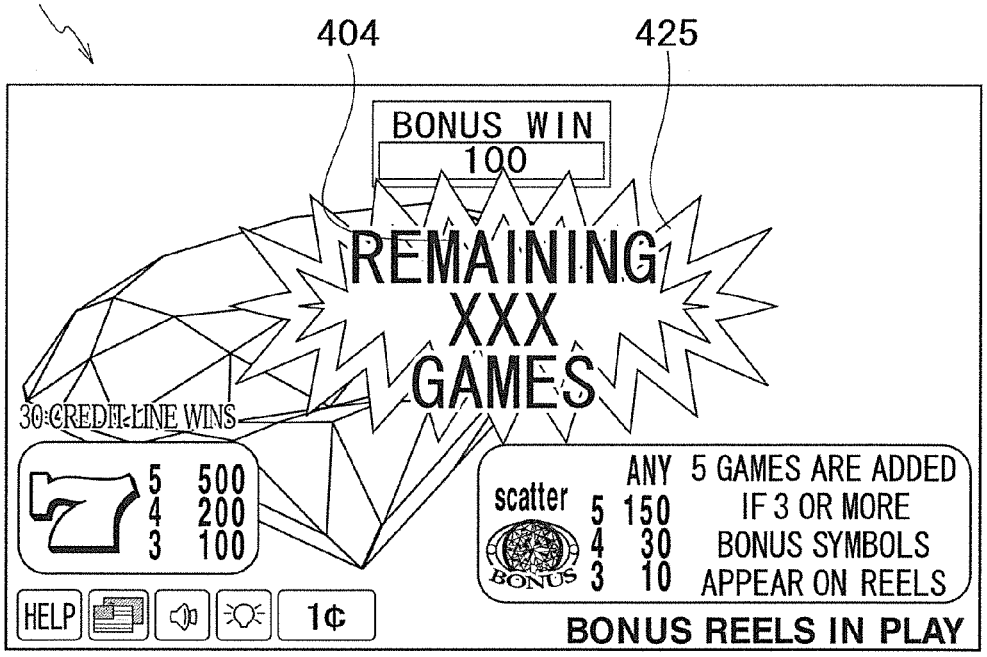
FIG. 66 is a diagram showing an example of image display on the upper image display panel.

Then, as shown in FIG. 65, a counted number addition notification image 424 is displayed on the upper image display panel 131. The counted number addition notification image 424 indicates that 5 is added the counted number (five free games are added). Then, after the number indicated by the free game count 404 is incrementally displayed, an explosion image 425 is displayed behind the free game count 404, as shown in FIG. 66. Thereafter, the display returns back to that of the free game, to start displaying of the moving reels M3 with a voice.

Figure 67:
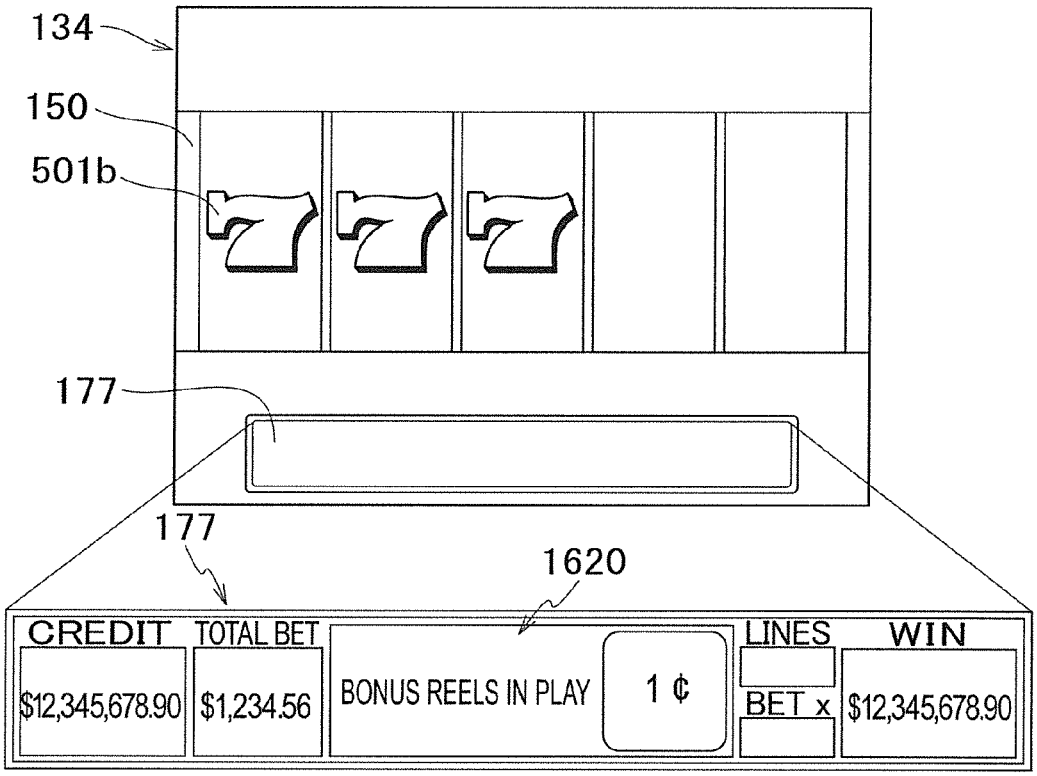
FIG. 67 is a diagram showing an example of image display on the display window and on the VFD.
Figure 68:
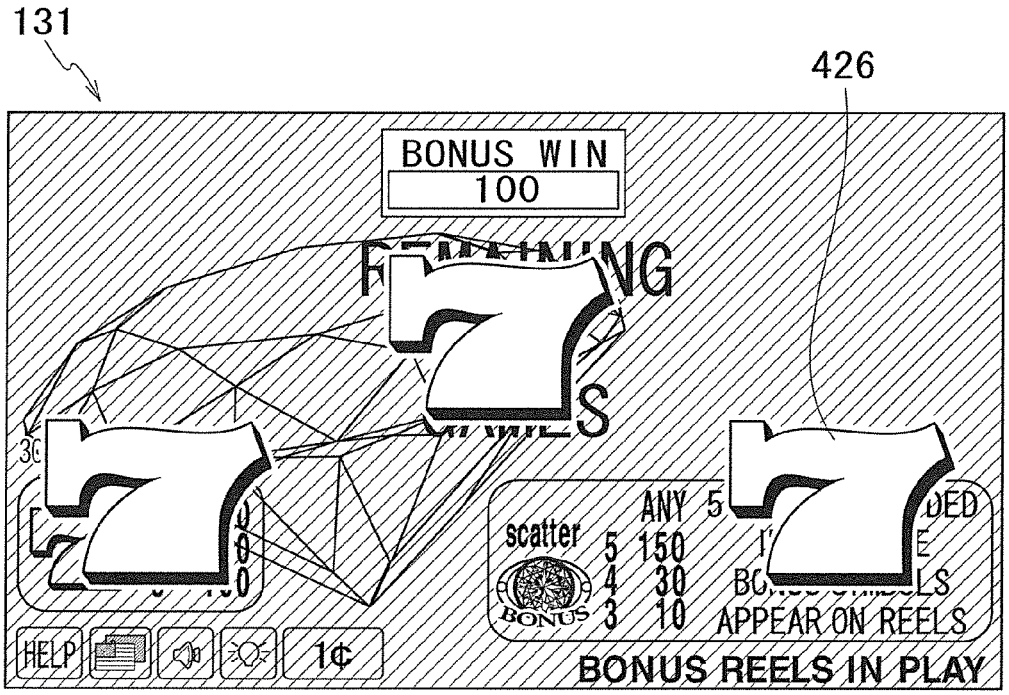
FIG. 68 is a diagram showing an example of image display on the upper image display panel.
Figure 69:
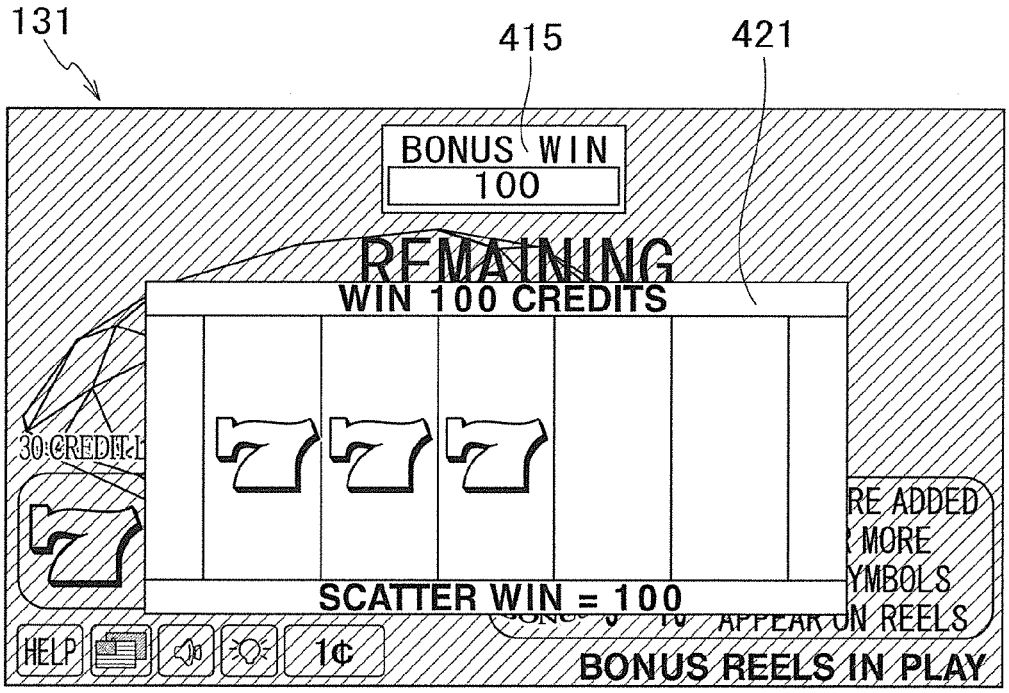
FIG. 69 is a diagram showing an example of image display on the upper image display panel.

Now, description will be given for a case where a winning combination formed by three or more (three or more a kind of) "7" symbols 501*b* is achieved on the display window 150 in the bonus game, as shown in FIG. 67. In this case, on the upper image display panel 131, there are displayed seven symbol images 426 whose number is equal to the number of "7" symbols 501*b* displayed on the display window 150, as shown in FIG. 68. Then, as shown in FIG. 69, the winning indicating image 421 is displayed, and in the winning indicating image 421, the payout amount is incrementally displayed. Simultaneously with the incremental display in the winning indicating image 421, the incremental display of the payout amount is performed in the bonus win meter 415 and in the win meter of the VFD 177.

Figure 70:
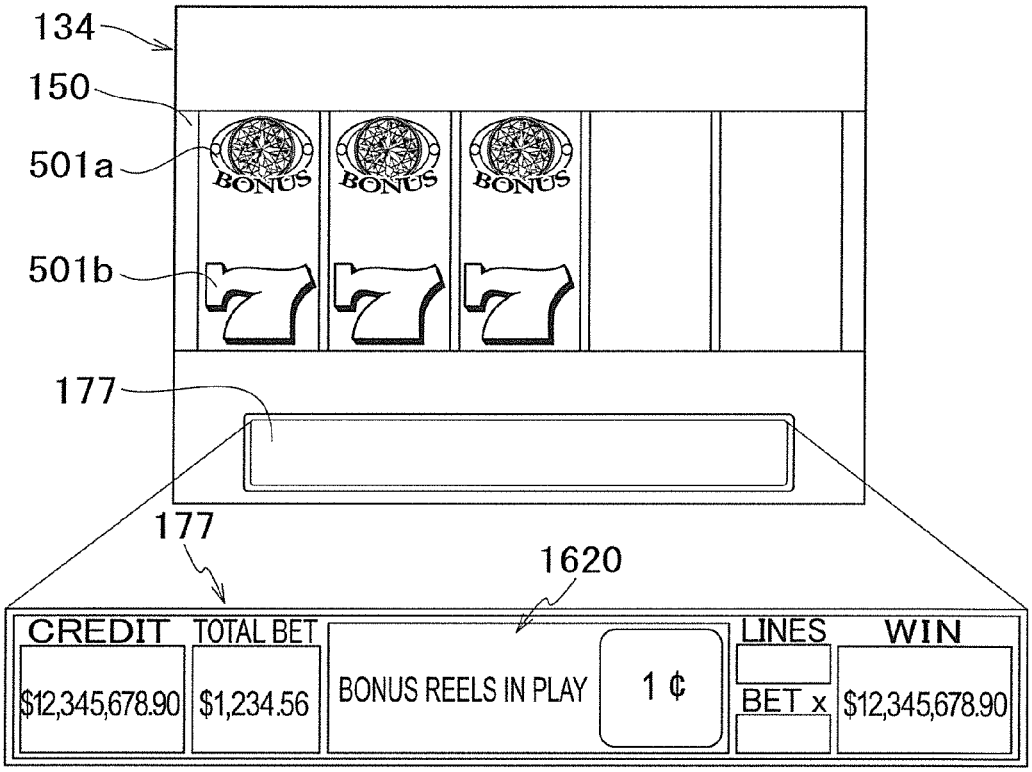
FIG. 70 is a diagram showing an example of image display on the display window and on the VFD.
Figure 71:
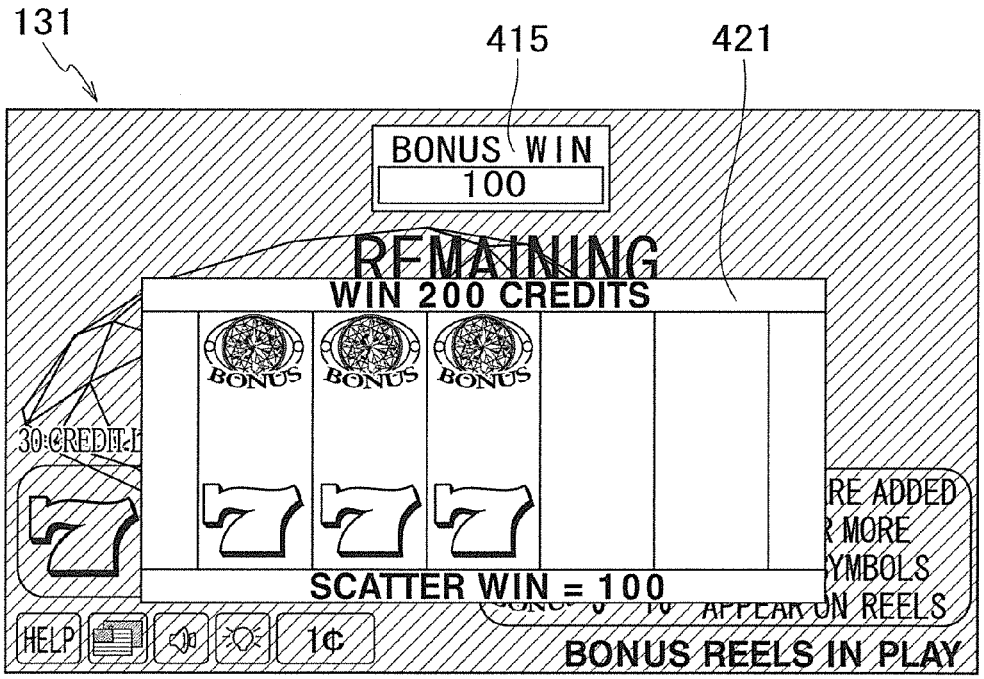
FIG. 71 is a diagram showing an example of image display on the upper image display panel.

As shown in FIG. 70, when, in the bonus game, (i) a winning combination formed by three or more (three or more a kind of) "Bonus" symbols 501*a* is achieved on the display window 150, and (ii) a winning combination formed by three or more (three or more a kind of) "7" symbols 501*b* is achieved on the display window 150, a text of "RETRIGGER" is displayed in the game status region 1620 of the VFD 177. At this time, on the upper image display panel 131, there are displayed the seven symbol images 426 whose number is equal to the number of "7" symbols 501*b* displayed on the display window 150, as shown in FIG. 68. Then, there are displayed the bonus symbol images 423 whose number is equal to the number of the "Bonus" symbols 501*a* displayed on the display window 150, as shown in FIG. 63. Thereafter, as shown in FIG. 71, the winning indicating image 421 is displayed, and in the winning indicating image 421, the payout amount is incrementally displayed. Further, simultaneously with the incremental display in the winning indicating image 421, the incremental display of the payout amount is performed in the bonus win meter 415 and in the win meter of the VFD 177.

Figure 72:
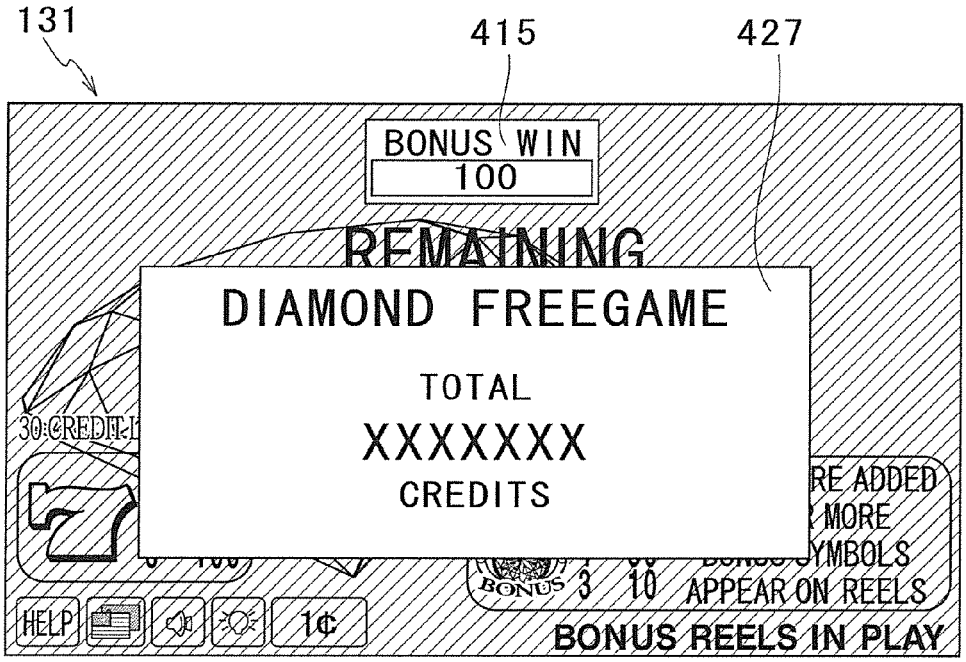
FIG. 72 is a diagram showing an example of image display on the upper image display panel.

Note that if no winning combination is achieved in the free game, the next game is just started. Further, when the number of remaining free games reaches zero after the free games are run, the screen of the upper image display panel 131 turns black and then a total winning indicating image 427 shown in FIG. 72 is displayed. The total winning indicating image 427 indicates the payout amount obtained through all the free games in the bonus game. Note that the total winning indicating image 427 may be of plural types to be changed depending on the payout amount obtained in the bonus game. For example, the following arrangement is possible: when the payout amount obtained in the bonus game is less than 24 times the bet amount at the time of satisfaction of the bonus condition, the total winning indicating image 427 of a normal type is used; when the payout obtained in the bonus game is not less than 25 times and less than 40 times the bet amount at the time of satisfaction of the bonus condition, the total winning indicating image 427 of a gorgeous type (e.g., a frame is added to the image) is used; and when the payout obtained in the bonus game is 40 times or more the bet amount at the time of satisfaction of the bonus condition, the total winning indicating image 427 of the gorgeous type with a fancy background image (e.g., an image of a firework and/or an image of a jewel is added) is used.

(Indication Effect)

An indication effect is an effect executed during a period from the start of a game to the determination of a game result. More specifically, the indication effect is executed: at the timing when a game is started in response to an operation on the control panel 30 (pressing of the spin button) (i.e., a timing before the start of the rotation of the reels M3); at a timing during a period from the start of the rotation to the stop of the reels M3; at a timing after the stop of the reels M3, and the like. The indication effect is executed by the speakers 112, the reel device M1, the backlight unit M7, and the like.

The indication effect before the start of the rotation of the reels M3 includes "Reverse Rising Dragon", "Wobbly", and "Sound Indication Effect". Note that when the "Sound Indication Effect" is executed, it has been determined that the bonus game will be started. Further, the indication effect before the start of the rotation of the reels M3 includes various types of "Flash Indication". Furthermore, the indication effect during the period from the start of the rotation of the reels M3 to the stop of the reels M3 includes "Low-Speed Reach", "High-Speed Reach", "Prior Stop Reach", "Frame Advance Reach", "Slip Movement Low-Speed Reach", "Slip Movement High-Speed Reach", "Slip Movement Prior Stop Reach", and "Slip Movement Frame Advance Reach". The indication effect after the stop of the reels M3 includes "Nudge". In addition, as a special effect showing the start of the bonus game has been determined, executed is "Symbol Match" or "High Speed Full Rotation".

Figure 73:
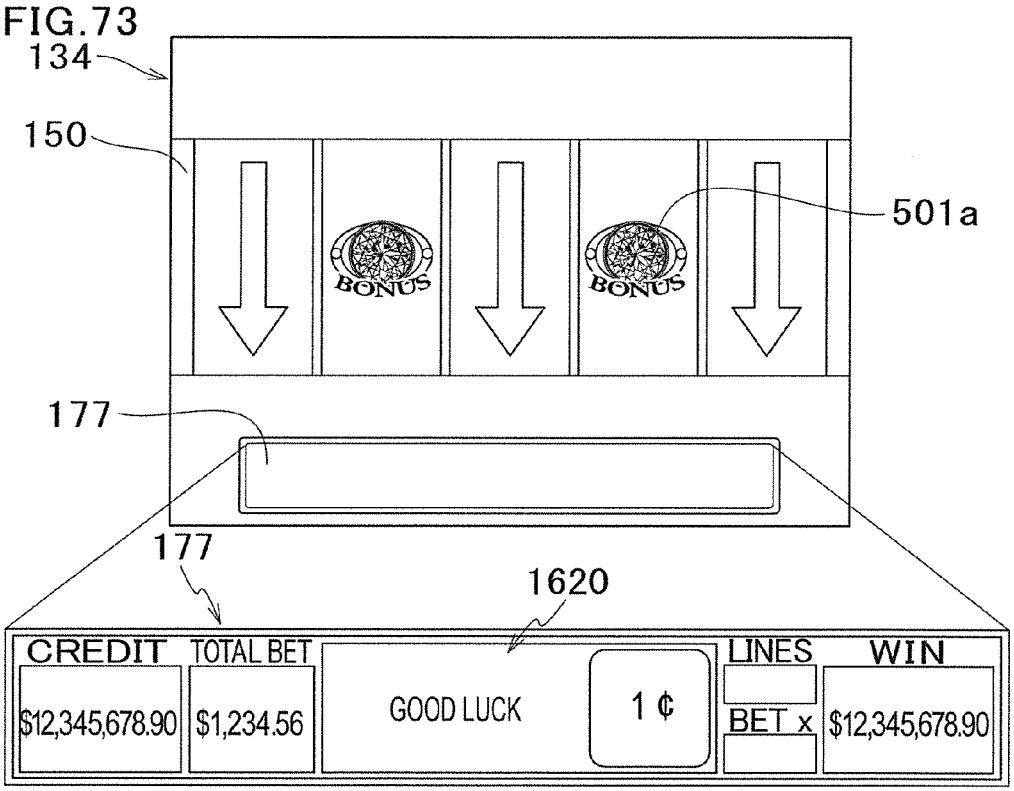
FIG. 73 is a diagram showing an example of an indication effect on the display window.
Figure 74:
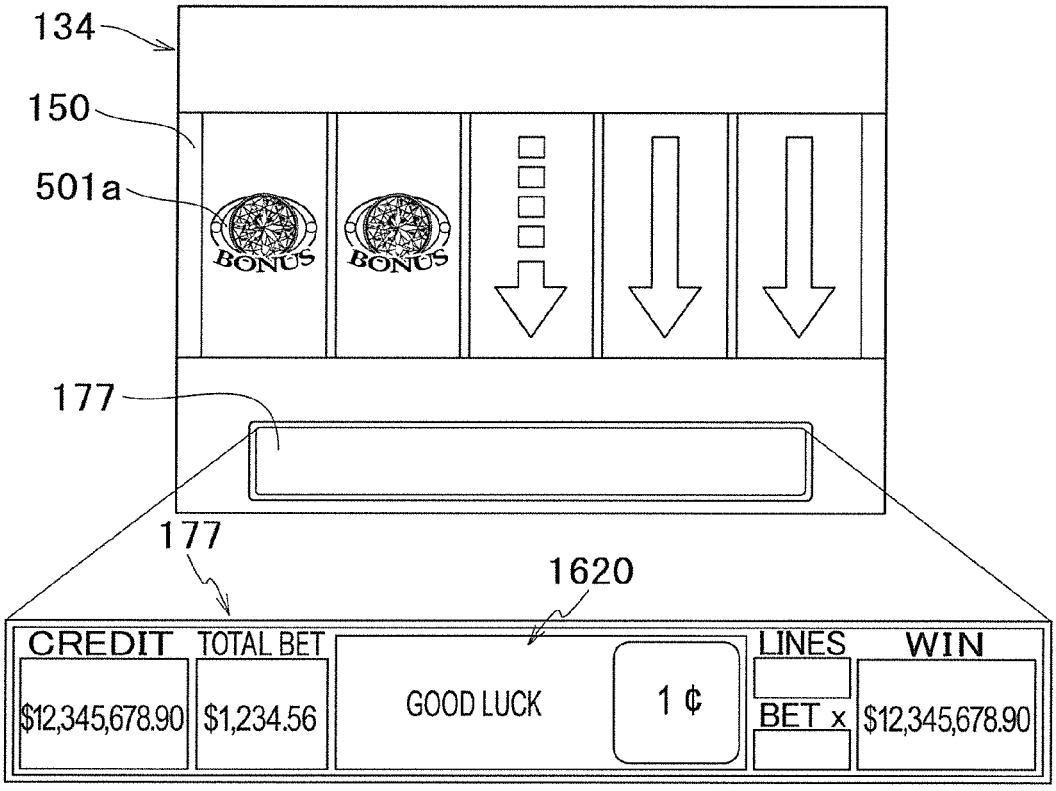
FIG. 74 is a diagram showing an example of the indication effect on the display window.

Specifically, in the indication effect of "Prior Stop Reach", after the rotation of the reels M3 is started as shown in FIG. 54, control is made so that the "Bonus" symbols 501*a* are respectively stopped, prior to the others, on two reels M3 out of the five reels M3, as shown in FIG. 73. Then, the reels M3 which have not been stopped are sequentially stopped, from the left reel M3 when viewed from the front, after the speed of the rotation is decreased than usual. In the indication effect of "Frame Advance Reach", after the rotation of the reels M3 is started as shown in FIG. 54, the "Bonus" symbols 501*a* are respectively stopped on the first reel and the second reel, and then the third reel is moved and rotated in the manner of frame advance, as shown in FIG. 74. After the third reel is stopped, the fourth reel is moved and rotated in the manner of frame advance, and after the fourth reel is stopped, the fifth reel is moved and rotated in the manner of frame advance, and then stopped. The indication effect of "Slip Movement" is the indication effect provided at the start of the rotation of the reels, and in this effect, the movement of the reels M3 is started from the left reel M3 when viewed from the front.

(Increment)

Count up is smoothly carried out upward. Control is executed in consideration of a difference between an actual amount of money (real amount of money) and an amount of money displayed at that time (displayed amount of money). The operation of the carry of a digit is done at the same time as the operation for lower digits. When a displayed amount of money is larger than a real amount of money (e.g., at the time of resetting in response to a winning), rewriting is immediately carried out.

The speed of the increment is determined in accordance with a remaining count-up number. When the remaining count-up number is increased during the operation, the speed of the increment is immediately changed to correspond to the increased remaining count-up number. The rewriting is performed when the remaining count-up number exceeds "101". More specifically, as shown in FIG. 75, the increment operation is carried out at a speed of increment (seconds) corresponding to each remaining count-up number.

When the remaining count-up number exceeds "101", the rewriting is carried out with the value (the remaining count-up number minus 60), and the count up is carried out based on a data table for the remaining 60 counts. For example, when the remaining count-up number is 110 counts, the target amount is rewritten so that 50 counts calculated by subtracting 60 from 110 are added to the target amount. At the same time as the rewriting, the remaining 60 counts are counted up. In the meantime, when the display amount becomes larger than the real amount due to resetting on account of progressive winning or the like, rewriting is immediately carried out. It is noted that the numbers above such as "101" and "60" are mere examples, and "101" may be any predetermined number and "60" may be any number to be subtracted.

When a progressive winning occurs, the increment is interrupted, the rewriting to the amount of money having been won is carried out, and a flickering effect starts. The flickering is not performed while the increment is being interrupted.

The speed of the increment may be controlled based on how many times an amount won by winning is as large as a bet amount. For example, when an amount won by winning is four times as large as a bet amount, the speed of the increment is set at four seconds with reference to the relationship between control thresholds and seconds defined in, for example, a data table shown in FIG. 76. Furthermore, after the speed of the increment is determined based on the data table of FIG. 76, the data table of FIG. 75 may be rewritten based on the determined value. For example, in the case where the amount won by winning is four times as large as the bet amount and therefore it is determined that the speed of the increment is four seconds with reference to FIG. 76 as described above, this "four seconds" may be used as the number of seconds corresponding to the remaining count-up number of "1 to 2" in the data table of FIG. 75, and the numbers of seconds corresponding to the other remaining count-up numbers may be changed to values calculated based on a predetermined ratio.

As for the output sounds from the speakers 112, the output from the illuminations 1212 of the top box decoration unit 120, and the output from the LEDs 1461 of the topper display device 14, the manner of the output at the time of winning changes depending on a multiplying factor for the payout. Specifically, the ranges of the multiplying factors based on which the manner changes are as follows: (i) less than 5, (ii) not less than 5 and less than 10; (iii) not less than 10 and less than 19; and (iv) not less than 19. Further, an image indicating a result displayed at the time of winning changes depending on the multiplying factor for the payout. Specifically, the ranges of the multiplying factors based on which the image changes are as follows: (i) not less than 10 and less than 19, and (ii) not less than 19. When the payout multiplying factor is not less than 10 and less than 19, an enlarged win meter and a text image of "BIG WIN" are displayed on the upper image display panel 131 at the time of the incremental display of the win meter. When the payout multiplying factor is not less than 19, a text image of "GREAT" and a win meter exclusive for the multiplying factors not less than 19 are displayed at the time of the incremental display of the win meter.

(Operation of Slot Machine)

The following describes an operation of the slot machine 10.

Note that the following description assumes that one of a plurality of stop tables is randomly determined at the timing of pressing the start button, and the reels M3 are automatically stopped at a predetermined timing based on the stop table determined; however, the slot machine 10 is not limited to this. Specifically, the following structure is possible. Namely, the slot machine 10 has not-shown reel stop buttons corresponding to the reels M3, respectively, and randomly determines one of the stop tables at the timing of pressing the operation button. Based on that stop table determined and the timing of pressing the reel stop buttons, the reels M3 may be stopped. In other words, after the internal random determination of the stop table, the slot machine 10 may stop the reels M3 based on the timing of pressing the reel stop buttons and the stop table randomly determined internally, and then determine if there is a winning combination of the symbols 501 stopped on all the reels M3.

Figure 77:
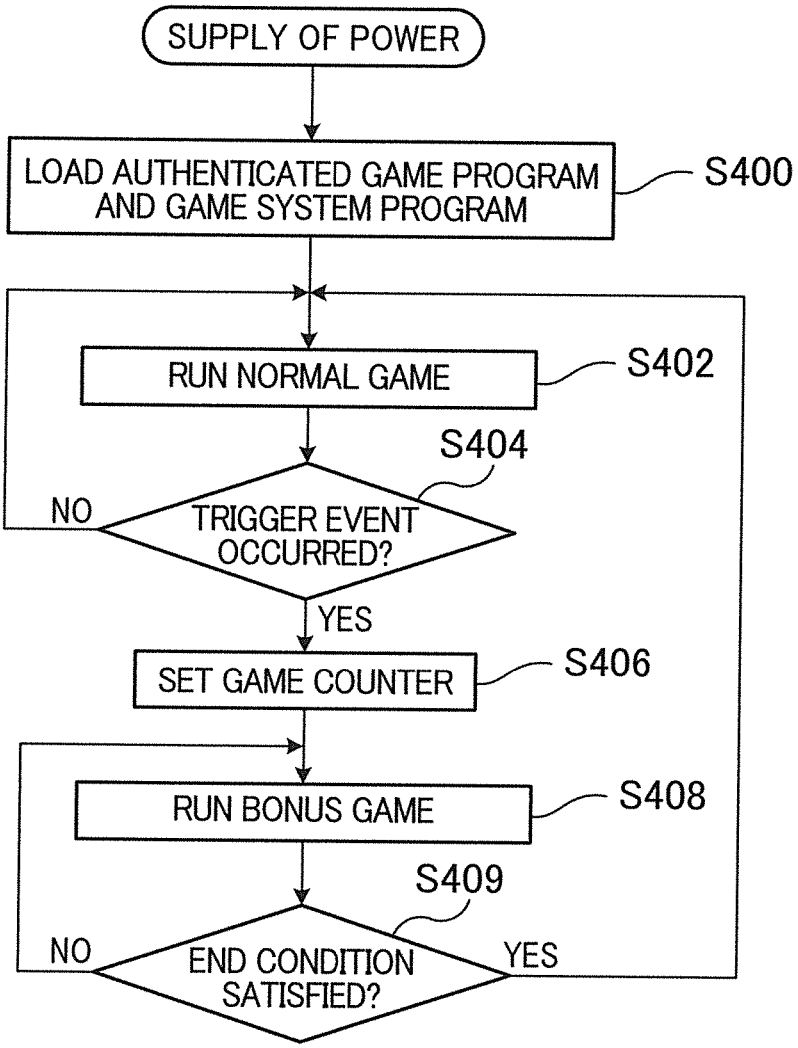
FIG. 77 is a flowchart showing a general process executed in the gaming machine of the first embodiment.

FIG. 77 shows a process executed in the slot machine 10. When the power is supplied to the slot machine 10, the main CPU reads out the program from the memory card 54 via the gaming board 50, and writes the program into the RAM 73, thus loading the authenticated game program and the game system program (S400). Next, the main CPU 71 runs the game program and the game system program.

When the player starts a unit game by inserting an IC card into the IC card reader or entering a coin into a coin receiver, a new unit game is run based on the coin entered or the bet stored. The game mode of the unit game to be run first after the slot machine 10 is booted is the normal game mode. As described, the main CPU 71 executes the normal game process for the first unit game (S402).

Every time the unit game of the normal game ends, the main CPU 71 in the game mode determination process P316 determines whether a trigger event has occurred (S404). The game mode of the subsequent unit games is maintained in the normal game mode, unless a trigger event has occurred. Thus, the main CPU 71 causes the process to return to step S402, and executes the normal game process for the subsequent unit games.

However, when the main CPU 71 determines that a trigger event has occurred in the determination process of step S404, the CPU 71 changes the game mode of the subsequent unit game to the bonus game mode.

As mentioned above, in the preferable embodiment, the number of unit games (free games) runnable in a single session of the bonus game is 10. There are bonus game symbol code determination tables different from each other, and one of them is randomly determined in each unit game of the bonus game. Every time the unit game of the bonus game is run, the game counter counts up the number of unit games already run in the session, or counts down the number of unit games remaining in the session. The following description assumes that the game counter counts up the number of unit games run, starting from zero. Therefore, the main CPU 71 sets the value of the game counter to zero in step S406. After that, the main CPU 71 executes the game process of the bonus game for the subsequent games (S408).

Every time the unit game of the bonus game ends, whether the end condition is satisfied is determined in the game mode determination process P316 (S409). Unless the end condition is satisfied, the game mode of the subsequent unit game is maintained in the bonus game mode. Therefore, the main CPU 71 causes the process to return to step S408, and executes the bonus game process for the subsequent unit game.

When the main CPU 71 determines that the end condition is satisfied in the determination process of step S409, the CPU 71 shifts the game mode of the subsequent unit game to the normal game mode. Then, the main CPU 71 causes the process to return to step S402, and executes the normal game process for the subsequent unit game.

Figure 78:
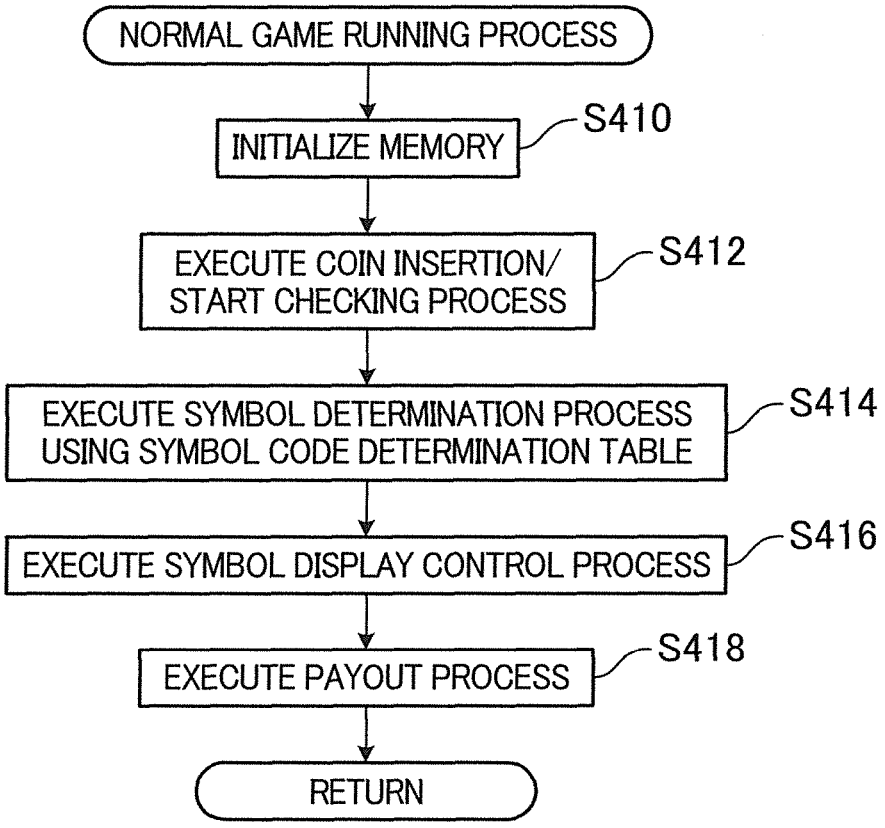
FIG. 78 is a flowchart showing a normal game process.

FIG. 78 shows the normal game running process and shows the details of step S402 shown in FIG. 77.

Every time the unit game ends, the main CPU 71 executes a memory initializing process (S410). In this initializing process, the main CPU 71 clears unnecessary data and information from the temporary work area of the RAM 73. The unnecessary data and information include: payout data, information of winnings or loses, and information of symbols to be stopped which are determined in the previous unit game.

After that, the main CPU 71 executes a coin insertion/start checking process (S412). In this process, the main CPU 71 checks an insertion of a coin or a bill, and scans inputs from the BET button and the START button.

After the START button [spin button] is pressed by the player, the main CPU 71 executes the symbol determination process (S414). In this process, the main CPU 71 generates five random numbers, and determines, with reference to the normal game symbol code determination table, five symbol codes of five symbols to be stopped according to the random numbers. The main CPU 71 determines whether the symbol matrix formed by the rearranged symbols includes any winning combination.

In step S416, the main CPU 71 executes the symbol display control process. In this process, the main CPU 71 controls the reel device M1 to rotate the reels M3 of the first to fifth reel units M11*a* to M11*e*, and then stops the reels M3 to form a symbol matrix on the display window 150 by rearranging the symbols according to the result of the symbol determination process.

Next, in step S418, the main CPU 71 executes the payout process to determine the amount of payout, and award the amount of payout determined to the player.

(Symbol Determination Process)

Figure 79:
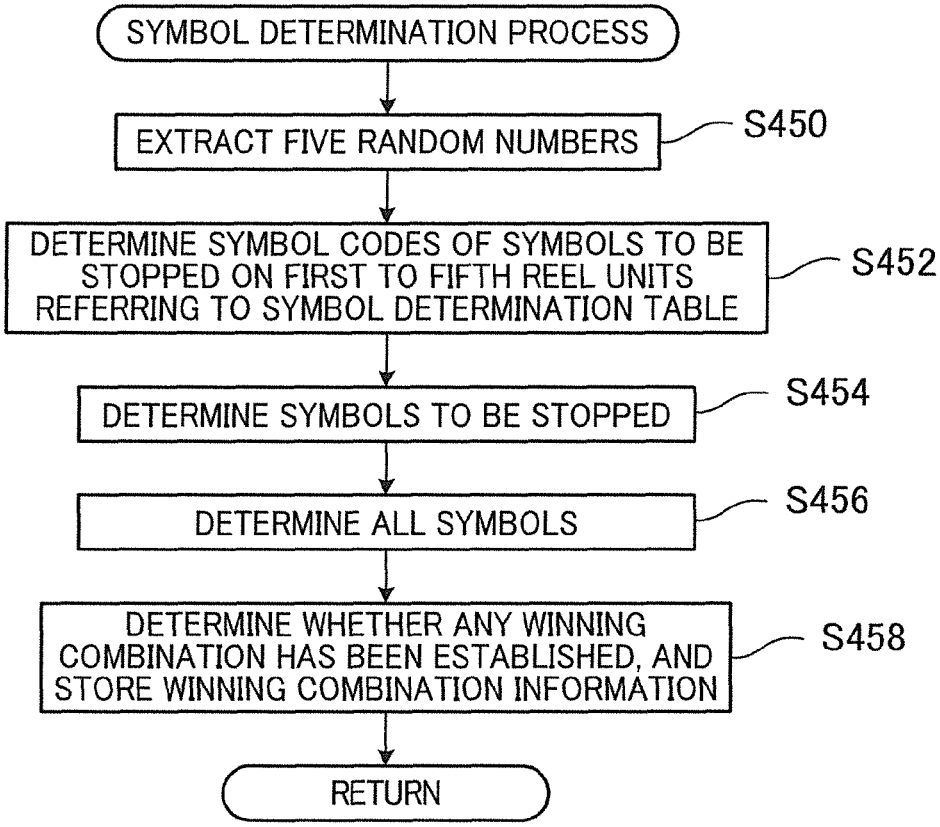
FIG. 79 is a flowchart showing details of a symbol determination process.

FIG. 79 shows the symbol determination process and shows the details of step S414 shown in FIG. 78.

First, in the random number generating process P302 executed by the main CPU 71, five random numbers are sampled (S450).

After that, in the symbol determination process P304 executed by the main CPU 71, the first to fifth symbol codes are determined by using the first to fifth random numbers, with reference to the symbol code determination table (S452). Next, the main CPU 71 refers to the symbol code table and uses the first to fifth symbol codes to determine the first to fifth symbols to be stopped (S454). Thus, the five symbols to be stopped are determined by using the five random numbers. After the first to fifth symbols to be stopped are determined, the main CPU 71 stores the symbols or the symbol codes in the RAM 73.

The five symbols to be stopped are the symbols to be stopped in the second row of the symbol matrix. The alignment of the symbols structuring the first to fifth symbol arrays are fixed on the reels M3 of the first to fifth reel units M11*a* to M11*e*. Therefore, determining these symbols to be stopped will determine all the symbols structuring the symbol matrix. The main CPU 71 refers to the symbol code table, and determines all the symbols structuring the symbol matrix based on the symbols to be stopped (S456).

After that, in the winning determination process P310 executed by the main CPU 71, there is determined whether a winning combination is formed by the symbols determined in step S456, which structure the symbol matrix (S458). When a winning combination is formed by the symbols structuring the symbol matrix, the winning combination is stored in the RAM 73, in the winning determination process P310. Further, the main CPU 71 may determine whether a winning combination is formed based on the symbol codes of the symbols to be stopped, instead of using the symbol matrix for determining whether a winning combination is formed.

When the symbol determination process ends, the flow returns to the main process (not shown). Then, the symbol display control process is executed, and the reels M3 of the first to fifth reel units M11*a* to M11*e* are rotated. The reels M3 of the first to fifth reel units M11*a* to M11*e* rotate at different speed from one another, and the symbol arrays on the reels M3 of the reel device M1 scroll on the display window 150. While the reels M3 are rotating, the backlight unit M7 is activated to provide an effect from the back of the reel strips M32. After this, the reels M3 of the first to fifth reel units M11*a* to M11*e* are stopped. Through this, scrolling of the symbol arrays are stopped so that the symbols to be stopped are positioned in the second row of the symbol matrix formed on the display window 150.

When the symbol display control process ends, the process returns to the main process. Then, the payout process is executed. When a winning combination is formed, the amount of payout is determined according to the winning combination, and the amount determined is paid out in the form of increasing the credit or outputting of the coins.

(Bonus Game Running Process)

Figure 80:
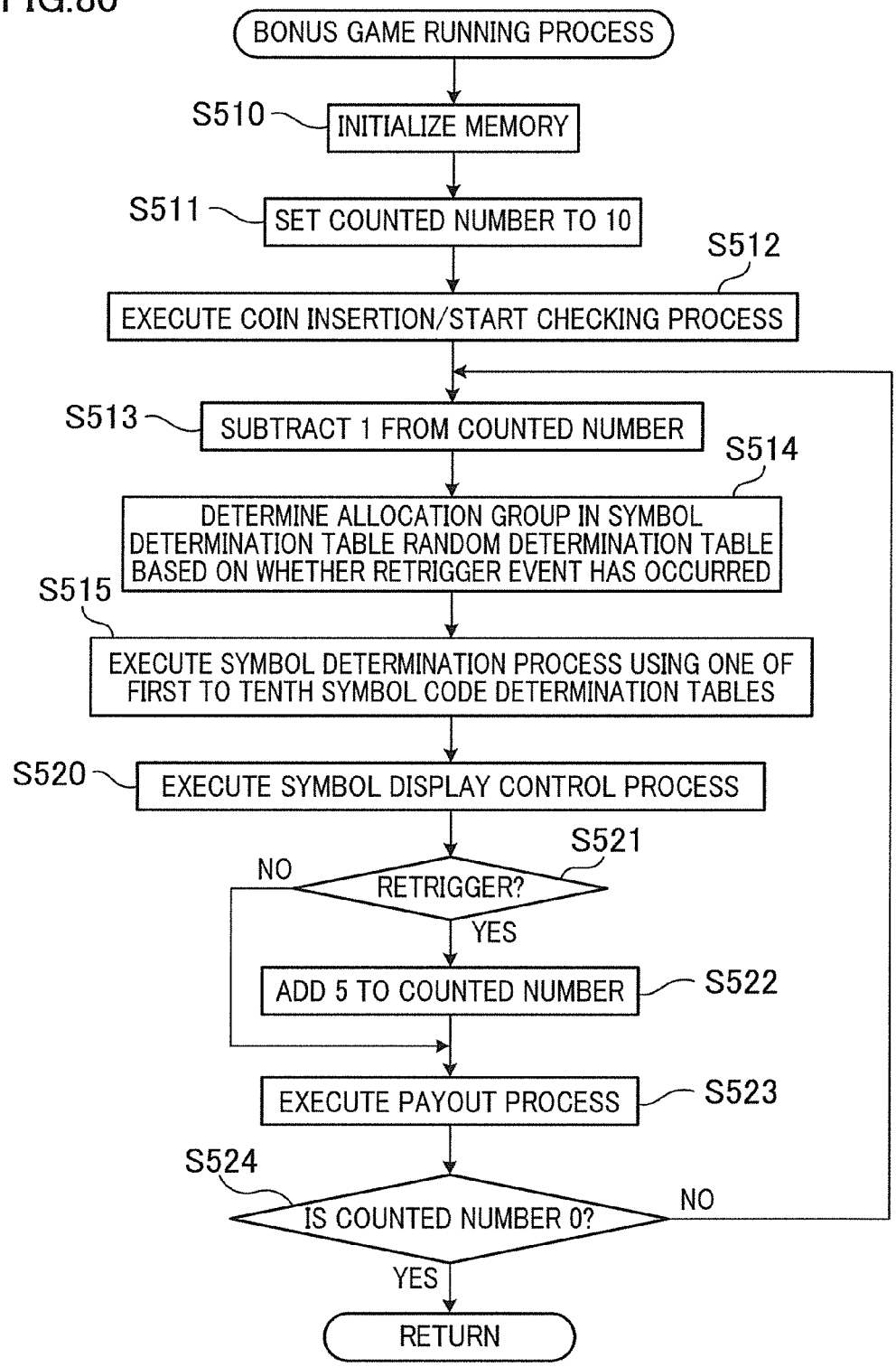
FIG. 80 is a flowchart showing a bonus game process.

FIG. 80 shows in detail the end condition determination process (S409) and the bonus game running process (S408) shown in FIG. 77.

When shifting to the bonus game mode occurs, the main CPU 71 first executes a memory initializing process (S510). The main CPU 71 clears unnecessary data and information from the temporary work area of the RAM 73. The unnecessary data and information include: payout data, information of winnings or loses, and information of symbols to be stopped which are determined in the previous unit game.

Next, the main CPU 71 sets the counted number of a game counter, which indicates a serial number of the bonus game to be run, to 10 in step S511.

Then, the main CPU 71 executes the coin insertion/start checking process (S512). In this process, the main CPU 71 checks for insertion of the coin or the bill, and detects an input signal from the BET button and the START button. Then, the counted number is decremented by 1 (S512). Thereafter, which of the allocation groups in the symbol determination table random determination table is used is determined based on whether the retrigger event has occurred or not (S514).

The main CPU 71 executes the symbol determination process (S515). In this process, the main CPU 71 generates five random numbers first. Next in the symbol determination process P304 executed by the main CPU 71, one of the bonus game symbol code determination tables is randomly selected, and the first to fifth symbol codes are determined based on the selected table.

After that, the main CPU 71 refers to the symbol code table, and determines the first to fifth symbols to be stopped, which correspond to the first to fifth symbol codes, respectively. As the result, the five symbols to be stopped are determined by using the five random numbers. After the first to fifth symbols to be stopped are determined, the main CPU 71 stores the symbols or the symbol codes in the RAM 73.

Next, in the winning determination process P310 executed by the main CPU 71, there is determined whether a predetermined winning combination is formed by the rearranged symbols. If the predetermined winning combination is formed by the rearranged symbols, that winning combination is stored in the RAM 73, in the winning determination process P310.

The main CPU 71 controls the reel device M1, and executes the symbol display control process to stop the rotation of the reels M3 of the first to fifth reel units M11*a* to M11*e* (S520). The scrolling of the symbols is stopped according to the result of the symbol determination process, and the symbols are rearranged to form the symbol matrix on the display window 150. Then, it is determined whether the retrigger condition is satisfied (S521). When the retrigger condition is satisfied, 5 is added to the counted number (S522), and the processing proceeds to step S523. When the retrigger condition is not satisfied, the processing proceeds to S523 without the addition. The main CPU 71 executes the payout process to determine the amount of payout, and provides the amount of payout determined to the player (S523).

The main CPU 71 determines whether the counted number is 0 (S516). The counted number of 0 means that the last game in the bonus game mode is being run. When it is determined that the counted number is 0, the main CPU 71 determines that the end condition is satisfied, and therefore this routine ends. When it is determined that the counted number is not 0, the processing proceeds to step S513, to run a free game again.

The above embodiment thus described solely serves as a specific example of the present invention, and the present invention is not limited to such an example. Specific structures and various means may be suitably designed or modified. Further, the effects of the present invention described in the above embodiment are not more than examples of most preferable effects achievable by the present invention. The effects of the present invention are not limited to those described in the embodiments described above.

(Modifications)

The following describes a modification of the reel strips which have been described with reference to FIG. 17 to FIG. 19, for example.

Figure 81:
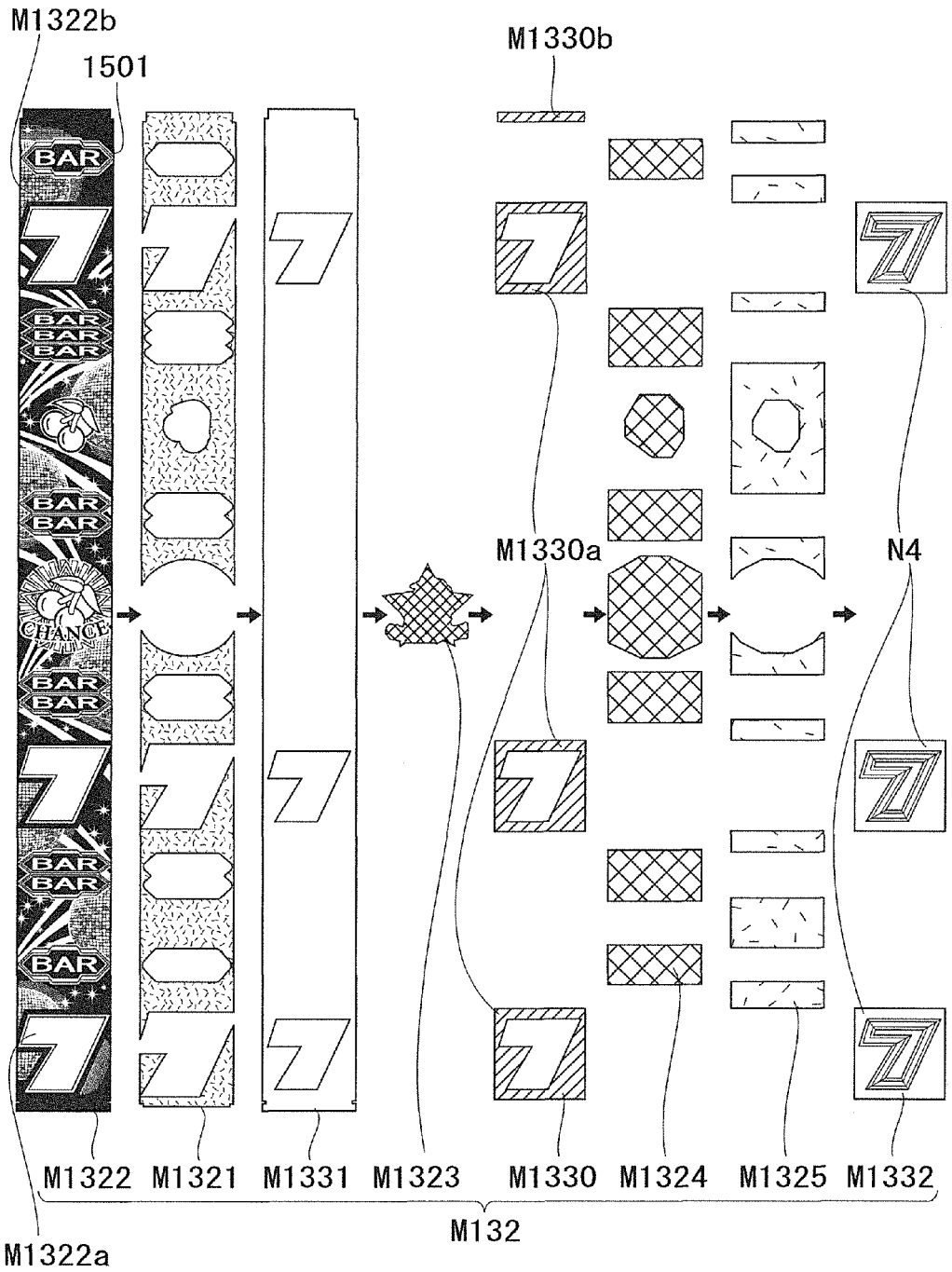
FIG. 81 is an explanatory diagram showing layers of a reel strip of a modification.
Figure 82:
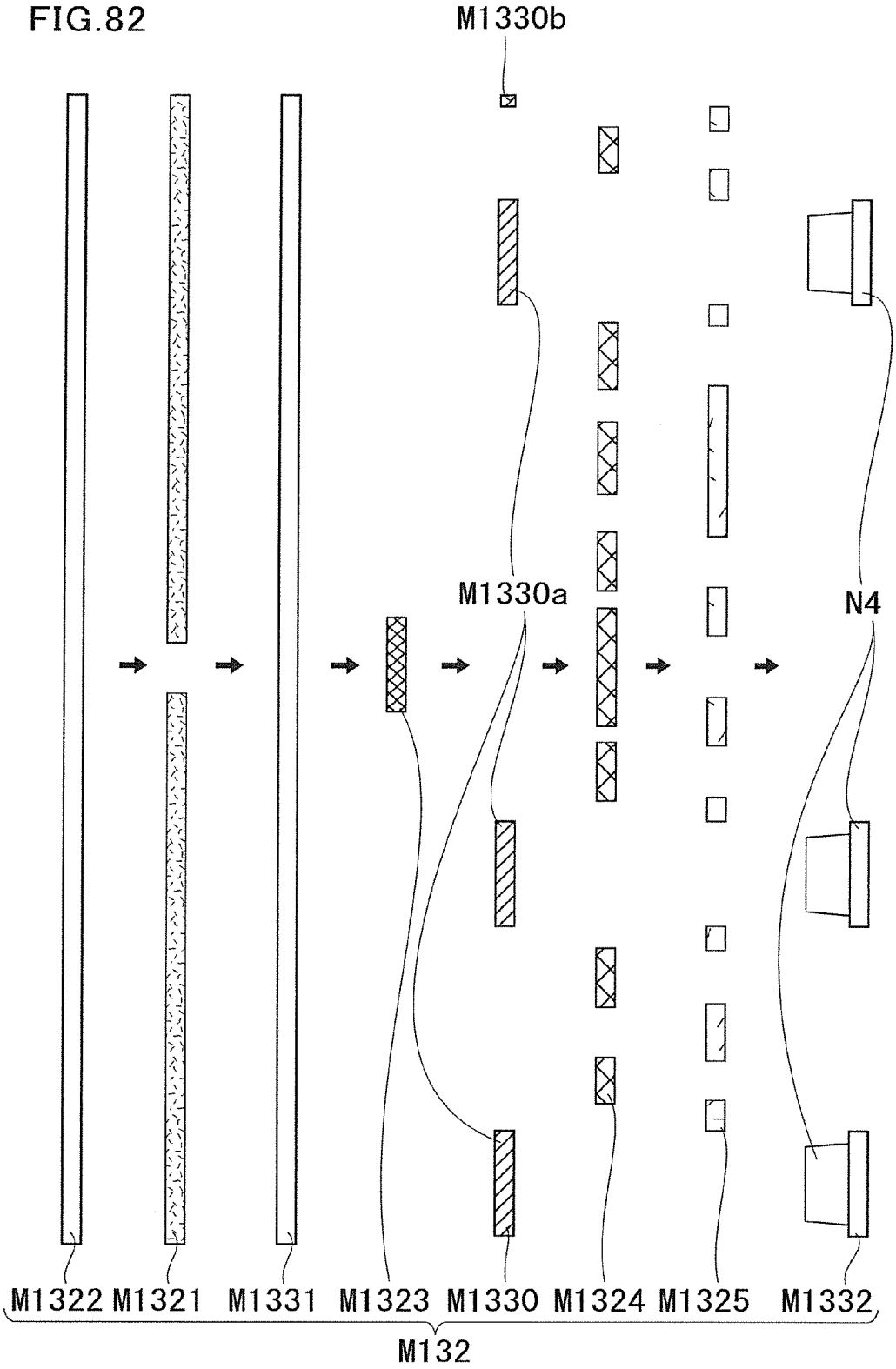
FIG. 82 is an explanatory diagram showing the layers of the reel strip of the modification.
Figure 83:
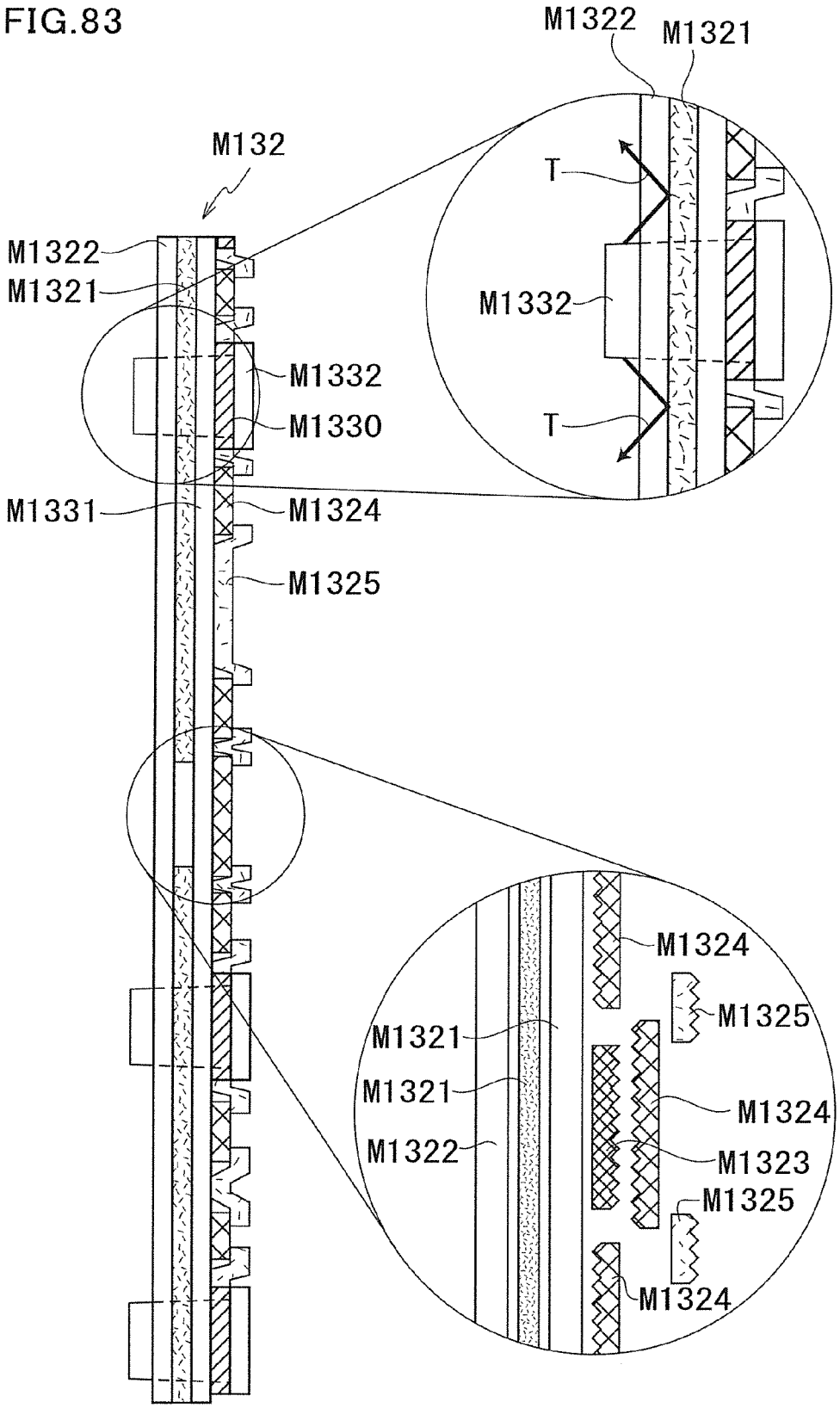
FIG. 83 is a side view of the reel strip of the modification with its partial exploded sectional views.

As shown in FIG. 81 to FIG. 83, each reel strip M132 of the modification includes a symbol-printed layer M1322, a color shifting layer M1321, a base layer M1331, a first diffusion layer M1323, a double-sided tape layer M1330, a second diffusion layer M1324, a third diffusion layer M1325, and a three-dimensional symbol layer M1332.

On the symbol-printed layer M1322, eleven symbols 1501 are placed at predetermined intervals. In this modification, seven types of symbols are included in a single symbol array. The seven types of symbols include "7", "BAR", "2 BARs", "3 BARs", "Cherry", and "Bonus (Chance Cherry)". Note that a "blank symbol" may be placed between the symbols 1501. The symbol-printed layer M1322 is the outermost layer when the reel strip M132 is mounted on the corresponding reel M31 as described in the above embodiment.

In this modification, the symbol-printed layer M1322 has, at the positions for the symbols 1501 of "7", holes M1322*a* each is formed by cutting out the shape of "7". The color shifting layer M1321, the base layer M1331, and the double-sided tape layer M1330 also have the similar holes at the position of those symbols 1501. Further, the diffusion layers M1323 to M1325 are not laminated at the positions of those symbols 1501. This enables light emitted from a light source (e.g., a backlight) provided in the reel device M1 to be applied to a player through the three-dimensional symbol layer M1332 provided at the positions of the holes M1322*a*, to enhance enjoyment. Note that, another structure is also possible. For example, a layer configured to transmit light does not have to have such holes.

A picture pattern 1322*b* in various colors is formed in a region of the symbol-printed layer M1322 which region is other than the regions where the symbols 1501 are located. The picture pattern 1322*b* is formed all over the region other than the regions where the symbols 1501 are placed; however, other structures are also possible. Further, the picture pattern 1322*b* is formed by various types of multicolor pictures such as mirror balls, light beams, and brilliance, as shown in FIG. 81; however, other pictures are also possible.

The symbol-printed layer M1322 is formed by printing the symbols 1501 and the picture pattern 1322*b* on a transparent PET (polyethylene terephthalate) sheet through UV (Ultra Violet) inkjet printing; however, other structures are also possible.

The color shifting layer M1321 is a multilayer optical film configured to selectively reflect and transmit predetermined wavelengths of visible light depending on the incident angle of the light, from which film the shapes of the symbols are cut out. That is, there is no color shifting layer M1321 in the areas where the symbols 1501 are located. Thus, in the areas for the symbols 1501, there is no change in color depending on the viewing angle, and this contrarily emphasizes the symbols 1501.

The base layer M1331 is a PET sheet, functioning as a base member to which the layers are attached. The base layer M1331 is colored milky white and is configured to transmit light. Note that the base layer M1331 may have another color, or may be transparent.

Figure 84:
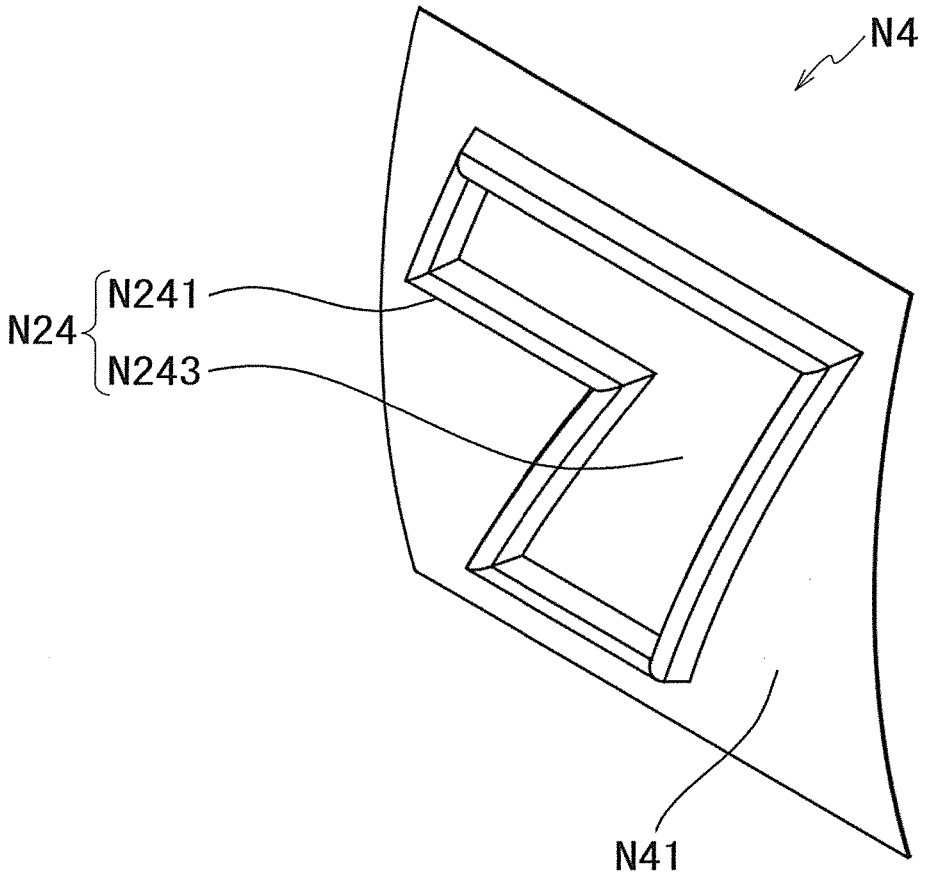
FIG. 84 is a perspective view of a three-dimensional symbol portion of the modification.

As shown in FIG. 81, the three-dimensional symbol layer M1332 has three three-dimensional symbol portions N4. Each three-dimensional symbol portion N4 is firmly attached to the reel strip M132 using a symbol fixing portion M1330*a* of the double-sided tape layer M1330, which will be described later. Each three-dimensional symbol portion N4 is integrally formed by an optical sheet mainly made of PVC (polyvinyl chloride), through vacuum molding. It is preferable that each three-dimensional symbol portion N4 is formed by an effect sheet which transmits and diffuses light. As shown in FIG. 84, each three-dimensional symbol portion N4 has an attached region N41 and a symbol region N42. The attached region N41 is attached to the adhesive symbol fixing portion M1330*a*. In the symbol region N42, a protruding portion N421 and a flat portion N423 are formed. As shown in FIG. 84, the symbol region N42 is formed into a shape of "7" through vacuum molding. Specifically, the protruding portion N421 is provided on the edge of the flat portion N423 formed into the shape of "7", and thereby a recess is formed. A sticker may be attached to all over or a part of the flat portion N423. The protruding portion N421 passes through the cutout portions of the double-sided tape layer M1330, the base layer M1331, the color shifting layer M1321, and the symbol-printed layer M1322 when the attached region N41 is attached to the symbol fixing portion M1330*a*. That is, as shown in FIG. 83, each protruding portion N421 protrudes toward the outer circumference through the corresponding hole M1322*a* of the symbol-printed layer M1322.

Each of the first diffusion layer M1323, the second diffusion layer M1324, and the third diffusion layer M1325 is a light diffusing sheet formed to correspond to the symbols, and is made from soft polyvinyl chloride (PVC). The first diffusion layer M1323, the second diffusion layer M1324, and the third diffusion layer M1325 diffuse light differently from one another. The combination of the laminated layers (the color shifting layer M1321 and the diffusion layers M1323 to M1325) varies from position to position on the reel strip M132, and therefore, different visual impressions are provided at the respective positions.

Specifically, there are the following main combinations. For example, both of the first diffusion layer M1323 and the second diffusion layer M1324 are laminated only at the position of the symbol 1501 of "Bonus (Chance Cherry)". Further, the reel strip M132 have through holes each having at least a shape of "7" at only the positions for the symbols 1501 of "7", and this enables light emitted from the above-described backlight unit M7 or the like to be transmitted through the three-dimensional symbol layer M1332. Thus, at the positions for the symbols 1501 of "7", light emitted from the backlight unit M7 or the like is transmitted. Since the three-dimensional symbol layer M1332 is formed by the light diffusing sheet, the transmitted light is diffused in multiple directions at each portion of the three-dimensional symbol layer M1332 which portion protruding from the symbol-printed layer M1322. As shown in FIG. 83, a part of the transmitted light (transmitted light T) passes through the symbol-printed layer M1322 to reach each region of the color shifting layer M1321 which region around the position for the symbol 1501 of "7", and the light is reflected. Thus, under the influence of the transmitted light T, a color change depending on the incident angle occurs in the region of the color shifting layer M1321 which region around the position for the symbol 1501 of "7". The influence of the transmitted light T decreases with an increase in the distance from the position for the symbol 1501 of "7", and this provides an effect of gradation in the region around the symbol 1501 of "7".

Further, the second diffusion layer M1324 is laminated at and around the positions of the symbols 1501 other than "7". Furthermore, the color shifting layer M1321 is laminated in the region of the picture pattern 1322*b*, and this provides a visual effect different from that is provided by the diffusion layers M1323 to M1325. Note that the second diffusion layer M1324 is also laminated in the regions of the picture pattern 1322*b* which regions around the symbols 150. This causes a difference in visual effect on the picture pattern 1322*b*, between the regions around the symbols 1501 (other than the symbols of "7") and the other regions (regions between the symbols 1501). With this, the symbols 1501 are more emphasized.

Furthermore, as shown in FIG. 83, each of the first diffusion layer M1323, the second diffusion layer M1324, and the third diffusion layer M1325 has two surfaces, one of which is smooth (a smooth surface), and the other of which has a mesh structure (a rough surface). The smooth surface of the first diffusion layer M1323 is adhered to the symbol-printed layer M1322. The rough surface of the second diffusion layer M1324 is adhered to the symbol-printed layer M1322. Further, the smooth surface of the third diffusion layer M1325 is adhered to the symbol-printed layer M1322. Note that the layers are adhered using double-sided tapes which are not shown.

The double-sided tape layer M1330 has: a reel fixing portion M1330*b* which is laminated at one end of the reel strip M132 in its rotation direction; and symbol fixing portions M1330*a* which are laminated on regions each including the symbol 1501 of "7". The reel fixing portion M1330*b* of the double-sided tape layer M1330 is provided to annularly fix the reel strip M132 including the double-sided tape layer M1330. Further, the symbol fixing portions M1330*a* of the double-sided tape layer M1330 are provided to respectively adhere the three-dimensional symbol portions N4 which are laminated on the inner circumferential surface side, as described above.

Thus, on the inner circumferential surface side (the back surface side) of the symbol-printed layer M1322, the color shifting layer M1321, the base layer M1331, the first diffusion layer M1323, the double-sided tape layer M1330, the second diffusion layer M1324, the third diffusion layer M1325, and the three-dimensional symbol layer M1332 are laminated in this order.

Note that the order of the lamination is not limited to the above. For example, the color shifting layer M1321 may be laminated on the outer circumferential surface side (the front surface side) of the symbol-printed layer M1322. In addition to this, the base layer M1331, the first diffusion layer M1323, the double-sided tape layer M1330, the second diffusion layer M1324, the third diffusion layer M1325, and the three-dimensional symbol layer M1332 may be laminated on the inner circumferential surface side (the back surface side) of the symbol-printed layer M1322. Further, the symbol-printed layer M1322 may be omitted, if the symbols are printed on the base layer M1331.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A reel strip having symbols placed thereon, the reel strip disposed on an outer circumferential surface of a cylindrical reel configured to be rotated with its cylinder central axis being held at a predetermined position, the reel strip comprising:

a color shifting layer configured to selectively reflect and transmit predetermined wavelengths of visible light depending on an incident angle of the light;

a diffusion layer laminated at a position inward of the color shifting layer and configured to diffuse incident light to be outputted; and a symbol-printed layer laminated at a position outward of the color shifting layer and including a first region on which the symbols are printed.

2. The reel strip according to claim 1, wherein the color shifting layer is a color film of which color perceived by a viewer changes depending on a viewing angle.

3. The reel strip according to claim 2, wherein the color shifting layer is a multilayer optical film having a plurality of layers each configured to selectively reflect specific wavelengths of light.

4. The reel strip according to claim 3, wherein the color shifting layer has a characteristic that its reflection band shifts toward a shorter wavelength band and becomes narrower as the incident angle decreases.

5. The reel strip according to claim 4, wherein the color shifting layer has a characteristic that when visible light is applied to the color shifting layer at an incident angle of 90 degrees, the color shifting layer transmits violet, blue, green, and longer-wavelength red light, while the color shifting layer reflects yellow, orange, and shorter-wavelength red light.

6. The reel strip according to claim 4, wherein the color shifting layer has a characteristic that: when visible light is applied to the color shifting layer at an incident angle of 90 degrees, the color shifting layer transmits violet, blue, green, and longer-wavelength red light, while the color shifting layer reflects yellow, orange, and shorter-wavelength red light; and when the visible light is applied to the color shifting layer at an incident angle of 60 degrees, the color shifting layer transmits violet, shorter-wavelength blue, yellow, orange, and red light, while the color shifting layer reflects longer-wavelength blue and green light.

7. The reel strip according to claim 1, wherein:

the symbol-printed layer further includes a second region on which the symbols are not located;

a picture pattern in various colors is printed in the second region; and the color shifting layer is laminated in the second region.

8. A gaming machine comprising:

a reel including a reel strip provided on an outer circumferential surface of the reel, the reel strip having symbols placed thereon; and a reel drive mechanism configured to rotate the reel at a predetermined position to rearrange the symbols, wherein the reel strip includes:

a color shifting layer configured to selectively reflect and transmit predetermined wavelengths of visible light depending on an incident angle of the light;

a diffusion layer laminated at a position inward of the color shifting layer and configured to diffuse incident light to be outputted; and a symbol-printed layer laminated at a position outward of the color shifting layer and including a first region on which symbols are printed.

9. The gaming machine according to claim 8, further comprising:

a display window through which the symbols on the reel strip are visible from the outside;

a backlight unit configured to emit backlight illuminating light including the predetermined wavelengths of visible light from a position inside the reel toward a portion of the reel strip which portion is located within the display window; and a front light unit configured to emit front light illuminating light including the predetermined wavelengths of visible light from a position outside the reel toward the reel strip.

10. The gaming machine according to claim 9, further comprising a backlight control device configured to control an emission manner of the backlight illuminating light emitted from the backlight unit, wherein:

the backlight unit includes a plurality of illuminating light sources arranged in a width direction and a longitudinal direction of the reel strip, with which an amount of the emitted backlight illuminating light of the light sources is adjustable to multiple levels; and the backlight control device is configured to control the plurality of illuminating light sources individually.

11. The gaming machine according to claim 10, wherein each of the illuminating light sources is a full color light-emitting diode.

12. The gaming machine according to claim 9, further comprising a front light control device configured to control an emission manner of the front light illuminating light emitted from the front light unit, wherein:

the front light unit includes a plurality of illuminating light sources arranged in the width direction of the reel strip, with which an amount of the emitted front light illuminating light of the light sources is adjustable to multiple levels; and the front light control device is configured to control the plurality of illuminating light sources individually.

13. The gaming machine according to claim 9, wherein:

the reel has a cylindrical shape, and the reel is configured to be rotated with its cylinder central axis being held at the predetermined position by the reel drive mechanism; and the front light unit is disposed at a position along a direction of rotation of the reel and outside the display window.

14. The gaming machine according to claim 8, wherein the color shifting layer is a color film of which color perceived by a viewer changes depending on a viewing angle.

15. The gaming machine according to claim 14, wherein the color shifting layer is a multilayer optical film having a plurality of layers each configured to selectively reflect specific wavelengths of light.

16. The gaming machine according to claim 15, wherein the color shifting layer has a characteristic that its reflection band shifts toward a shorter wavelength band and becomes narrower as the incident angle decreases.

17. The gaming machine according to claim 16, wherein the color shifting layer has a characteristic that when visible light is applied to the color shifting layer at an incident angle of 90 degrees, the color shifting layer transmits violet, blue, green, and longer-wavelength red light, while the color shifting layer reflects yellow, orange, and shorter-wavelength red light.

18. The gaming machine according to claim 16, wherein the color shifting layer has a characteristic that: when visible light is applied to the color shifting layer at an incident angle of 90 degrees, the color shifting layer transmits violet, blue, green, and longer-wavelength red light, while the color shifting layer reflects yellow, orange, and shorter-wavelength red light; and when the visible light is applied to the color shifting layer at an incident angle of 60 degrees, the color shifting layer transmits violet, shorter-wavelength blue, yellow, orange, and red light, while the color shifting layer reflects longer-wavelength blue and green light.

19. The gaming machine according to claim 8, wherein:

the symbol-printed layer further includes a second region on which the symbols are not located;

a picture pattern in various colors is printed in the second region; and the color shifting layer is laminated in the second region.

* * * * *